US007819395B2

(12) United States Patent
Farmer

(10) Patent No.: US 7,819,395 B2
(45) Date of Patent: Oct. 26, 2010

(54) SELECTIVE DRIVE MECHANISM

(75) Inventor: Geoffrey A. Farmer, Billericay (GB)

(73) Assignee: Pitney Bowes Ltd., Harlow (GB)

( * ) Notice: Subject to any disclaimer, the term of this patent is extended or adjusted under 35 U.S.C. 154(b) by 83 days.

(21) Appl. No.: 11/877,148

(22) Filed: Oct. 23, 2007

(65) Prior Publication Data

US 2008/0150215 A1 Jun. 26, 2008

(30) Foreign Application Priority Data

Dec. 21, 2006 (GB) ..... 0625658.0

(51) Int. Cl.
*B65H 5/00* (2006.01)

(52) U.S. Cl. ..... 271/10.13; 271/10.05

(58) Field of Classification Search ..... 271/10.01, 271/10.05, 10.13
See application file for complete search history.

(56) References Cited

U.S. PATENT DOCUMENTS

| | | | | |
|---|---|---|---|---|
| 3,568,401 | A | 3/1971 | Bonsch | |
| 4,570,919 | A | 2/1986 | Huang | |
| 4,691,911 | A | 9/1987 | Nakagawa et al. | |
| 5,222,724 | A * | 6/1993 | Hirano et al. | 271/10.11 |
| 5,224,698 | A * | 7/1993 | Kobayashi | 271/270 |
| 5,402,996 | A * | 4/1995 | Long | 271/9.07 |
| 5,419,543 | A * | 5/1995 | Nakamura et al. | 271/9.01 |
| 5,738,453 | A | 4/1998 | Tsuburaya et al. | |
| 5,947,465 | A * | 9/1999 | Kato et al. | 271/10.11 |
| 6,367,795 | B1 * | 4/2002 | Matsuda et al. | 271/126 |
| 6,540,219 | B1 * | 4/2003 | Naruse et al. | 271/37 |
| 2003/0025263 | A1 * | 2/2003 | Koga | 271/9.12 |
| 2004/0004321 | A1 * | 1/2004 | Uwagaki et al. | 271/117 |
| 2004/0012140 | A1 * | 1/2004 | Asada et al. | 271/121 |
| 2004/0251598 | A1 * | 12/2004 | Okamoto | 271/147 |
| 2005/0062217 | A1 * | 3/2005 | Asada | 271/162 |
| 2007/0069451 | A1 * | 3/2007 | Iwago et al. | 271/186 |

FOREIGN PATENT DOCUMENTS

| | | |
|---|---|---|
| EP | 1803585 A1 | 7/2007 |
| JP | 60148840 | 8/1985 |
| JP | 61184248 | 8/1986 |

* cited by examiner

*Primary Examiner*—Patrick Mackey
*Assistant Examiner*—Prasad V Gokhale
(74) *Attorney, Agent, or Firm*—Steven J. Shapiro; Angelo N. Chaclas

(57) ABSTRACT

There is provided a sheet handling machine comprising: a drive source; a first driven shaft arranged to receive drive from the drive source at least when the drive source drives in a first direction of rotation; a feed roller shaft; a feed roller mounted on the feed roller shaft for feeding sheets when the feed roller shaft is driven; and a rotatably supported drive transmission for selectively engaging drive transmission from the first driven shaft to the feed roller shaft in dependence upon the rotational position of the drive transmission. A mailpiece creation apparatus is also provided, illustrating one application of such a machine, as well as associated methods for sheet handling and mailpiece creation.

6 Claims, 28 Drawing Sheets

SELECTIVE DRIVE MECHANISM

CROSS REFERENCE TO RELATED APPLICATIONS

This application claims the benefit of the filing date of Dec. 21, 2006, for United Kingdom application number 0625658.0, which is owned by the assignee of the present application.

FIELD OF THE INVENTION

The present invention relates to a sheet handling machine, and to a mailpiece creation apparatus as a particularised form of such a sheet handling machine. The invention also relates to an associated sheet handling method and a mailpiece creation method.

BACKGROUND

Mailpiece creation devices have been known for many years. The basic principle associated with these devices is to provide a machine which can automatically take a mail item (such as a letter printed on a sheet of paper or several sheets of paper, or more cumbersome or less flexible mail items, such as pens, CDs and other items that one might wish to send by post) and insert the mail item into an envelope.

Mailpiece creation devices have traditionally been very large, high production capacity installations. These mailpiece creation devices are industrial in nature and can occupy an entire room. As such, these large-scale mailpiece creation devices represent a production facility in their own right, and require constant maintenance and operation by a team of several specially trained personnel, in order to oversee their efficient operation. These large-scale mailpiece creation devices are utilised to produce a high throughput of mail items created and ready for delivery in mail shots addressed to a target audience of tens- to hundreds-of-thousands of addressees. The requirement for such a capability is usually the preserve of large commercial organisations, such as banks and utilities companies, as well as government institutions.

In order to meet the demands and requirements of these large institutions for delivering large mail shots to their target audiences, such devices have to be capable of providing a large degree of functionality, combined with high accuracy. A machine of this size and scale might typically operate in the following fashion.

Firstly, letters are printed onto blank (or letter-headed) paper as a starting material, the contents of each letter being specific to an individual addressee. The sheet or sheets which form each letter are then collated into the correct order and accumulated together at an accumulation location. The accumulation of sheets is then passed as a unitary collation through a folding mechanism, which folds the collation in a desired way (e.g., either in half or into thirds, depending on the size of envelope into which the sheets are to be inserted).

Envelopes are fed from a separate location, and are typically provided with the envelope flap in a closed position. The envelope is firstly "flapped", to open the flap, before being transported to an insertion location, where the envelope is held with the flap open, exposing the mouth of the envelope for insertion of mail items into the main body of the envelope.

The folded collation of sheets is then inserted into the envelope, along with any secondary mail items, such as flyers, CDs, pens, etc. The envelope, with its contents enclosed, is then passed to a sealer location, where the envelope flap is closed to the main body of the envelope and sealed against it.

For traditional envelopes employing gum on the flap to seal the envelope, a moistener is provided to apply moisture to the underside of the flap as it is brought to the closed position onto the main body.

Since the contents of the mail item to be delivered are specific to the intended recipient, the mailpiece formed in this manner must be correctly addressed to the intended recipient. This may be achieved either by addressing the mail items themselves, at a location that will be visible through a window in the envelope once the mailpiece has been created, or, alternatively, the envelopes themselves may then be individually addressed either by printing onto the envelope or through the application of an appropriately addressed label. In these latter cases, it is necessary to ensure that the mailpiece creation device operates to an extremely high degree of accuracy, so as to ensure that the correct mail items are delivered to the correct recipients.

More recently, smaller businesses have begun to recognise the practical cost and time saving benefits that an automatic mailpiece creation device can provide. Particularly in the case of medium sized enterprises, which might regularly need to send out mail shots to thousands or tens of thousands of addressees, the time savings that can be achieved by using an automatic mailpiece creation device can be significant, not least in terms of the number of main hours of paid time that would previously have been spent on paying employees to prepare and send such mail items.

However, medium sized enterprises typically do not need a mailpiece creation device on the scale of those used by larger corporations. In order to meet the more modest demands of such medium sized enterprises, mailpiece creation devices have been provided that typically operate with a somewhat reduced degree of functionality, as well as with a reduction of throughput capacity in terms of the numbers of mailpieces that can be created within a given time period.

Typical devices of this kind might be of the order of size of a typical photocopier, seen in most offices. These devices would usually take pre-printed sheets as the starting material, loaded into one or more paper trays. The appropriate number of sheets from respective paper trays is then collated together in order and accumulated at an accumulation location, to form a unitary mail item. The mail item thus formed would then be folded, as described above, at which stage a mail insert may sometimes be inserted into the final fold of the folding process, typically if it is desired to include some advertising literature with the mail item. Envelopes are then delivered from a separate location, flapped to open the envelope flap, and held with the flap open at an insertion location. The folded mail item is then inserted into the envelope before the envelope is closed and sealed and the mailpiece ejected for delivery.

Such mailpieces will normally either be addressed on the pre-printed mail items, the address for delivery being visible through a window in the envelope, or would need to be addressed manually, for delivery to the appropriate recipient. Mailpiece creation devices of this type will usually have a lesser degree of functionality than for the industrial sized complexes used by larger organisations, for example perhaps only be suitable for use with a limited number of different sizes of sheets of paper, and a limited number of sizes of envelope.

Most recently, customer demand has pushed for further reduction in the size of such mailpiece creation devices. In particular, developments have been made in attempting to provide mailpiece creation devices suitable for small office and home office (SOHO) use. Small offices tend to produce mail items for smaller readerships, perhaps producing mail shots of only several tens or hundreds of individual mail items for postal delivery. In order to meet the demands of such relatively smaller enterprises, so-called "desktop" mailpiece creation devices have been provided, for use in SOHO environments.

Despite their name, however, such desktop mailpiece creation devices are very much larger than, for example, a typical desktop printer, and would still be utilised as a standalone piece of equipment, for example in the post room of a substantial office building. These SOHO mailpiece creation devices have a reduced throughput capacity, and typically have a greatly reduced degree of functionality, at least in terms of the flexibility of the device to adapt to different sizes of paper or envelope. Such SOHO devices would normally be configured to collate, accumulate, fold and insert paper of one particular size into envelopes of another particular size, before sealing the envelope and ejecting it for delivery. These SOHO devices are typically also limited in terms of the number of sheets that maybe collated to form a mail item, and in terms of any ability to insert irregular sized objections into the envelope. Nevertheless, for many users the ability to quickly produce mail items on standard stationary can be beneficial, and the high throughput (relative to human mailpiece creation capacity) is often welcomed.

In spite of the growing trend in modern offices to move towards electronic communications, such as by facsimile and electronic mail, the number of postal items delivery continues to grow worldwide. This can be largely attributed to increasing correspondence between the Western and Eastern continents, as business relations around the globe continue to expand. With the continued expansion in demand for mailpiece creation devices to meet this growing postal economy, smaller users have come to appreciate the benefits of automatic mailpiece creation devices for their own work. To this end, there has been recognised a growing need for a low flexibility, yet functional and reliable, genuine desktop mailpiece creation device, suitable for use by individuals or small business, for producing limited runs of mail items to more specific target audiences.

The technical considerations that have typically stood in the way of further size reduction of existing mailpiece creation devices are due to some of the specific technical problems encountered with paper handling machines.

For example, paper is not a particularly easy material to manipulate with a mechanical device. Sheets of paper have an inherent stiffness resisting bending, which can make them difficult to advance around tight bends in a paper feed path, or to direct accurately into a desired opening. Similarly, it is desirable to produce mail items that are accurately folded at a desired location, both for aesthetic reasons, as well as to ensure that the folded mail item will fit within the mouth of an envelope.

To produce a fold in a sheet of paper at a desired point along its length, a buckle folder will often be utilised. Such folders operate by feeding a sheet along a so-called buckle chute, so that the sheet is brought to a halt at its leading edge, as it hits against a stop in the chute. As the buckle folder proceeds to feed the sheet in the forwards direction, the sheet is caused to buckle in a direction that is determined by the shape of the buckle chute and its orientation relative to the feed path along which the sheet has arrived. A pair of rollers, forming a folding nip there between, can then be positioned at the location where it is known that the buckle will form. However, the geometry of such a buckle folder is heavily dependent on the desired location of the fold in the sheet of paper, and the relative angles between the inlet feed path along which the sheet arrives and the buckle chute into which the sheet is delivered, in order to produce the buckle assuredly at the desired location.

This fixed geometry has made it difficult to reduce the size of known sheet folding mechanisms, and similar considerations apply to other component parts of a mailpiece creation device. For example, a sheet or envelope cannot be fed around a bend that is too sharp without permanently creasing or bowing the sheet of paper or envelope. Since this is generally undesirable, sheet and envelope feed paths tend to have a minimum radius of curvature which cannot be reduced further, leading to constraints in the design process.

A further consideration facing designers of sheet handling devices has involved known envelope sealing mechanisms. Typically, an envelope is fed with the flap end at the rear, so that the flap (which is initially closed but not sealed) can be opened by a suitable flapping mechanism as the envelope is fed along a feed path. The envelope is then held with the flap open at a mail item insertion location, awaiting insertion of mail items. However, in order to seal the envelope flap, the envelope must first be transported in one direction to a moistening location for applying moisture to the gum adhesive on the underside of the envelope flap, before being reverse-fed, typically around a bend, between a pair of sealing rollers, in order to close and seal the flap to the main body. This sealing process has traditionally made it difficult to incorporate non-flexible or bulky mail items into the mailpiece, as the filled envelope will not generally fit through known sealing mechanisms.

A further constraint in reducing the size of mailpiece creation devices has been the complexity of the mechanisms required in order to perform the various functions of collating and folding a mail item, delivering the mail item to an insertion location, flapping an envelope, delivering the envelope to the insertion location and holding the flap open, inserting the folded mail item into the envelope, moistening the envelope flap, sealing the envelope and ejecting the envelope from the mailpiece creation device. In order to correctly sequence each step in the mailpiece creation process, numerous motors, electronic clutches and sensors must typically be utilised, along with a fairly complex microprocessor program for overseeing the complete operation.

SUMMARY OF THE INVENTION

According to a first aspect of the present invention, there is provided a sheet handling machine comprising: a drive source; a first driven shaft arranged to receive drive from said drive source at least when said drive source drives in a first direction of rotation; a feed roller shaft; a feed roller mounted on said feed roller shaft for feeding sheets when said feed roller shaft is driven; and rotatably supported drive transmission means for selectively engaging drive transmission from said first driven shaft to said feed roller shaft in dependence upon the rotational position of said drive transmission means.

In a preferred embodiment of the sheet handling machine, said drive transmission means comprises: a support arm rotatably supported at a pivot so as to be selectively pivotable between a first angular position in which the transmission means is disengaged from transmitting drive from said first driven shaft to said feed roller shaft and a second angular position in which the transmission means is engaged to transmit drive from said first driven shaft to said feed roller shaft. These preferred embodiments may also further comprise: a drive receiving member mounted on said feed roller shaft for receiving drive so as to drive said feed roller shaft, and wherein said drive transmission means further comprises: a drive transferring member mounted on said support arm spaced apart from the pivot of said support arm, the drive transferring member being disengaged from said drive receiving member when the support arm is in the first position, and being configured to engage said drive receiving member when the support arm is in the second angular position, thereby to transfer drive from said drive transferring member to said drive receiving member so as to drive said feed roller shaft. Even more preferably, in these embodiments of the sheet handling machine, said drive receiving member is a friction roller; said drive transferring member is a friction roller rotationally mounted on said support arm; when the support arm is in the first position, said drive transferring member is frictionally decoupled from said drive receiving member; and when the support arm is in the second position, said drive transferring member is frictionally coupled to said drive receiving member, so that rotation of the drive transferring member causes rotation of said drive receiving member, thereby to transfer drive from said drive transferring member to said feed roller shaft.

In further embodiments of the sheet handling machine: the support arm pivot is arranged coaxially with the rotational axis of said first driven shaft; and the drive transmission means further comprises: a first drive transmission member mounted on said first driven shaft; and a second drive transmission member mounted on said support arm at a location spaced apart from said first drive transmission member and arranged so as to be rotationally coupled to said drive transferring member, the first and second drive transmission members being coupled to one another for transmitting drive from said first drive transmission member to said second drive transmission member, thereby to transmit drive from said first driven shaft to said drive transferring member. In such embodiments, it is possible that: the first drive transmission member is a pulley; the second drive transmission member is a pulley mounted on a common shaft with the drive transferring member; and the drive transmission means further comprises a drive belt that couples said first and second drive transmission members.

In yet further embodiments of the sheet handling machine, the first driven shaft is arranged to receive drive from said drive source only when the drive source drives in the first direction of rotation. In this case, the first driven shaft may be arranged to receive drive from said drive source via a one-way clutch.

In even further embodiments, the sheet handling machine further comprises: a jack shaft coupled to the drive source to receive drive from said drive source in both directions of rotation; and shaft driving means operable to rotationally couple said jack shaft and said first driven shaft at least when the jack shaft receives drive from said drive source driving in said first direction of rotation. Here, said shaft driving means may comprise: a first jack shaft pulley mounted on said jack shaft; a shaft driving pulley mounted on said first driven shaft; and a driving means drive belt connected around at least said first jack shaft pulley and said shaft driving pulley, thereby to drive said first driven shaft by said jack shaft when said drive source is driven at least in said first direction of rotation. Even more preferably, said shaft driving means further comprises: a driving means belt tensioner including a pulley supported so as to be biased into engagement with said driving means drive belt, thereby to maintain tension in said driving means drive belt. In a preferred form of such embodiments, said first jack shaft pulley may be mounted on said jack shaft by a one-way clutch, thereby to drive said jack shaft pulley, said driving means drive belt and at least said shaft driving pulley, only when said drive source drives in said first direction of rotation. Performance may be improved further in embodiments where the driving means belt tensioner pulley is mounted on a one-way clutch arranged to resist continued motion of the driving means drive belt and connected pulleys in their driven direction after drive from the drive source in said first direction of rotation has ceased.

In still further embodiments of the sheet handling machine, the machine comprises: a plurality of feed roller shafts arranged to receive drive from said drive source at least when the drive source drives in said first direction of rotation; and a corresponding plurality of feed rollers mounted on respective ones of said feed roller shaft for feeding sheets when said feed roller shafts are driven.

In still even further embodiments, the sheet handling machine further comprises: a second driven shaft arranged to receive drive from said drive source only when said drive source drives in a second direction of rotation opposite to the first direction of rotation; at least one further feed roller shaft having a feed roller mounted thereon for feeding sheets when said at least one further feed roller shaft is driven; and a second rotatably supported drive transmission means for selectively engaging drive transmission from said second driven shaft to said at least one further feed roller shaft in dependence upon the rotational position of said second drive transmission means.

In another preferred series of embodiments of the sheet handling machine, said drive transmission means comprises: a cam shaft arranged to receive drive from said drive source at least when said drive source drives in a second direction of rotation which is opposite to said first direction of rotation; a cam rotatably supported to rotate with the cam shaft, the cam defining a cam surface; a drive engaging support means, including a cam follower constrained to maintain contact with the cam surface, wherein the cam surface is shaped to vary the position of the cam follower as the rotational position of the cam is varied with rotation of the cam shaft, thereby to actuate the drive engaging support means in order to selectively engage drive transmission from said first driven shaft to said feed roller shaft in dependence upon the rotational position of said cam. Preferably, the cam follower is biased into engagement with said cam surface so as to constrain said cam follower to maintain contact with the cam surface as the rotational position of the cam varies. It is further preferred that said drive engaging support means is pivotally mounted, such that the rotational position of the drive engaging support means varies, between a first angular position in which said transmission means is disengaged from transmitting drive from said first driven shaft to said feed roller shaft and a second angular position in which said transmission means is engaged to transmit drive from said first driven shaft to said feed roller shaft, as the rotational position of the cam varies.

In yet further preferred embodiments of the sheet handling machine, the described drive engaging support means is operable to actuate the support arm discussed above, so as to pivot the arm at the same time as the drive engaging support means between respective first angular positions, in which the transmission means is disengaged from transmitting drive from said first driven shaft to said feed roller shaft, and the respective second angular positions, in which the transmission means is engaged to transmit drive from said first driven shaft to said feed roller shaft In yet even further preferred embodiments including a cam, said first driven shaft is configured to receive drive from said drive source only when said drive source is driving in the first direction, and said cam shaft is configured to receive drive from said drive source only when said drive source is driving in the second direction. In this manner, preferred embodiments may be realised in which the sheet handling machine further comprises: a second driven shaft arranged to receive drive from said drive source only when said drive source drives in the second direction of rotation; at least one further feed roller shaft having a feed roller mounted thereon for feeding sheets when said at least one further feed roller shaft is driven; a second rotatably supported drive transmission means for selectively engaging drive transmission from said second driven shaft to said at least one further feed roller shaft in dependence upon the rotational position of said second drive transmission means, wherein said second drive transmission means comprises: a second cam shaft arranged to receive drive from said drive source only when said drive source drives in the first direction of rotation; a second cam rotatably supported to rotate with the second cam shaft, the second cam defining a second cam surface; a second drive engaging support means, including a second cam follower constrained to maintain contact with the second cam surface, wherein the second cam surface is shaped to vary the position of the second cam follower as the rotational position of the second cam is varied with rotation of the second cam shaft, thereby to actuate the second drive engaging support means in order to selectively engage drive transmission from said second driven shaft to said at least one further feed roller shaft in dependence upon the rotational position of said second cam.

In the foregoing embodiments, further advantage may be derived in embodiments of the sheet handling machine where the drive source includes a single motor.

In alternative still preferred embodiments of the sheet handling machine, the drive source includes two motors, which are located in the sheet handling machine on opposite sides of a feed path which passes through the machine, thereby to provide a separate drive source for roller shafts in the sections on each side of said feed path; and the machine can be opened at the paper feed path, thereby to split said two sections so as to allow an operator manual access to the feed path.

In yet more preferred embodiments of the sheet handling machine, at least one feed roller of the sheet handling machine forms a component in at least one of the following sheet handling mechanisms: a sheet separator for separating a single sheet from a stack of paper; a sheet feeder for feeding a sheet along a feed path; a sheet deskew roller pair for aligning the leading edge of a sheet fed along a feed path; a sheet folding station for folding a sheet; a sheet insertion station for inserting a sheet into an envelope; an envelope separator for separating a single envelope from a stack of envelopes; an envelope feeder for feeding an envelope along a feed path; an envelope flap securing mechanism for securing an envelope flap in an open state; an envelope sealing mechanism for closing and sealing the envelope flap to a main body of the envelope; and a mailpiece feeder for feeding a mailpiece along a feed path.

The invention further provides that the sheet handling machine may be embodied by a mailpiece creation apparatus for creating mailpieces by inserting paper sheets into envelopes.

In preferred embodiments of such a mailpiece creation apparatus, said apparatus comprises a sheet folder for folding a paper sheet prior to insertion of the sheet into an envelope, said sheet folder comprising: a folder inlet feed path; a driven fold roller; at least one cooperating fold roller, the driven fold roller and said at least one cooperating fold roller forming a folding nip therebetween; a buckle feed path for receiving a predetermined portion of a sheet therein from the folder inlet feed path; and a buckle finger located adjacent to said folding nip and being configured to be actuated between a standby position, in which the buckle finger does not interfere with a sheet extending from the folder inlet feed path to the buckle feed path, and an interference position, in which the buckle finger extends into the path of a sheet extending from the folder inlet feed path to the buckle feed path, wherein the buckle finger is configured to extend to the interference position so as to deflect a buckle forming in a sheet extending into the buckle feed path into the folding nip, thereby to resist a buckle forming in the sheet in a direction away from the folding nip.

In further preferred embodiments of the mailpiece creation apparatus, the sheet folder comprises: two cooperating fold rollers, each forming a respective folding nip with the driven fold roller; and a corresponding buckle finger associated with each folding nip, the fold rollers and buckle fingers being arranged to perform two successive folding operations on a sheet passing through the sheet folder.

According to a second aspect of the present invention, there is provided a sheet handling method for driving sheets using a drive source coupled to first and second drive shafts which are engageable with respective first and second feed rollers, comprising the steps of: driving in a first driving direction of the drive source so as (i) to rotate a first drive transmission member to a first predetermined angular position, thereby engaging the first drive shaft with the first feed roller, and (ii) to drive the second drive shaft; driving in a second driving direction of the driving source, which is opposite to the first driving direction, so as (i) to drive said first drive shaft to transmit drive to said first feed roller, thereby advancing a sheet at the first feed roller, and (ii) to rotate a second drive transmission member to a respective first predetermined angular position, thereby engaging the second drive shaft with the second feed roller; driving in the first direction of the driving source so as (i) to rotate said first drive transmission member to a second predetermined angular position, thereby disengaging the first drive shaft from the first feed roller, and (ii) to drive said second drive shaft to transmit drive to said second feed roller, thereby advancing a sheet at the second feed roller; and driving in the second driving direction of the driving source so as (i) to drive the first drive shaft, and (ii) to rotate the second drive transmission member to a respective second predetermined angular position, thereby disengaging the second drive shaft from the second feed roller.

Preferred embodiments of this method also include the steps of: making a first detection of a position of the sheet advanced at the first feed roller; and switching the direction of driving of the drive source from the second driving direction to the first driving direction when a predetermined first detection is made. More preferably, embodiments of this method may instead or further include the steps of: making a second detection of a position of the sheet advanced at the second feed roller; and switching the direction of driving of the drive source from the first driving direction to the second driving direction when a predetermined second detection is made.

According to a third aspect of the present invention, there is provided a mailpiece creation method including the steps of: advancing a sheet a predetermined distance into a buckle feed path and halting the sheet leading edge against further advancement; further advancing the sheet from behind the leading edge, thereby causing a buckle to form in the sheet at an associated predetermined distance along the sheet; deflecting the buckle with a buckle finger to direct the buckle in a predetermined direction into a folding nip between a pair of fold rollers; driving the buckle between said fold rollers to form a fold in the sheet at the associated predetermined distance along the sheet; and inserting the folded sheet into an envelope.

Preferred embodiments of this method may also include, before inserting the folded sheet into an envelope, the steps of: advancing the folded sheet from between said fold rollers a further predetermined distance into a further buckle feed path and halting the folded leading edge of the sheet against further advancement; further driving the sheet between the fold rollers, thereby causing a further buckle to form in the sheet at an associated further predetermined distance along the sheet; deflecting the further buckle with another buckle finger to direct the further buckle in a predetermined direction into a further folding nip between another pair of fold rollers; and driving the buckle between said another pair of fold rollers to form a further fold in the sheet at the associated further predetermined distance along the sheet.

BRIEF DESCRIPTION OF THE DRAWINGS

To enable a better understanding of the invention, and to show how the same may be carried into effect, reference will now be made, by way of example only, to the accompanying drawings, in which.

DETAILED DESCRIPTION

An illustrative example of a paper handling machine in the form of a mailpiece creation apparatus will now be described with reference to the accompanying drawings.

Figure 1:
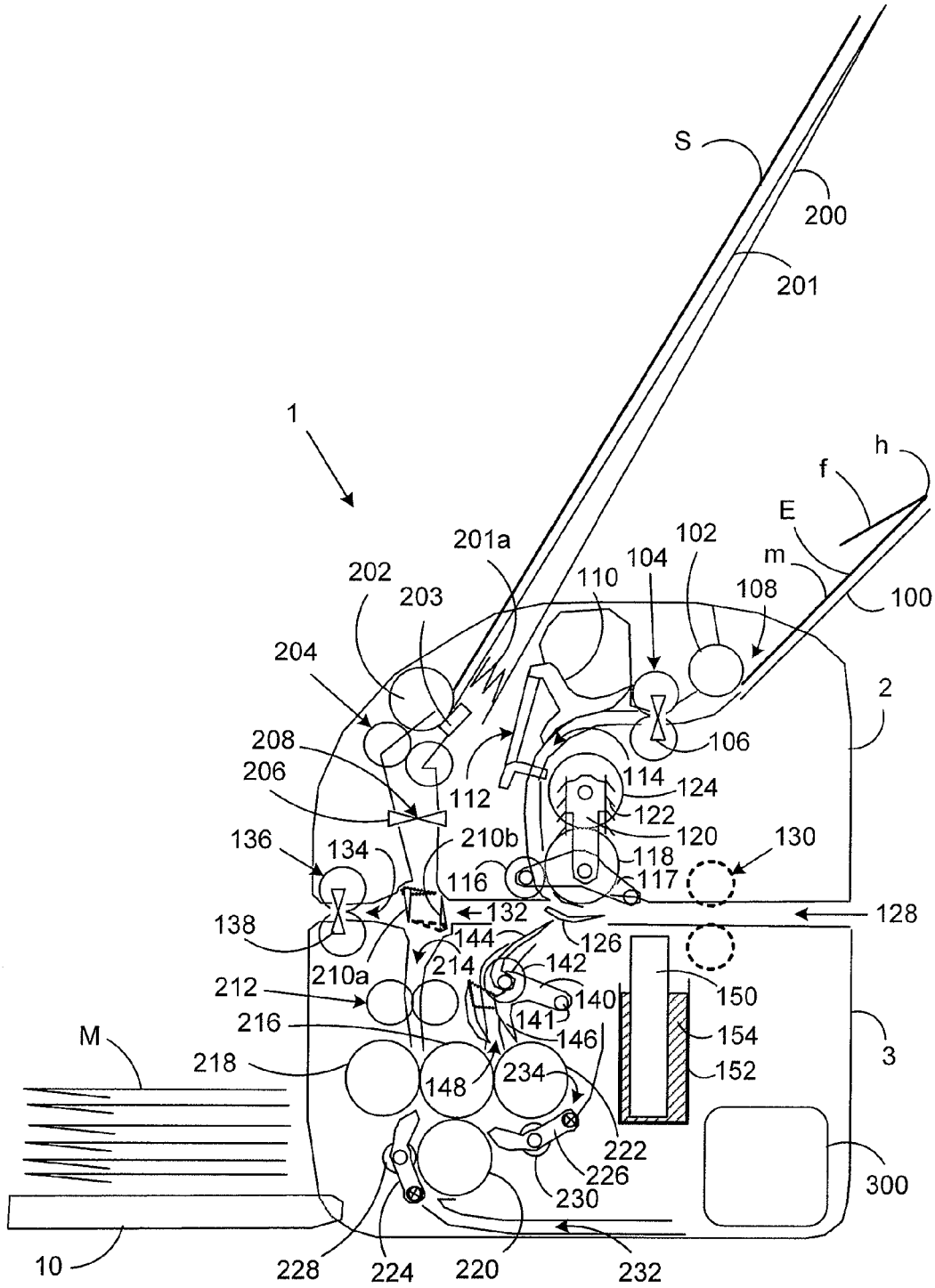
FIG. 1 is a cross-sectional side view of an embodiment of a mailpiece creation apparatus in accordance with the present invention.

Referring firstly to FIG. 1, an outline will be given of the construction of the mailpiece creation apparatus in terms of the major functional components thereof for carrying out sheet and envelope handling processes.

Figure 9:
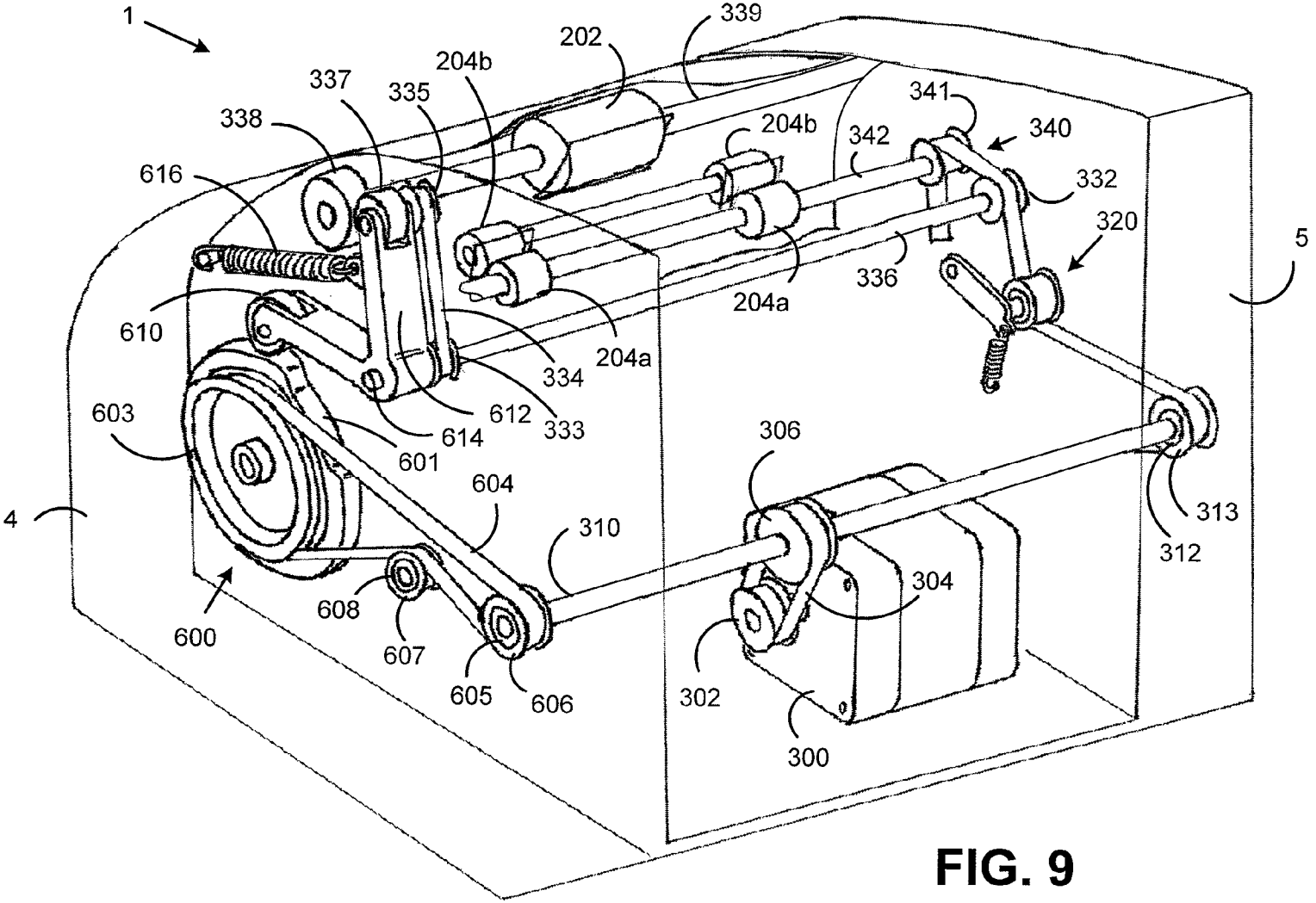
FIG. 9 is a perspective view of the same components shown in FIGS. 7 and 8, indicating how these components may be arranged within a housing of the mailpiece creation apparatus.

The mailpiece creation apparatus 1 is contained generally within a housing consisting of an upper housing 2 and a lower housing 3, through which the various sheet and envelope feed paths for the different sheet and envelope handling stations are located. Referring briefly to FIG. 9, it will be seen that the housing further comprises right- and left-side housing compartments 4 and 5, respectively, for housing the various drive and control mechanisms associated with the sheet and envelope handling stations shown in FIG. 1.

Located generally at the bottom front of the mailpiece creation apparatus 1 is a mailpiece collection tray 10, arranged to receive mailpieces M ejected from mailpiece outlet feed path 134. The mailpiece collection tray 10 is pivotally mounted to the housing of the mailpiece creation apparatus 1 so as to be retractable from the open collection position shown in FIG. 1 to a closed, retracted position located in a recess in the front of the housing between side housing portions 4 and 5. This reduces the external profile of the mailpiece creation apparatus 1, so as to occupy less space when not in use, and for transport, etc.

At the top of the mailpiece creation apparatus 1 is located an envelope tray 100 for storing a plurality of envelopes E in a stack, ready for insertion into the mail piece creation apparatus 1. The envelope tray 100 is located adjacent to an envelope inlet feed path 108, through which envelopes E can enter the mailpiece creation apparatus 1. Also located at the top of the mailpiece creation apparatus 1 is a sheet tray 200, for storing a plurality of sheets S in a stack thereon. Sheet tray 200 is located adjacent to a sheet inlet feed path 208, through which sheets S enter the mailpiece creation apparatus 1. In the particular disclosed embodiment of FIG. 1, the sheet tray 200 supports the stack of sheet S on a sheet tray upper plate 201 which is mounted to the main structure of the sheet tray 200 by a sheet tray upper plate spring 201*a*. The sheet tray upper plate 201 is biased away from the sheet tray 200 main body, so as to compensate for the thickness of sheets S in a stack loaded on the sheet tray 200, to ensure that the upper sheet S is always located adjacent to the sheet inlet feed path 208, ready for feeding into the mailpiece creation apparatus 1.

In a similar fashion as for the mailpiece collection tray 10, the envelope tray 100 and sheet tray 200 preferably either are removable from the machine, so as to reduce the volume occupied by the machine when not in use or for transport, etc., or are constructed so as to be retractable to a low profile configuration either retracted into or flush with the housing. In one preferred form, the sheet tray 200 may be made telescopic, so as to have an extendable length for supporting sheets in an extended configuration, and being retractable to a compact configuration for storage. The retractability and storage capability of the mailpiece collection tray 10, envelope tray 100 and sheet tray 200 can advantageously reduce the space occupied by the mailpiece creation apparatus 1 when not in use, and results in a configuration that is similar in size to a typical desktop printer or scanner unit, commonly found in applications where the printer is directly connected to a home computer. Accordingly, the mailpiece creation apparatus 1 can be truly said to be a "desktop" mailpiece creation apparatus, being of a size suitable for storage within the region of an individual person's work space, without completely occupying the available working surface of their desk.

In the illustrated embodiment of the mailpiece creation apparatus 1 of FIG. 1, the envelope tray 100 is configured to stack envelopes E ready for insertion into the apparatus 1 via the envelope inlet feed path 108. The mailpiece creation apparatus 1 is configured to function with envelopes E that consist of a main body m and a flap f attached to the main body by a hinge h, about which the flap f is rotatable relative to the main body m. The mailpiece creation apparatus 1 is configured to receive envelopes E in a stack with the flaps f of each envelope E in a closed position (but not sealed), with the envelopes being stacked with the flap f facing upwards and the hinge h located furthest from the envelope inlet feed path 108.

At the location of the envelope inlet feed path 108 there is provided an envelope separation roller 102, configured to feed a single envelope E from the stack of envelopes loaded on the envelope tray 100, and to advance the separated single envelope E into the envelope inlet feed path 108. The envelope E is advanced until it arrives at an envelope inlet feed roller pair 104, consisting of a driven feed roller 104*a* and a cooperating feed roller 104*b* (see FIG. 2). As the leading edge of the envelope E arrives between the envelope inlet feed roller pair 104, its presence is detected by an envelope inlet sensor 106.

From this position, the envelope E is then driven along an envelope flapping path 114 by the envelope inlet feed roller pair 104. An envelope flapper mechanism 110 is provided adjacent to the envelope flapping path 114, for carrying out a so-called "stripping" operation by inserting a blade edge 167 (see FIG. 11A) between the envelope main body m and the closed envelope flap f, as the envelope is fed along the envelope flapping path 114. This causes the envelope flap f to separate from the envelope main body m, thereby opening the envelope E by rotating the flap f relative to the envelope main body m about the hinge h. The envelope flapper mechanism 110 is actuated by an envelope flapper link mechanism 112, partially located within the envelope flapping path 114. As the leading edge of the envelope E advances to and makes contact with the envelope flapper link mechanism 112, the envelope flapper mechanism 110 is actuated so as to bring the blade edge 167 into the envelope flapping path 114, in advance of the leading portion of the envelope flap f.

The envelope E is then further advanced around the envelope flapping path 114 until the leading edge is brought into engagement with a driven sealing feed roller 118 and a cooperating envelope flap securing roller 116, which together form a nip for securing the envelope flap f in the envelope flapping path 114. As the envelope E is advanced around the envelope flapping path 114, drive of the envelope E is transferred from the envelope inlet feed roller pair 104 to the cooperating rollers 116 and 118, to further advance the envelope into the mailpiece creation apparatus 1. Envelope sealing feed roller 118 and envelope flap securing roller 116 are maintained in cooperating engagement with one another by an envelope securing frame 117 which maintains these rollers at a fixed predetermined spacing. In an alternative embodiment, the flap securing roller 116 may be maintained in cooperating engagement with the sealing feed roller 118 by use of an appropriate biasing means for biasing the flap securing roller 116 against the envelope sealing feed roller 118.

As the envelope E is further advanced by the cooperating roller pair of envelope sealing feed roller 118 and envelope flap securing roller 116, the leading edge is guided by a trapdoor 126 forming part of the envelope feed path, so as to direct the envelope leading edge into an envelope insertion path 128. The envelope E is fed into the envelope insertion path 128 until substantially the entire main body m of the envelope E is located within the envelope insertion path 128, while the envelope flap f is maintained in a secure manner between the envelope sealing feed roller 118 and the envelope flap securing roller 116. By applying an appropriate braking mechanism to the envelope securing roller 116 or the envelope sealing feed roller 118, the envelope flap f can be secured so as to hold the flap f open with the envelope main body m located in the insertion feed path 128. The envelope E is thus presented in a condition suitable to receive mail items into the envelope E, since it is held with the envelope mouth open and the flap f securely held.

In the illustrated embodiment of FIG. 1, it would be possible to insert additional mail items into the envelope E held in this configuration, by inserting such mail items from the left hand side (as seen in FIG. 1) of the mailpiece creation apparatus 1 along the mailpiece outlet feed path 134 and mailpiece feed path 132, although the mailpiece creation apparatus 1 of the illustrated embodiment is not specifically configured for this purpose, per se.

The embodiment of the mailpiece creation apparatus 1 disclosed herein is configured to form a mail item by folding a sheet S, for insertion into an envelope E held open at the insertion feed path 128 in the manner described above. Although it is possible to configure the mailpiece creation apparatus 1 so as to form mail items comprising two or more sheets, the illustrated example of a mailpiece creation apparatus 1 is configured for forming mail items consisting of a single folded sheet S, to be inserted into the envelope E.

To form the mail item, a sheet S is fed from the top of a stack of sheets loaded into the sheet tray 200. A sheet separation roller 202 and a sheet separation block 203 are provided at the opening to the sheet inlet feed path 208, to feed a single sheet S from the top of the stack of sheets and into the opening of the sheet inlet feed path 208. The single sheet S is advanced by the sheet separation roller 202, while the sheet separation block 203 functions to retard any further sheets in the stack, to prevent them being simultaneously fed into the sheet inlet feed path 208, for example due to frictional forces between the sheets in the stack. The separated single sheet S is advanced along the sheet inlet feed path 208 between a sheet inlet feed roller pair 204, until the leading edge of the sheet S is detected at a sheet inlet sensor 206. The single sheet S may be advanced to this point either by the sheet separation roller 202, or, more preferably, by the sheet inlet feed roller pair 204. Sheet inlet feed roller pair 204 comprises a sheet inlet driven feed roller 204*a* and a cooperating sheet inlet feed roller 204*b*. The sheet inlet sensor 206 is located in the sheet inlet feed path 208 at a location suitable not only to detect advancement of the leading edge of the sheet S into the sheet inlet feed path 208, but also, later, to detect when the trailing edge of the sheet S has passed that point in the sheet inlet feed path 208.

As the sheet S is further advanced along the sheet inlet feed path 208, it passes between a pair of feed path selector flaps 210*a* and 210*b*, which serve to selectively open or close the path of advancement from the sheet inlet feed path 208 into a sheet folder inlet path 214, which, at the same time, serves to selectively close or open, respectively, a path of advancement from mailpiece feed path 132 to mailpiece outlet feed path 134. Although the feed path selector flaps 210*a* and 210*b* do function, in one of their respective positions, to close the passages against sheets or mailpieces flowing in the cross direction, their primary purpose is to provide movable guide sections that form the edges of the guide path for guiding sheets and mailpieces from the sheet inlet feed path 208 to the sheet folder inlet path 214, or from the mailpiece feed path 132 to the mailpiece outlet feed path 134, respectively. That is to say, the primary purpose of feed path selector flaps 210*a* and 210*b* is to act as guide means between the relevant sections of feed path.

A sheet S advanced across the gap between feed path selector flaps 210*a* and 210*b* is advanced into the sheet folder inlet feed path 214 and into engagement with a sheet folder deskew roller pair 212 located in the sheet folder inlet path 214. Sheet folder deskew roller pair 212 comprises a driven deskew roller 212*a* and a cooperating deskew roller 212*b*, which cooperate to feed the sheet S along the sheet folder inlet feed path 214.

Deskew roller pair 212 is so named due to its function of de-skewing, or aligning, the sheet S leading edge, prior to advancing the sheet S into the sheet folder section of the mailpiece creation apparatus 1. As the single sheet S is first advanced into engagement with the deskew roller pair 212, the deskew roller pair arrests the leading edge of the sheet. As the sheet is further advanced by sheet inlet roller pair 204, it is caused to buckle in the section of feed path between the sheet inlet roller pair 204 and the sheet folder deskew roller pair 212. As the buckle forms, the leading edge of the sheet S is forced into the nip between sheet folder deskew rollers 212*a* and 212*b*, forcing the leading edge of the sheet S to become aligned in this deskew roller nip.

Drive is then transferred to the sheet folder deskew roller pair 212, for advancing the sheet S further along the sheet folder inlet path 214 and into the sheet folder section of the mailpiece creation apparatus 1.

As the sheet S is advanced into the sheet folder section, it passes between a driven sheet folder roller 216 and a first cooperating folder roller 218, which together form a nip in the sheet folder inlet feed path 214. Driven sheet folder roller 216 and first cooperating folder roller 218 are then driven to advance the sheet S into the sheet folder section, and into a first buckle chute 232. A first buckle finger 224 includes a first finger roller 228, which together with a second cooperating folder roller 220 forms a nip at the entrance into the first buckle chute 232. After the sheet S has been advanced a predetermined distance into the first buckle chute 232, further advancement of the sheet is halted, causing a buckle to form in the sheet S at a location in the vicinity of the first buckle finger 224. One method for halting further advancement of the sheet S is to close the first finger roller 228 onto the second cooperating folder roller, closing that nip and halting the sheet S. Another method is to provide a stop in the first buckle chute 232, to halt the sheet S at the leading edge. First buckle finger 224 is then actuated so as to direct the buckle in the sheet S into a nip between the driven sheet folder roller 216 and the second cooperating folder roller 222. In particular, the first buckle finger 224 is operable to prevent the buckle from forming in the sheet S in a direction other than towards the nip between folder rollers 216 and 222. In this manner, the buckle can be formed in the sheet S at a predetermined and predictable point along the sheet S, determined by the configuration of the first buckle chute 232, the orientation of the sheet folder rollers 216, 218 and 220, and the positioning of the first buckle finger 224.

After the buckle is pressed into the roller nip between driven sheet folder roller 216 and second cooperating folder roller 220, which rotates in cooperation with the driven sheet folder roller 216, the buckle is driven between the cooperating sheet folder roller pair and forced through the nip formed between driven sheet folder roller 216 and the second cooperating folder roller 220, so as to form a fold in the sheet S at the location of the buckle. The sheet S then continues to be fed through the nip between folder rollers 216 and 220, and into a second buckle chute 234.

A second buckle finger 226 and an associated second finger roller 230 are provided at the entrance into the second buckle chute 234. The second finger roller 230 and a third cooperating folder roller 222 together form a nip at the inlet to the second buckle chute 234. After the sheet S has been advanced a predetermined distance into the second buckle chute 234, further advancement of the leading edge of the sheet is halted, while the sheet S continues to be advanced towards the second buckle chute 234 by the driven folder roller 216 and the second cooperating folder roller 220. Again, the second finger roller 230, can be configured to halt advancement of sheet S by clamping the sheet S in the nip formed with the third cooperating roller 222, or the sheet S leading edge may be halted by other means, such as a stop in the second buckle chute 234. In a similar manner as with the first buckle chute 232, this causes a further buckle to form in the sheet S at a predetermined point along the length of the sheet. Buckle finger 226 is then actuated so as to divert the further buckle into the roller nip formed between driven sheet folder roller 216 and the third cooperating folder roller 222. In particular, the buckle finger 226 is operative to prevent the buckle from forming in a direction away from the roller nip between driven sheet folder roller 216 and the third cooperating sheet folder roller 222. With the sheet having been pressed into the nip between the driven sheet folder roller 216 and the third cooperating folder roller 222, the buckle is then forced through the nip so as to form a further fold at the location of the further buckle. As the driven sheet folder roller 216 continues to be driven, the sheet becomes fully fed between the nip between the driven sheet folder roller 216 and the third cooperating sheet folder roller 222, and is advanced along a sheet insertion feed path 148.

In the configuration set out in the illustrated embodiment, the sheet folder section of the mailpiece creation apparatus 1 produces a so-called C-fold, although a similar arrangement may be utilised for producing Z-folds and double-folded sheets, also.

What will be appreciated is that the first and second buckle chutes 232 and 234, as they are depicted in FIG. 1, would tend to force the sheet S into forming a buckle in a direction away from the sheet folding nips between sheet folder roller 216 and second cooperating folder roller 220 and between sheet folder roller 216 and third cooperating folder roller 222, respectively. By providing the first and second buckle fingers 224 and 226, respectively, adjacent to these nips between the folder rollers, the buckles can be assuredly diverted into the folding nips, while allowing the buckle chutes 232 and 234 to be configured with greater design freedom within the mailpiece creation apparatus 1 so as to occupy a smaller volume within the apparatus than has been achievable with conventionally arranged sheet folders and buckle chutes.

It can be seen from the constructional layout of the sheet folder section in FIG. 1, and from the shape of the first and second buckle fingers 224 and 226, that the buckle fingers 224 and 226 provide a dual function not only of nudging the buckles into the respective folder roller nips, but also of forming part of the guide path for the sheet S as it is advanced into the first and second buckle chutes 232 and 234 respectively. As a replacement for the buckle chutes 232 and 234 and the buckle fingers 224 and 226, similarly arranged buckle chutes could be provided which are configured to form a so-called "S" buckle, that is to say, a buckle in the sheet S which is simultaneously buckled both in a first direction, near the entrance to the buckle chute, away from the respective folder roller nip, and also in a second direction, towards the respective folder roller nips, at a second point nearer to the folder roller nips, thus adopting an S-shaped profile in cross-section. This may be achieved by appropriately configuring the inner curvature of the buckle chutes around the second cooperating folder roller 220 and third cooperating folder roller 222, respectively. However, such S-buckle buckle chutes are restrictive in their flexibility for handling stiffer sheets, since they necessitate forming two buckles in a single sheet, which can lead to unwanted creasing of the paper, before the fold has been formed in the sheet at the desired location. Furthermore, the requirement to bend the sheet simultaneously in two different directions can lead to unwanted bowing of the sheet, and will tend to reduce the accuracy of the fold placement along the length of the sheet.

As shown in FIG. 1, the mailpiece creation apparatus 1 includes an insertion frame 140 that is rotatably mounted on a pivot 141. The insertion frame 140 supports an insertion frame guide 146 that defines both sides of a portion of a sheet feed path, for guiding sheets through the insertion frame. The insertion frame 140 further includes an insertion roller 142 for feeding sheets S that have been advanced through the insertion frame guide 146. Insertion fingers 144 are mounted coaxially with the insertion roller 142, biased in the anti-clockwise direction as shown in FIG. 1.

In FIG. 1, the insertion frame 140 is in a retracted position, from which it can rotate clockwise about pivot 141 into an insertion position. As the insertion frame 140 rotates from the retracted position into the insertion position, insertion fingers 144 push up into the envelope insertion path 128 by displacing trapdoor 126 towards the driven envelope sealing feed roller 118. This is possible, since the trapdoor 126 is pivotally mounted to a support frame, biased in the clockwise direction as viewed in FIG. 1.

In the insertion position, the insertion frame 140 is positioned so that the insertion frame guide 146 forms a continuation of the sheet insertion feed path 148 leading from the sheet folder section. The insertion frame guide 146 directs sheets S, fed along the sheet insertion feed path 148, between the trapdoor 126 and the insertion fingers 144, into the envelope insertion path 128. When an envelope E is secured in the envelope insertion path 128, with the flap f secured between the flap securing roller 116 and the driven envelope sealing feed roller 118, the insertion fingers 144 project into the mouth of the envelope E so as to hold the mouth of the envelope E wide open for the insertion of a mail item thereinto. A mail item (such as the folded sheet S) advanced along sheet insertion feed path 148 and through insertion frame guide 146 is engaged by the insertion roller 142. The insertion roller 142 is ideally situated then further to advance the mail item between the displaced trapdoor 126 (which functions to push the top of the envelope mouth upwards, and the insertion fingers 144, which function to force the bottom of the envelope mouth downwards, thereby holding the mouth of the envelope E open as the insertion roller 142 is driven to advance the mail item into the main body m of the envelope E). After the mail item has been inserted into the envelope E, the insertion frame 140 can again be retracted, allowing the trap door 126 to return to its original position.

The driven envelope sealing feed roller 118 is mounted, with the envelope securing roller 116, to a common envelope securing frame 117, as noted above. The envelope securing frame 117 is mounted to rotate about a pivot 572 (see FIGS. 18A, 19A and 19B).

Driven envelope sealing feed roller 118 is also mounted to an envelope sealer frame 120, to which is mounted a cooperating envelope sealing roller 124 that is held in biased engagement with the driven envelope sealing feed roller 118. The envelope sealer frame 120 is constrained to follow a substantially vertical envelope sealer guide 122. This enables the envelope sealer frame 120 to descend from the position shown in FIG. 1 across the envelope insertion path 128, through the location of the trapdoor 126, to an envelope sealing position in which the nip formed between driven envelope sealing feed roller 118 and cooperating envelope sealing roller 124 is located in the envelope insertion path 128. As the envelope sealer frame 120 descends in this manner, the envelope securing frame 117 is caused to rotate about the pivot 572. Thus, as the envelope sealer frame 120 descends, the flap f of an envelope E secured between the envelope flap securing roller 116 and the driven envelope sealing feed roller 118 is caused to partially close by rotating about the envelope hinge h. However, because the flap f is secured in the securing nip between envelope securing roller 116 and driven envelope sealing feed roller 118, the envelope flap remains secured for substantially the entire transition of the envelope sealer frame 120, due to the pivotal motion of the envelope securing frame 117. During this process, the envelope E is positioned with the main body m located substantially entirely within the envelope insertion path 128, such that the position of the envelope main body m and its contents, as well as the location of the envelope hinge h, remains substantially unaltered. With the envelope sealer frame 120 descended to the envelope sealing position, the sealing nip between the driven envelope sealing feed roller 118 and the cooperating envelope sealing roller 124 is brought into alignment, and substantially into engagement, with the hinge h of the envelope E held in the envelope insertion path 128.

A moistener wick 150 is located beneath the envelope insertion path 128, proximate to where the underside of the envelope flap f is descended to as the envelope sealer frame 120 moves from the flap securing position to the envelope sealing position, for applying moisture to the underside of the flap f, in order to moisten the sealing gum on gum-sealed envelopes of a known type. The moistener wick 150 is moistened by moistener fluid 154 held in a moistener fluid container 152.

Located on opposite sides of the envelope insertion path 128 is an envelope insertion path feed roller pair 130, comprising a driven envelope insertion path feed roller 130*a* and a cooperating envelope insertion path feed roller 130*b*, that can selectively be brought into engagement with an envelope E held in the envelope insertion path 128. To fully close and seal the envelope E, envelope insertion path feed roller pair 130 is brought into engagement with the envelope main body m, and driven to advance the hinge h of the envelope E into engagement with the sealing nip between driven envelope sealing feed roller 118 and cooperating envelope sealing roller 124.

Driven envelope sealing feed roller 118 is then driven to advance the envelope E through the sealing nip, with the hinge h first. This driving motion releases the flap f of the envelope E from the securing nip between the driven envelope sealing feed roller 118 and the envelope flap securing roller 116, as the envelope E is advanced. Due to the inherent resiliency of the material of the envelope flap f, this release from the securing nip will bring the underside of the envelope flap f into contact with the moistener wick 150, if such contact has not already been effected, as the flap f straightens towards its previous unsecured state. The driven envelope sealing feed roller 118 is then further driven to advance the envelope E completely through the sealing nip between driven envelope sealing feed roller 118 and cooperating envelope sealing roller 124, bringing the envelope flap f fully into contact with the envelope main body m, in a pressing engagement. This seals the flap f to the envelope main body m, to form a completed mail piece M.

As an alternative to relying on the inherent resiliency of the flap 8, the flap may be brought into contact with the moistener wick 150 by positively engaging the flap f with the moistener wick 150. One method for achieving this is to alter the holding position of envelope E in the envelope insertion path 128, or to reduce the radius of the driven envelope sealing feed roller 118, so as to cause the flap f to buckle as the envelope sealer frame 120 descends to the sealing position. The moistener wick 150 can then be appropriately placed to engage the buckled flap. Another method is to attach a portion of the feed path (shown as 117*a* in FIGS. 19A and 19B) to the envelope securing frame 117 and the sealer securing and actuating frame 570 (see FIG. 19B). The portion 117*a* is located between the driven envelope sealing roller 118 and the envelope flap f, and is configured so that, as the envelope sealer frame 120 moves into the envelope sealing position, it presses the flap f into contact with moistener wick 150.

The driven envelope sealing feed roller 118 is then driven further, to advance the mail piece M along mail piece feed path 132. Feed path selector flaps 210*a* and 210*b* are switched from their earlier position, which allowed passage from the sheet inlet feed path 208 to the sheet folder inlet path 214, so as to instead allow passage between the mailpiece feed path 132 and the mailpiece outlet feed path 134. As noted above, feed path selector flaps 210*a* and 210*b* operate as portions of the continuous guide path from mailpiece feed path 132 through to mailpiece outlet feed path 134. The completed mailpiece M is thus brought into engagement with mailpiece outlet feed roller pair 136. Mailpiece outlet feed roller pair 136 includes driven mailpiece outlet feed roller 136*a* and cooperating mailpiece outlet feed roller 136*b*. Engagement of the mailpiece M with the mailpiece outlet feed roller pair 136 is detected by mailpiece outlet sensor pair 138, and the mailpiece outlet feed roller pair is then driven to fully eject the mailpiece M from the mailpiece outlet feed path 134 onto the mailpiece collection tray 10. Mailpiece outlet sensor pair 138 is configured to sense when the mailpiece M has been fully ejected.

In the illustrated embodiment of the mailpiece creation apparatus 1, all of the above-described components are configured to be driven by a single motor 300, using a simple microprocessor control system coupled to a mechanical drive system, for driving the various roller components, and a mechanical actuation system, for actuating the movements of the various component parts of the mailpiece creation apparatus 1, including selectively engaging and disengaging drive from various ones of the driven rollers.

In order to implement this single motor drive system, the mailpiece creation apparatus 1 is operated by a drive system that rotates each of the driven rollers either each time the motor 300 is driven in the clockwise direction, or each time the motor 300 is driven in the anticlockwise direction, but not both. It should be noted that although a particular driven roller may only be rotated when the motor 300 drives in, for example, the clockwise direction, the driven roller itself may actually be configured to rotate anticlockwise, dependent upon its location and function within the mailpiece creation apparatus 1. That roller, however, would then only rotate in the anticlockwise direction, and would rotate each time the motor is driven clockwise. The exception to this is where a selective drive mechanism is employed, as will be described in greater detail below.

Figure 2:
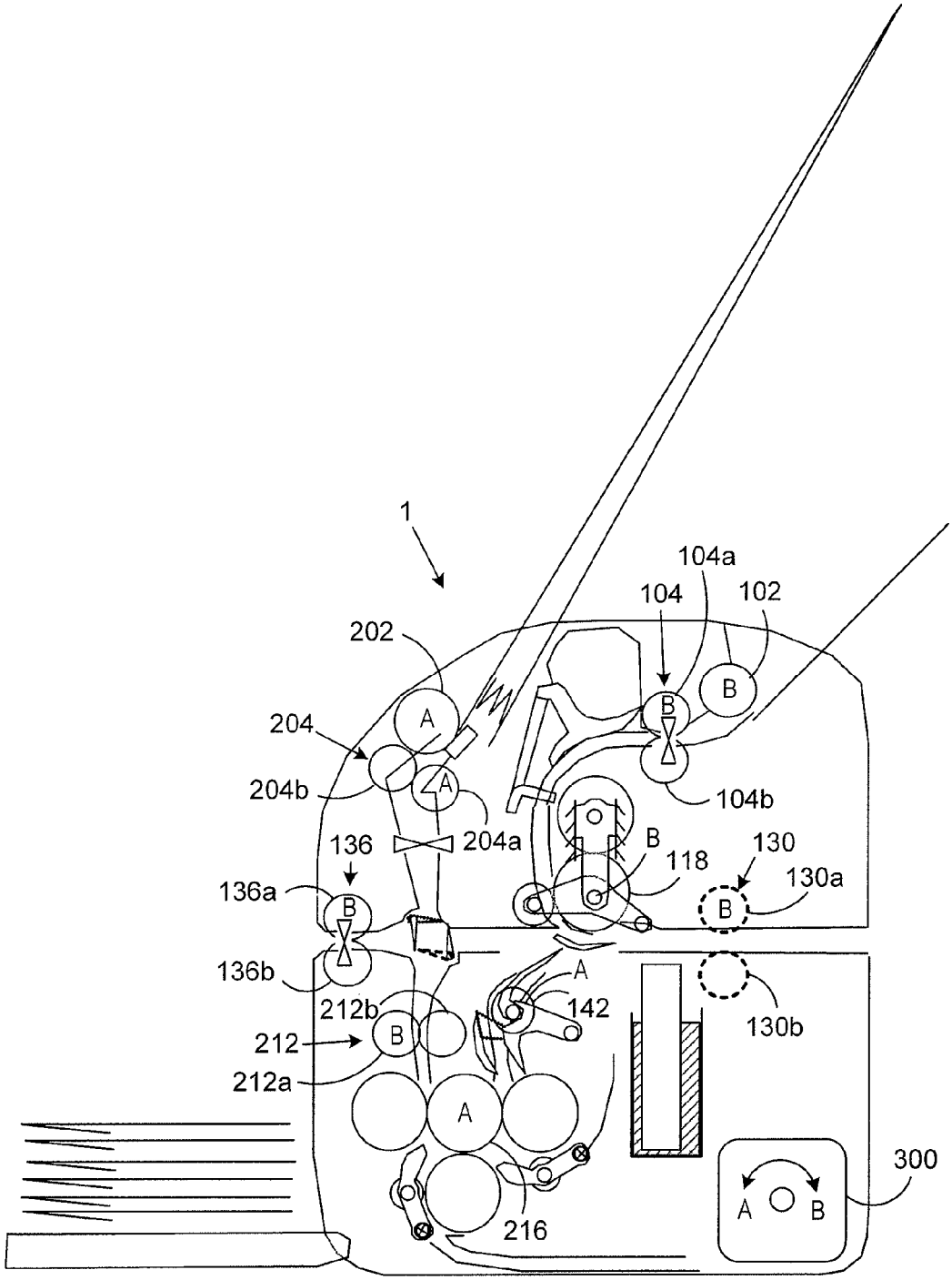
FIG. 2 is a cross-sectional side view of the mailpiece creation apparatus of FIG. 1, indicating the direction of rotation of the driven rollers for sheet handling.

Referring to FIG. 2, each of the driven rollers is identified either with a symbol "A" or a symbol "B". Each of the rollers marked with symbol "A" is rotated only when the motor 300 is driven anticlockwise (as viewed in FIG. 2), while the driven rollers marked with symbol "B" are driven only when the motor 300 drives in the clockwise direction (again, as viewed in FIG. 2).

Thus, it can be seen that sheet separation roller 202, driven sheet inlet feed roller 204*a*, driven sheet folder roller 216 and insertion roller 142 are each driven only when the motor 300 is driven in the anticlockwise direction, as viewed in FIG. 2. When driven, however, sheet separation roller 202 is driven clockwise, driven sheet inlet feed roller 204*a* is driven anticlockwise, driven sheet folder roller 216 is driven anticlockwise, and insertion roller 142 is driven clockwise.

On the other hand, envelope separation roller 102, driven envelope inlet feed roller 104*a*, driven envelope sealing feed roller 118, driven envelope insertion path feed roller 130*a*, driven sheet folder deskew roller 212*a* and driven mailpiece outlet feed roller 136*a* are each driven only when the motor rotates in the clockwise direction, as viewed in FIG. 2. By coincidence, each of the envelope separator roller 102, driven envelope inlet feed roller 104*a*, driven envelope sealing feed roller 118, driven envelope insertion path feed roller 130*a*, driven sheet folder deskew roller 212*a* and driven mailpiece outlet feed roller 136*a* is driven clockwise when the motor is driven clockwise.

Of course, for any of the feed roller pairs shown, the driven roller would need to be configured to rotate in the opposite direction if the position of the driven roller and respective cooperating roller were to be swapped, even though each of the driven rollers would still be driven by the motor only when the motor was driving in the noted predetermined direction of rotation.

It should also be noted that envelope separation roller 102 and sheet separation roller 202 are configured only to receive drive from the motor at selected times during rotation of the motor in the clockwise and anticlockwise directions, respectively. This is achieved through respective suitable selective drive mechanisms, to be discussed further below, and ensures that no further sheets S or envelopes E will be fed from the respective sheet tray 200 or envelope tray 100 during the mailpiece creation process, after a single sheet S and a single envelope E have already been taken into the mailpiece creation apparatus 1. On the other hand, each of the further driven rollers noted above is configured so as to always be driven when the motor 300 drives in the corresponding direction of rotation, regardless of whether a sheet S or envelope E is, at that time, available for processing in the corresponding section of the mailpiece creation apparatus 1.

FIGS. 3, 4, 5 and 6 show, schematically, details of the major components of the drive system and mechanical actuation system that is used to carry out a mailpiece creation cycle though alternative clockwise and anticlockwise rotations of the motor 300 in an appropriate sequence. Although each of FIGS. 3, 4, 5 and 6 is a view from the same side of the mailpiece creation apparatus 1 as shown in FIGS. 1 and 2, it will be appreciated that the drive systems and mechanical actuation systems depicted in these pictures can be located on either side of the main central paper and envelope processing portions of the mailpiece creation apparatus 1, as appropriate, in the left and right side housing portions 5 and 4. However each of FIGS. 3, 4, 5 and 6 is viewed from the same direction, and independent of much of the details of FIGS. 1 and 2, for ease of understanding.

Figure 3:
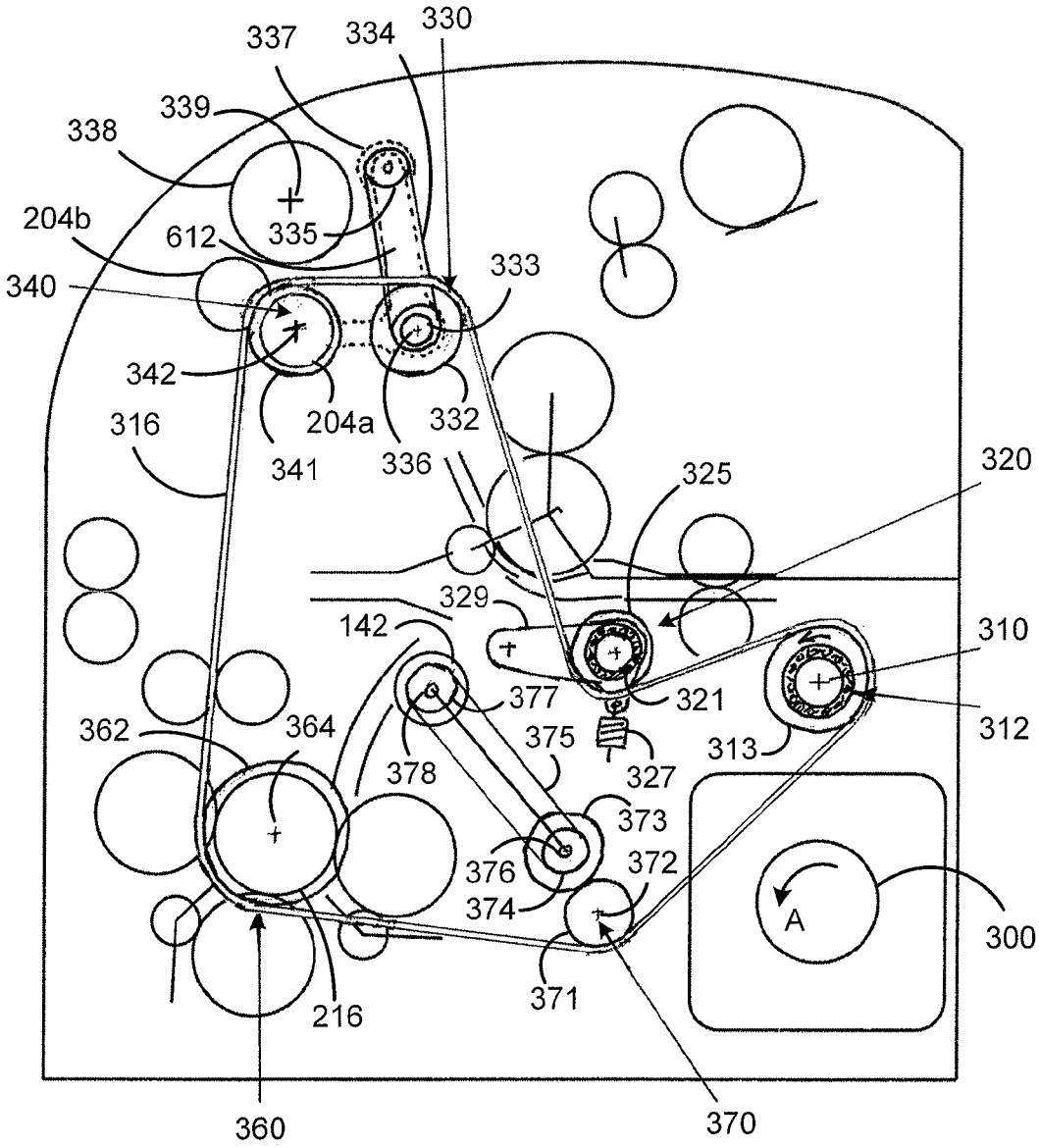
FIG. 3 is a cross-sectional side view of the mailpiece creation apparatus of FIGS. 1 and 2, showing schematically the drive mechanism for providing drive to the drive rollers that are driven when the motor rotates anti-clockwise.

FIG. 3 shows a drive system for transmitting drive to the various driven rollers when motor 300 is driven in the anticlockwise direction, as viewed in FIG. 3. In order to supply drive from the motor 300 to each of the driven rollers, a direction A drive belt 316 is provided. Drive is transferred to the direction A drive belt 316 from a motor jack shaft 310 that is coupled to the motor 300. The jack shaft 310 is coupled to the motor (see FIG. 7) so as to rotate in both the clockwise and anticlockwise directions as the motor 300 itself drives in the clockwise and anticlockwise directions, respectively. Direction A drive belt 316 is coupled to the motor jack shaft 310 via a pulley 313 that is mounted to the motor jack shaft 310 by a one-way clutch 312, so as to supply drive to the direction A drive belt 316 only when the motor is driving in the anticlockwise direction.

To maintain a sufficient degree of tension in the direction A drive belt 316 for supplying drive to each of the driven rollers without slipping, a direction A belt tensioner assembly 320 is provided. The direction A belt tensioner assembly includes a pulley 325 that is biased into engagement with the direction A drive belt 316 by biasing means 327, so as to take up and accommodate any slack that may develop in the direction A drive belt 316, thereby to maintain a sufficient level of tension in the direction A drive belt 316 for driving the driven shafts.

To prevent unwanted reverse-direction motion of the direction A drive belt and the various driven shafts, when the driving direction of motor 300 is reversed, the direction A belt tensioner pulley 325 is mounted on a one-way clutch 321. Because the one-way clutch 321 is mounted to a non-rotatable support, reverse motion of the direction A drive belt 316 is prevented. In the particular example of the direction A drive belt tensioner assembly 320 shown in FIG. 3, the tensioner assembly is mounted on a pivoted frame 329, for supporting the pulley 325 and one-way clutch 321 in biased engagement with the direction A drive belt 316.

To provide drive to the sheet separation roller 202, a sheet separator drive wheel 338 is mounted onto the same shaft 339 as the sheet separation roller 202. Drive is selectively transmitted to the sheet separator drive wheel 338 by selectively engaging the sheet separator drive wheel 338 by a sheet separator drive assembly 330.

Sheet separator drive assembly 330 includes a drive receiving pulley 332, configured to receive drive from the direction A drive belt 316. Drive receiving pulley 332 is mounted on a common shaft 336 with a drive transmit pulley 333. An elbow link arm 612 is pivotally mounted, so as to pivot about an axis that is arranged coaxially with the axis of rotation of the drive receiving pulley 332 and the drive transmit pulley 333. A second drive transmit pulley 335 is mounted to the elbow link arm 612 at a position spaced apart from the axis of rotation of the elbow link arm 612. Drive is transmitted between the first transmit pulley 333 and the second transmit pulley 335 by a drive transmit belt 334 connected around both transmit pulleys 333 and 335. The second drive transmit pulley 335 is mounted to the elbow link arm 612 on a common shaft with the selective transfer drive wheel 337, so that the selective transfer drive wheel 337 is continuously driven when the direction A drive belt is driven by rotation of the motor 300 in the anticlockwise direction, as viewed in FIG. 3. By selectively pivoting the elbow link arm 612, the selective transfer drive wheel 337 may be selectively brought into engagement with the sheet separator drive wheel 338 for transmitting drive to the sheet separation roller 202 along the separation roller shaft 339.

A sheet inlet feed roller drive assembly 340 is provided to transmit drive from the direction A drive belt 316 to the driven sheet inlet feed roller 204*a*. This is achieved by mounting the driven sheet inlet feed roller 204*a* to a common shaft 342 with a sheet inlet feed roller drive pulley 341. Sheet inlet feed roller drive pulley 341 receives drive from the direction A drive belt 316 and transmits drive to the sheet inlet feed roller 204*a* along sheet inlet feed roller shaft 342.

A sheet folder drive assembly 360 is, similarly, provided for transmitting drive from the direction A drive belt 316 to the driven sheet folder roller 216. To achieve this, a sheet folder drive pulley 362 is mounted to a common shaft 364 with the driven sheet folder roller 216, thereby to transmit drive from the direction A drive belt 316 along the shaft 364 to the driven sheet folder roller 216.

For transmitting drive to the insertion roller 142, an insertion frame drive system is provided. The insertion frame drive system 370 receives drive from the direction A drive belt 316 via a main insertion frame drive roller 371 mounted on a shaft 372. The main insertion frame drive roller 371 transfers drive to an insertion frame drive transmit roller 373 via a frictional coupling. Insertion frame drive transmit roller 373 is mounted on a common shaft 376 with a first insertion frame drive transmit pulley 374. To enable the insertion frame 140 to continuously receive drive from the direction A drive belt 316, even though it is rotatably mounted on pivot 141, the axis of rotation of shaft 376 is made coaxial with the axis of rotation of the pivot 141. A second insertion frame drive transmit pulley 377 is mounted on the insertion frame 140 on a common shaft 378 with the insertion roller 142. Drive is transmitted from the first insertion frame drive transmit pulley 374 to the second insertion frame drive transmit pulley 377 by an insertion frame drive transmit belt 375, which is connected around both drive transmit pulleys 374 and 377.

Figure 4:
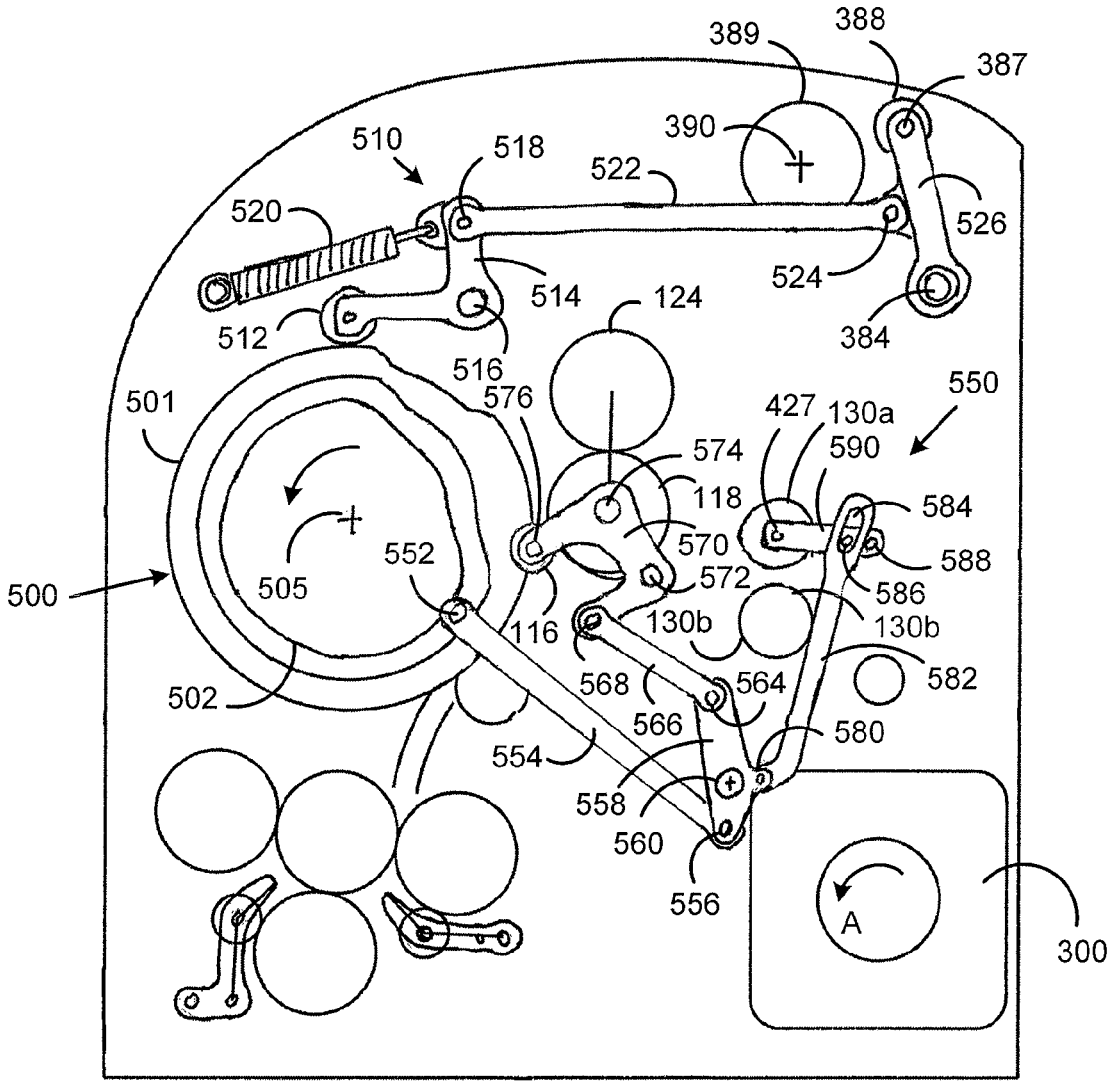
FIG. 4 is a cross-sectional side view of the mailpiece creation apparatus of FIGS. 1 and 2, from the same direction as FIG. 3, showing schematically the major components of a cam-based control system that is actuated when the motor rotates anti-clockwise.

Turning now to FIG. 4, there is shown a mechanical actuation system for actuating various components of the mailpiece creation apparatus 1 as the motor 300 is rotated in the anticlockwise direction, simultaneously as the drive system shown in FIG. 3 is transmitting drive to the selective transfer drive wheel 337, driven sheet inlet feed roller 204*a*, driven sheet folder roller 216 and insertion roller 140.

The mechanical actuation system of FIG. 4 is provided with an anticlockwise cam 500 that is driven when the motor 300 rotates in the anticlockwise direction (note that although the anticlockwise cam 500 shown in FIG. 4 is configured to rotate anticlockwise as the motor 300 rotates anticlockwise, an alternative equivalent arrangement could be achieved utilising an anticlockwise cam 500 that is configured to rotate clockwise as the motor 300 rotates anticlockwise). For the purposes of clarity, the drive system for driving anticlockwise cam 500 to rotate is not depicted. In one suitable arrangement, the anticlockwise cam 500 may be mounted on a shaft that receives drive from the direction A drive belt 316 that was described above in relation to the drive system of FIG. 3.

Anticlockwise cam 500 is mounted to rotate on a cam shaft 505, denoted in FIG. 4 by a "+" symbol marking the axis of rotation of the cam shaft 505. The anticlockwise cam 500 defines at least a first cam surface 501 and a second cam surface 502, each defining a cam profile that varies in radius around the circumference of the anticlockwise cam 500. Note that the cam surfaces and the cam profiles shown in FIGS. 4 and 6 to 9 are purely schematic, and do not necessarily denote a suitable cam profile for carrying our the actuation functions described herein.

The first cam surface 501 is configured to actuate a selective drive mechanism 510 for engaging and disengaging drive from the motor 300 to the envelope separation roller 102, according to the rotational position or orientation of the anticlockwise cam 500.

The selective drive mechanism 510 includes an elbow link arm 514 pivotally mounted on a shaft 516 at the elbow of the elbow link arm 514. At one end of the elbow link arm 514, there is provided a cam follower 512, in the form of a roller. The cam follower 512 is constrained to maintain contact with the cam surface 501 of the cam 500 by biasing means 520 which biases the elbow link arm 514 about the shaft 516 in a direction to maintain contact between the follower 512 and the cam surface 501. The selective drive mechanism 510 further includes a link arm 522 that is rotationally connected at one end to the elbow link arm 514 at a position spaced apart from the pivot shaft 516. At the other end, the link arm 522 is rotationally mounted to a central portion of a selective drive transfer support arm 526. Selective drive transfer support arm 526 is pivotally mounted so as to be able to rotate about a shaft 384 at one of its ends. At the other end of the selective drive transfer support arm 526 is a drive transfer roller 388, which is rotatably mounted to the selective drive transfer support arm 526 on a shaft 387. As the cam follower 512 follows the cam surface 501, as the anticlockwise cam 500 rotates to various different angular orientations, the elbow link arm 514 pivots between a first disengaged position, as shown in FIG. 4, in which the drive transfer roller 388 is decoupled from transmitting drive, and an engaged position, in which the drive transfer roller 388 is engaged in frictional contact with an envelope separator roller drive wheel 389 that is mounted to a shaft 390. Envelope separation roller 102 is also mounted to shaft 390, such that drive from drive transfer roller 388 is transmitted to the envelope separator roller drive wheel 389, and from there along shaft 390 to the envelope separation roller 102.

Anticlockwise cam 500 is further configured to actuate the buckle fingers 224 and 226, for deflecting the buckles formed in a sheet S into the folder roller nips at an appropriate angular orientation of the anticlockwise cam 500. Similarly, the anticlockwise cam 500 is configured to actuate the insertion frame 140, so as to move the insertion frame 140 between the retracted position and the insertion position, at an appropriate stage in the mailpiece creation process, according to the angular orientation of the anticlockwise cam 500. However, neither of these mechanisms is depicted in FIG. 4, for reasons of clarity, and also since the skilled reader will readily envisage appropriate mechanisms and cam profiles for carrying out the required actuation functions, to suit the specific configuration of the mailpiece creation apparatus in question.

FIG. 4 does, however, depict one form of a sealer actuation link mechanism 550, for moving the envelope sealer frame 120 between the flap securing position and the envelope sealing position. As shown in FIG. 4, the second cam surface 502 is formed as a track in one end face of the anticlockwise cam 500. The sealer actuation link mechanism 550 is provided with a cam follower 552 located within the track of the second cam surface 502. Cam follower 552 is thereby constrained to follow the second cam surface 502 as anticlockwise cam 500 rotates, to actuate the sealer actuation link mechanism 550 according to the angular orientation of the anticlockwise cam 500. The cam follower 552 is mounted on a follower support arm 554, which is connected at one end to a sealer pivot actuator frame 558 by a rotational joint 556. Sealer pivot actuator frame 558 is mounted to rotate about a pivot 560, as the position and orientation of the follower support arm 554 varies with changes in the angular orientation of the anticlockwise cam 500. The sealer pivot actuator frame 558 is further coupled, by a rotational joint 564, to a straight arm joint 566 that is also coupled to a sealer securing and actuating frame 570 via a rotational joint 568. The sealer securing and actuating frame 570 is mounted to rotate about a pivot 572 coaxial with the pivot of the envelope securing frame 117 described above. The driven envelope sealing feed roller 118 is mounted to the sealer securing and actuating frame 570, similarly as for the envelope securing frame 117, on a shaft 574, while the envelope flap securing roller 116 is also similarly mounted to the sealer securing and actuating frame 570, by a separate shaft 576.

Furthermore, the sealer actuator follower body 558 is also coupled, via a rotational joint 580, to a slider link arm 582. Slider link arm 582 includes a slider track 584 along which a slider follower 586 can slide, between the ends of the track. This allows partial movement of the slider link arm 582 without engaging the slider follower 586. When the slider follower 586 is at one end of the track 584, the follower 586 is constrained to follow motion of the slider link arm 582 in the direction of the track 584. As shown in FIG. 4, the slider follower 586 is mounted to a lever arm 590, supported by a pivot 588 at one end. The other end of lever arm 590 is connected to driven envelope insertion path feed roller 130*a* by a shaft 427. This allows the driven envelope insertion path feed roller to be pivoted between a position in which it extends into the envelope insertion path 128 and a position in which it is retracted out of the envelope insertion path 128, thereby selectively to apply drive from the driven envelope insertion path feed roller 130*a* to an envelope E in the envelope insertion path 128. Although the cooperating envelope insertion path feed roller 130*b* is depicted in this embodiment as not being actuated by the sealer actuation link mechanism 550, it may also be configured to extend into and retract from the envelope insertion path 128, in cooperation with the driven envelope insertion path feed roller 130*a*.

It will be appreciated that the cam profiles and the particular sizes of the actuation link members depicted in FIG. 4 are entirely schematic, so as to illustrate the general principle by which the anticlockwise cam 500 may be utilised so as to actuate the selective drive link mechanism 510 and the sealer actuation link mechanism 550. However, it will be readily apparent that as the sealer pivot actuator frame 558 is actuated by the follower support arm 554, it is forced to rotate about pivot 560, thereby simultaneously actuating the slider link arm 582 so as to bring the driven envelope insertion path feed roller 130*a* into the envelope insertion path 128. At the same time, the corresponding enforced motion of the straight arm joint 566 causes the sealer securing and actuating frame 570 to rotate about pivot 572, thereby causing the envelope sealer frame 120 to transition from the flap securing position to the envelope sealing position.

Figure 5:
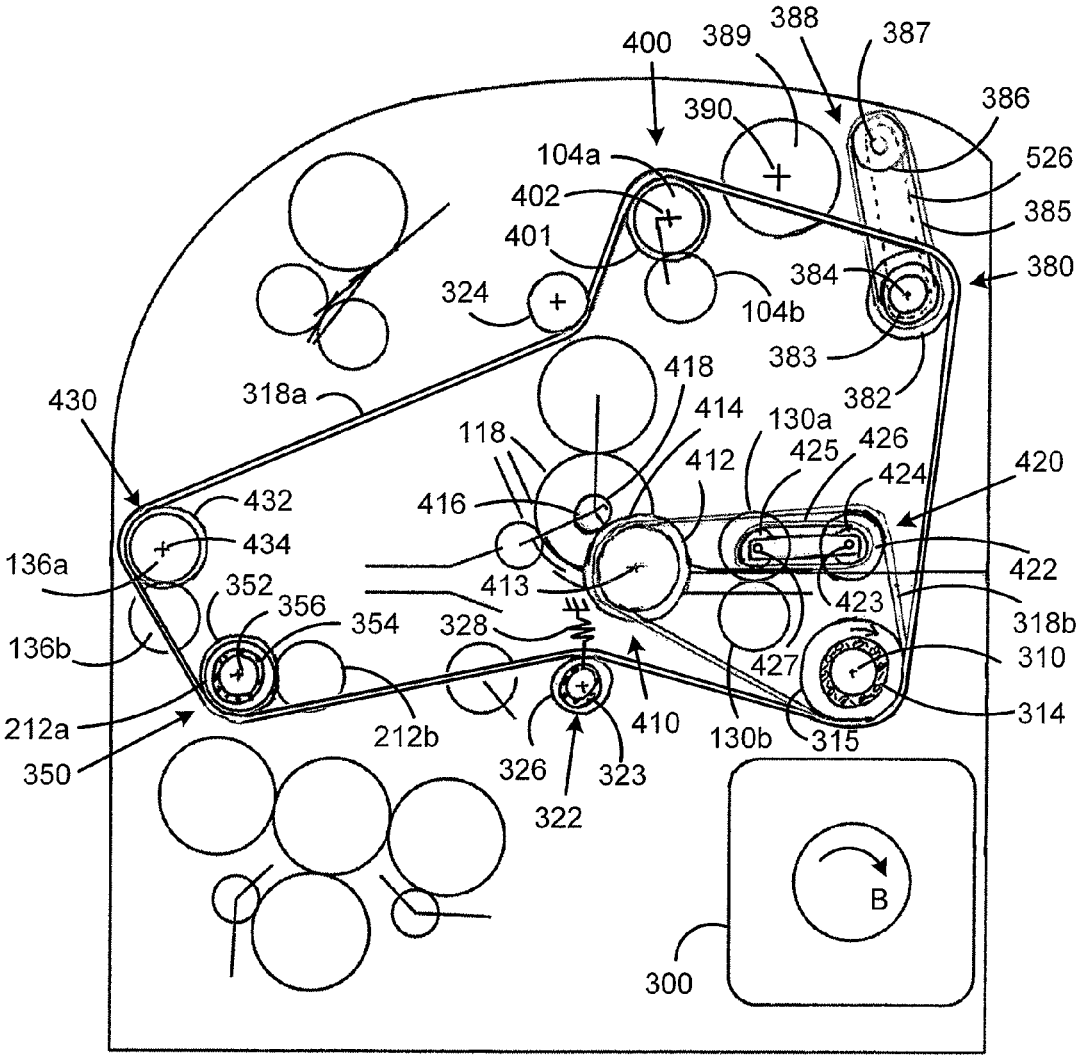
FIG. 5 is a cross-sectional side view of the mailpiece creation apparatus of FIGS. 1 and 2, from the same direction as FIG. 3, showing schematically the main components of the drive mechanism for providing drive to the drive rollers that are driven when the motor rotates clockwise.

Turning to FIG. 5, there are depicted, schematically, the main components of the drive system for transferring drive from the motor 300 to the envelope separation roller 102, driven envelope inlet feed roller 104*a*, driven envelope sealing feed roller 118, driven envelope insertion path feed roller 130*a*, driven sheet folder deskew roller 212*a* and driven mailpiece outlet feed roller 136*a*, as the motor 300 rotates in the clockwise direction.

As shown in FIG. 5, there is provided a first direction B drive belt 318*a* and a second direction B drive belt 318*b* (also known in the art as a "roller"), for transmitting drive from said motor 300, when it rotates in the clockwise direction, to the identified feed rollers.

In a similar manner as for the drive system of FIG. 3, drive is transmitted from the motor 300 to the first and second direction B drive belts 318*a* and 318*b* via a pulley 315 mounted on the motor jack shaft 310 via a one-way clutch 314. The one-way clutch 314 is configured to allow rotation of the pulley 315 for driving the first and second direction B drive belts 318*a* and 318*b* only when the motor is driving in the clockwise direction. As noted above, this is also when the jack shaft 310 is rotating in the clockwise direction.

Also similar to the anticlockwise drive system of FIG. 3, the clockwise drive system of FIG. 5 includes a direction B drive belt tensioner assembly for maintaining sufficient tension in the first direction B drive belt 318*a*, which is of sufficient length to require such a tensioner assembly 322. The tensioner assembly 322 includes a pulley 326 that is maintained in biased engagement with the first direction B drive belt 318*a* by a biasing means 328. Moreover, the pulley 326 is mounted on the direction B belt tensioner assembly 322 via a one-way clutch 323, again for preventing reverse motion of the first direction B drive belt 318*a* when the motor driving direction changes.

As well as preventing reverse motion of the first direction B drive belt 318*a*, the one-way clutch 323 also prevents reverse motion of the second direction B drive belt 318*b*, since the first and second direction B drive belts 318*a* and 318*b* are, in any case, rotationally coupled at the point of the pulley 315 that transmits drive to the direction B drive belts 318*a* and 318*b* from the motor 300.

The drive system of FIG. 5 further includes a routing pulley, arranged to direct the path of the first direction B drive belt 318*a* around and away from nearby components of the mailpiece creation apparatus 1.

An envelope inlet feed roller drive assembly 400 is provided to transfer drive from the first direction B drive belt 318*a* to the driven envelope inlet feed roller 104*a*. The envelope inlet feed roller drive assembly 400 comprises an envelope inlet feed roller drive pulley 401 mounted on a shaft 402 to which the driven envelope feed roller 104*a* is also mounted, thereby to transmit drive from the first direction B drive belt 318*a* to the envelope feed roller drive pulley 401, along shaft 402 and to the driven envelope inlet feed roller 104*a*.

A mailpiece outlet feed roller drive assembly 430 is provided to transmit drive from the first direction B drive belt 318*a* to the driven mailpiece outlet feed roller 136*a*. The mailpiece outlet feed roller drive assembly 430 includes an outlet feed roller drive pulley 432 mounted on a shaft 434. Driven mailpiece outlet feed roller 136*a* is also mounted on shaft 434, thereby to transmit drive from the first direction B drive belt 318*a* to the driven mailpiece outlet feed roller 136*a* via the outlet feed roller drive pulley 432 and shaft 434.

A sheet folder deskew roller drive assembly 350 is provided to supply drive to the driven deskew roller 212*a* from the first direction B drive belt 318*a*. The sheet folder deskew roller drive assembly 350 comprises a deskew drive pulley 352 around which the first direction B drive belt 318*a* is connected, to supply drive to the deskew drive pulley 352. Deskew drive pulley 352 is mounted on a deskew drive roller shaft 356 by a one-way clutch 354, enabling drive to be transmitted from the first direction B drive belt 318*a* to the shaft 356 via the one-way clutch 354 when the first direction B belt member 318*a* is being driven, thereby to transfer drive along the shaft 356 to the driven deskew roller 212*a*. Since the shaft 356 on which the driven deskew roller 212*a* is mounted is connected to the first direction B drive belt 318*a* via a one-way clutch 354, the shaft 356 and driven deskew roller 212*a* can be rotated in the driven direction (clockwise as shown in FIG. 5) even when the first direction B drive belt 318*a* is not being driven by the motor 300. This enables sheets in the deskew roller nip between driven deskew roller 212*a* and cooperating deskew roller 212*b* to be drawn through the deskew roller pair 212 by the sheet folder rollers, during a sheet folding process.

Concerning the second direction B drive roller 318*b*, an envelope sealer drive assembly 410 is provided to transmit drive from the second direction B drive belt 318*b* to the driven envelope sealing feed roller 118. The envelope sealer drive assembly 410 comprises a sealer drive pulley 412 which is configured to receive drive from the second direction B drive belt 318*b*. Sealer drive pulley 412 is mounted to a shaft 413, to which a sealer drive transfer gear 414 is also mounted, for receiving drive along the shaft 413 when the sealer drive pulley 412 is driven by the second direction B drive belt 318*b*. Sealer drive transfer gear 414 is coupled to a second sealer drive transfer gear 416 mounted to the shaft 418 of the driven envelope sealing feed roller 118. Drive is thus transferred from sealer drive transfer gear 414 to the second sealer drive transfer gear 416 through the frictional engagement of these rollers, then along shaft 418 so as to drive the driven envelope sealing feed roller 118. In order to ensure that drive can be transmitted to the driven envelope sealing feed roller 118 both at the flap securing position and at the envelope sealing position, the sealer drive pulley 412 is mounted on a shaft 413 that is arranged coaxially with the pivotal axis of the envelope securing frame 117. In this manner, as the envelope sealer frame 120 transitions from the flap securing position to the envelope sealing position, engagement is maintained between the sealer drive transfer gears 414 and 416, such that drive may always be transferred to the driven envelope sealing fed roller at any point in the transition of the envelope sealer frame 120.

An envelope insertion path feed roller drive assembly 420 is further provided for transmitting drive from the second direction B drive belt 318*b* to the driven envelope insertion path feed roller 130*a*. The envelope insertion path feed roller drive assembly 420 includes a drive pulley 422 that receives drive from the second direction B drive belt 318*b*. Pulley 422 is mounted to a shaft 423 that is coaxial with the pivot point 588 of lever arm 590 to which the driven envelope insertion path feed roller 130*a* is mounted. First drive transmit pulley 424 receives drive from the drive pulley 422 along shaft 423. A second drive transmit pulley 425 is mounted to lever arm 590, at a point spaced apart from the pivot 588. Drive transmit pulley 425 is mounted to a shaft 427, to which the driven envelope insertion path feed roller 130*a* is also commonly mounted, for transmitting drive from the drive transmit pulley along shaft 427 to the driven envelope insertion path feed roller 130*a*. Drive is transmitted between first drive transmit pulley 424 and second drive transmit pulley 425 by a drive transmit belt 426 connected around the two drive transmit pulleys. Because the lever arm 590 is a pivot 588 that is coaxial with the axis of rotation of the drive pulley 422, the drive transmit belt 426 is prevented from going slack at any point during the pivotal motion of the lever arm 590. Drive can, therefore, assuredly always be transmitted from second direction B drive belt 318*b* to the driven envelope insertion path feed roller 130*a*, regardless of the orientation of lever arm 590. This allows envelope insertion path feed roller drive assembly 420 to compensate for different thicknesses of filled envelopes E that may need to be driven along the envelope insertion path 128.

It will be appreciated that while the various components of the drive mechanisms of FIGS. 3 and 5 have been shown as transmitting drive between the components utilising a drive belt system driven by the motor 300, alternative drive systems could be implemented, utilising numerous alternative drive transmission means between the driven and driving components. Such alternatives, for example, include toothed gears, toothed gears in combination with a toothed belt, frictionally coupled rollers arranged in series etc.

Figure 6:
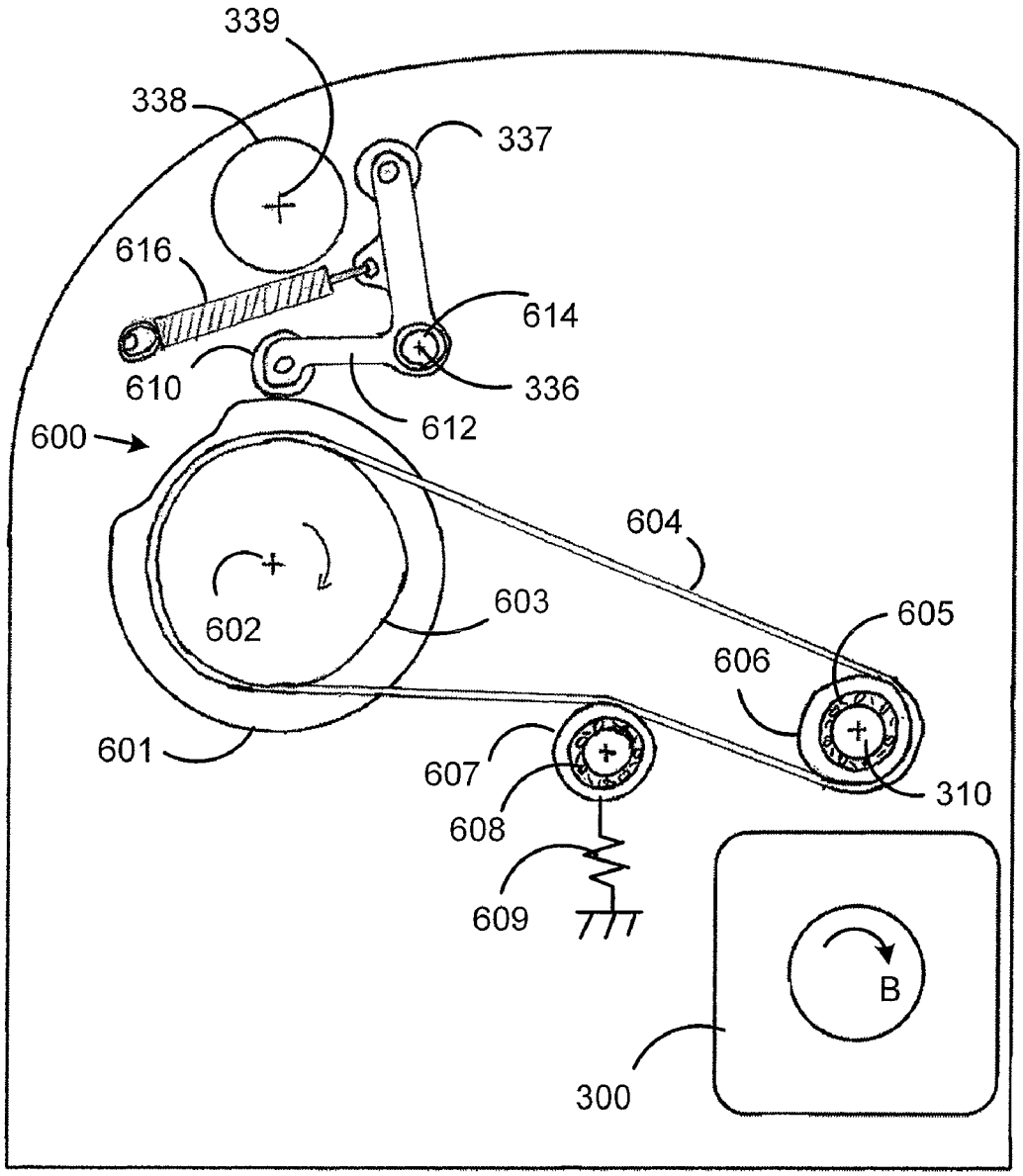
FIG. 6 is a cross-sectional side view of the mailpiece creation apparatus of FIGS. 1 and 2, from the same direction as FIG. 3, showing schematically the major components of a cam-based control system that is actuated when the motor rotates clockwise.

FIG. 6 shows schematically a mechanical actuation mechanism for selectively engaging drive transmission to the sheet separation roller 202. This selective drive transmission mechanism is controlled by a clockwise cam 600. Clockwise cam 600 is driven when the motor 300 drives in a clockwise direction, but is not driven when motor 300 is driving anti-clockwise. This is achieved through the use of a one-way clutch 605 which mounts a cam drive pulley 606 to the motor jack shaft 310. As shown in FIG. 6, when motor 300 is driven in a clockwise direction, motor jack shaft 310 is also driven in a clockwise direction and one-way clutch 605 operates to transmit drive to the cam drive pulley 606. When motor jack shaft 310 is rotated anti-clockwise, drive is not transmitted to the cam drive pulley 606. Drive is transferred from the cam drive pulley 606 to a cam drive wheel 603 that is mounted on a cam shaft 602 of the clockwise cam 600. Drive is transmitted from the cam drive pulley 606 to the cam drive wheel 603 by a cam drive belt 604 connected around both the pulley 606 and wheel 603. A cam drive belt tensioner is provided to maintain tension in the cam drive belt 604. The cam drive bet tensioner includes a cam drive belt tensioner pulley 607 that is biased into tensioning engagement with the cam drive belt 604 by suitable biasing means 609. Cam drive belt tensioner pulley 607 is mounted on a one-way clutch 608, so as to prevent reverse-direction motion of the cam drive belt 604 when the drive direction of motor 300 and motor jack shaft 310 is reversed. This increases the accuracy of timing of the cam-based actuation mechanism, and ensures that the clockwise cam 600 is controllably directed to the desired rotational position when driven in a controlled manner by motor jack shaft 310.

Clockwise cam 600 defines a cam surface 601 having a cam profile whose radius with respect to the axis of rotation of cam shaft 602 varies around the circumference of the clockwise cam 600. The selective drive link mechanism shown in FIG. 6 includes a follower 610 in the form of a cooperating roller, constrained to follow the cam surface 601 of clockwise cam 600 as the angular orientation of clockwise cam 600 varies as the clockwise cam 600 is rotated by drive transmitted from the motor 300 driving in the clockwise direction. Cam follower 610 is mounted to one end of an elbow link arm 612, which is pivotally mounted at the elbow about a pivot 614. Pivot 614 is aligned coaxially with the axis of rotation of the selective drive mechanism drive shaft 336 of the sheet separator drive assembly 330 for transmitting drive to the sheet separator roller 202. The elbow link arm 612 is rotatable about pivot 614 between a first, disengaged, position, as shown in FIG. 6, in which drive is not transmitted to the sheet separation roller 202, and a second, engaged, position, in which drive is transmitted to sheet separation roller 202. In order to actuate the elbow link arm 612 between these two positions, the cam follower 610 is maintained in pressing engagement with cam surface 601 of the clockwise cam 600 through the use of an appropriate biasing means 616, constraining the elbow link arm 612 to be actuated between the engaged and disengaged positions as the angular position of the clockwise cam 600 varies. Selective transfer drive wheel 337 is mounted at the opposite end of the elbow link arm 612 to the cam follower 610, at a position spaced apart from the pivot 614. As explained in relation to FIG. 3, drive is continuously supplied to selective transfer drive wheel 337 whenever motor 300 is driven in the anti-clockwise direction. When the elbow link arm 612 is in the disengaged position, the selective drive transfer wheel 337 simply free-wheels at the end of the elbow link arm 612. With elbow link arm 612 pivoted to the engaged position, selective transfer drive wheel 337 is brought into frictional engagement with sheet separator drive wheel 338, to transmit drive from the selective transfer drive wheel 337 to the sheet separator drive wheel 338 when motor 300 is driven anti-clockwise. Sheet separator drive wheel 338 is mounted to sheet separation roller shaft 339, thereby transmitting drive along the sheet separation roller shaft 339 to the sheet separation roller 202, which is commonly mounted on the sheet separation roller shaft 339 with the sheet separation drive wheel 338.

Figure 7:
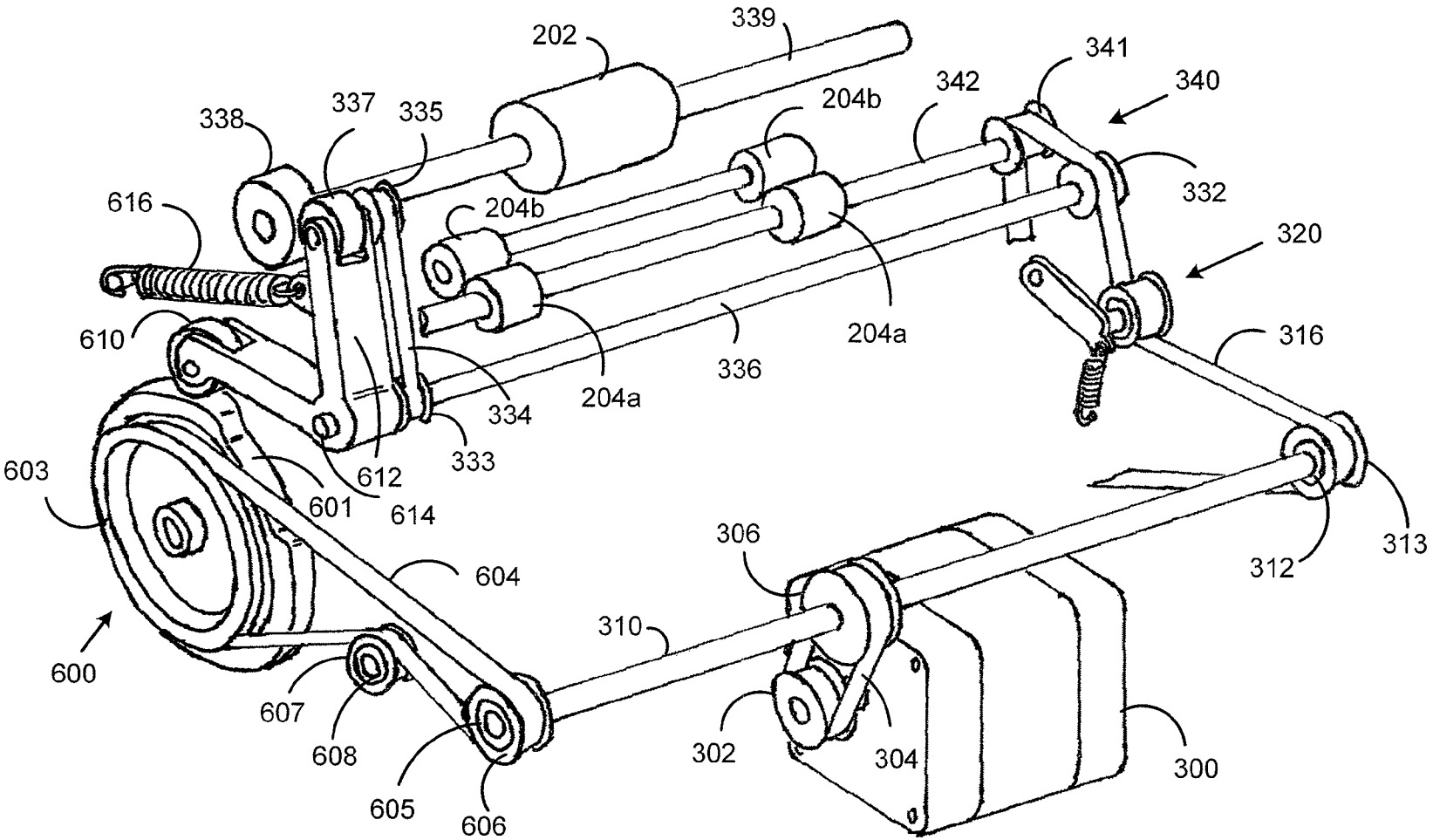
FIG. 7 is a perspective view showing the main components of one particular mechanism for selectively providing drive to a sheet feed roller from the motor.

FIG. 7 shows a perspective view of selected components of the drive mechanism of FIG. 3 and the cam-controlled selective drive link mechanism of FIG. 6, detailing how the various components concerned with operating a selective drive transmission from motor 300 to the sheet separation roller 202 are mounted to a series of common shafts.

As illustrated, motor 300 drives a motor pulley 302 in both the clockwise and anti-clockwise directions. Motor pulley 302 transmits drive to a jack shaft pulley 306 mounted to motor jack shaft 310 via a drive belt 304, which is connected around both the motor pulley 302 and jack shaft pulley 306. Through this arrangement, motor jack shaft 310 is constrained to rotate in the clockwise and anti-clockwise directions as the motor 300 is drive clockwise and anti-clockwise, respectively.

From FIG. 7, it will be apparent how, as the motor drives in the anti-clockwise direction, drive is continuously supplied from the motor 300, along motor jack shaft 310, through direction A drive belt 316, along selective drive mechanism drive shaft 336, through drive transmit belt 334 and to selective transfer drive wheel 337 at the end of the elbow link arm 612. Thus, it can be seen how drive is transferred to the selected transfer drive wheel 337 regardless of the position of the elbow link arm 612, whenever motor 300 is driven in the anti-clockwise direction.

On the other hand, it can also be seen how drive is transferred from motor 300, to be transmitted through motor drive belt 304, along motor jack shaft 310, through cam drive belt 604 and to cam drive wheel 603, for rotating clockwise cam 600 each time motor 300 is driven in the clockwise direction, thereby to actuate elbow link arm 612 in response to the angular position of the clockwise cam 600.

Accordingly, it can be seen how drive to the sheet separation roller 202 can be selectively engaged by driving the motor 300 clockwise, with the sheet separation roller 202 then being driven by driving the motor 300 anti-clockwise with the elbow link arm 612 in the engaged position. Once a sheet S has been fed into the mailpiece creation apparatus 1 by the sheet separation roller 202, the motor drive direction can then be reversed, again, to the clockwise direction so as to rotate clockwise cam 600 in order to actuate and disengage the elbow link arm 612, after which point the sheet separation roller 202 is not driven by further anti-clockwise drive supplied from motor 300, preventing further sheets from being fed into the mailpiece creation apparatus 1 while a mailpiece creation cycle is completed on the already fed sheet S.

Figure 8:
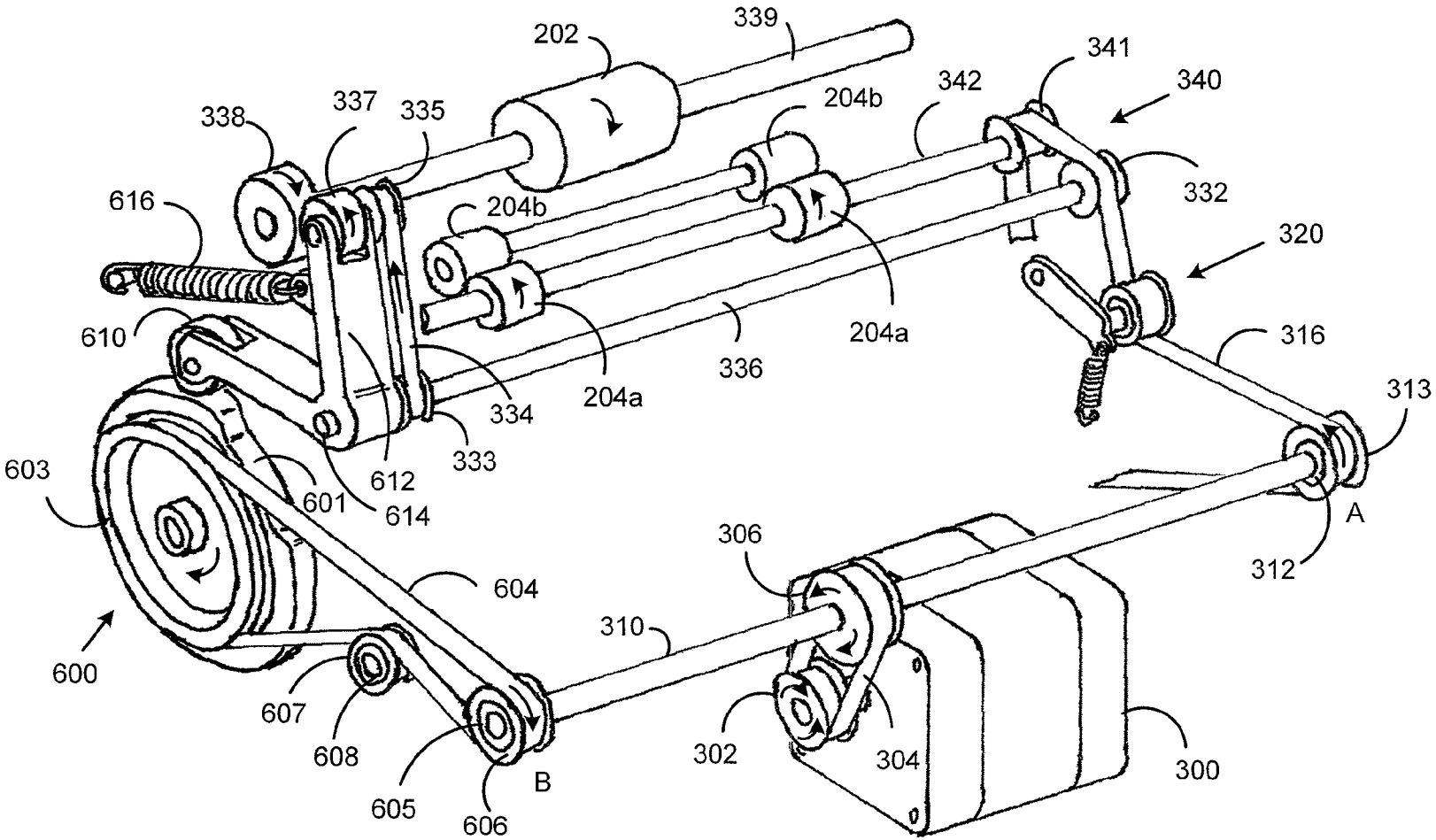
FIG. 8 is a perspective view showing the same components shown in FIG. 7, indicating the direction of rotation in which each component is driven to be rotated.

FIG. 8 merely shows the identical components illustrated in FIG. 7, but marked to show the respective directions of rotation of the various driven components. As explained above, sheet separation roller 202 is driven in the illustrated clockwise direction only when drive is engaged by the elbow link arm 612.

FIG. 9 is a similar view to FIGS. 7 and 8, and shows how the various components of the illustrated drive mechanism and cam-based selective drive transfer mechanism can be incorporated into side housing portions 5 and 4, on the left and right sides, respectively, of the mailpiece creation apparatus 1. It will be clear to the skilled reader that the drive mechanisms of FIGS. 3 and 5 and the cam-based actuation mechanisms of FIGS. 4 and 6 can be fully enclosed within the side housing portions 4 and 5 of the mailpiece creation apparatus 1.

Referring now to FIGS. 10-23, a complete mailpiece creation cycle will be described for the mailpiece creation apparatus 1, illustrating how an entire mailpiece creation cycle can be completed utilising only the clockwise and anti-clockwise rotation of the single motor 300 in combination with the above described drive and cam control mechanisms of FIGS. 3 to 9, along with a simple microprocessor running a simple control program.

At the start of the mailpiece creation cycle, as shown in FIG. 1, at least one sheet S is loaded in sheet tray 200, supported on sheet tray upper plate 201 with its lower edge adjacent the sheet separation roller 202. At least one envelope E is loaded in envelope tray 100, oriented with the hinge h located furthest from the envelope separation roller 102, and with the flap f closed and facing substantially upwards.

In the configuration shown in FIG. 1, the cam-based mechanical actuation systems of FIGS. 4 and 6 are located with the anticlockwise cam 500 and the clockwise cam 600, respectively, located at their "home" positions, for cycle initiation. In the home position, shown respectively in FIGS. 4 and 6, the selective drive engagement mechanisms are disengaged.

As a first step, motor 300 is driven anticlockwise by a predetermined amount, thereby rotating anticlockwise cam 500 so as to engage drive transfer roller 388 with envelope separator roller drive wheel 389, in the manner described above with reference to FIG. 4. After the motor 300 has been driven anticlockwise by the predetermined amount, thereby effecting a given change in the angular orientation of the anticlockwise cam 500 from its home position, the drive direction of motor 300 is reversed, to drive in the clockwise direction.

Figure 10:
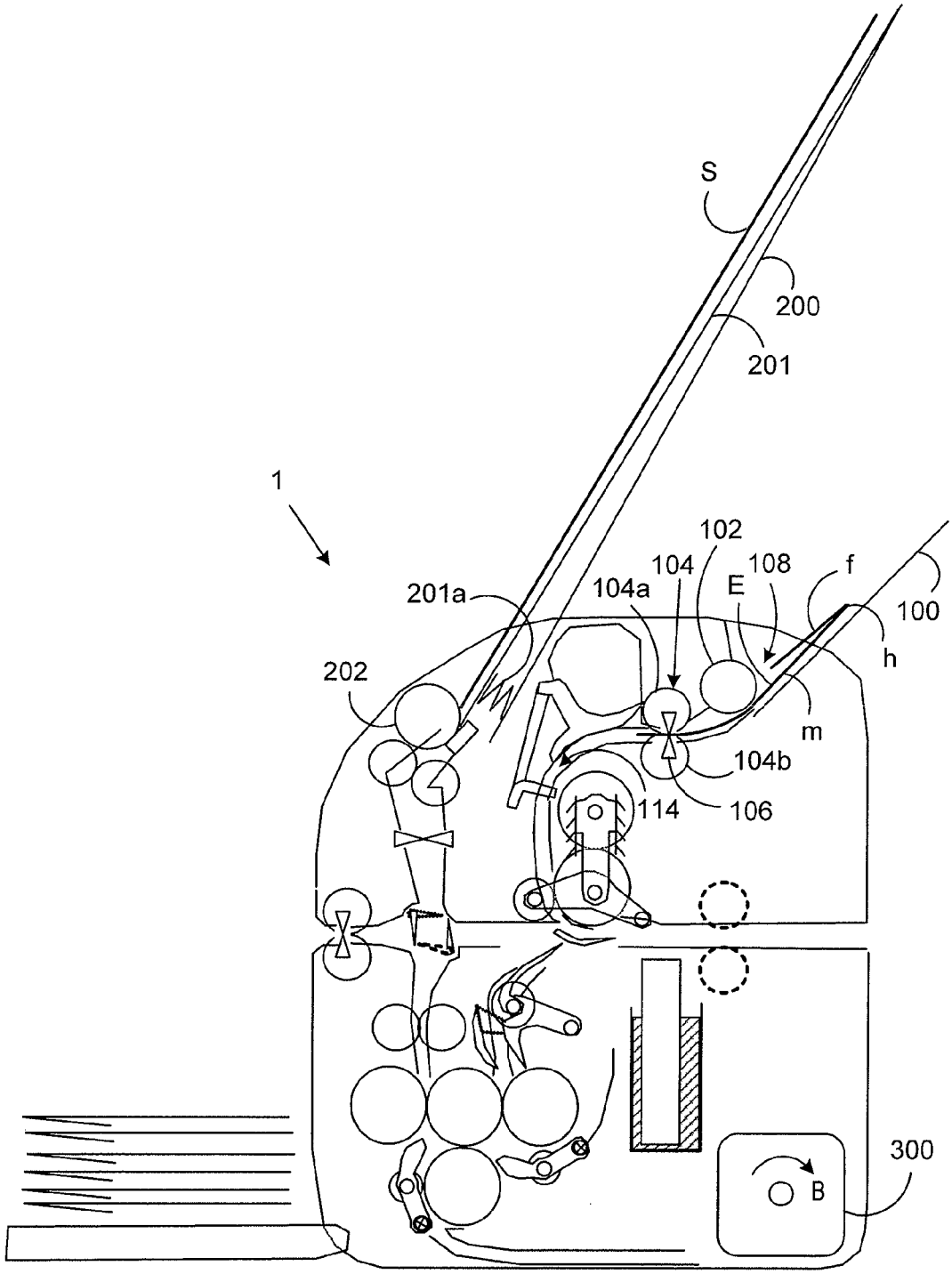
FIGS. 10-23 are a series of cross-sectional side views of the mailpiece creation apparatus of FIGS. 1 and 2, showing sequentially one mailpiece creation cycle; and In the above sequence.

Referring to FIG. 10, as the motor 300 drives clockwise, clockwise cam 600 is driven, thereby to actuate the elbow link arm 612 to engage drive at the sheet separation roller 202. (Note that drive is not actually supplied to sheet separation roller 202 while the motor is rotating clockwise, but only when the motor is driven anticlockwise, as explained in detail above with reference to FIG. 3). At the same time as clockwise cam 600 is driven to actuate the sheet separator selective drive mechanism, the drive system of FIG. 5 transmits drive to the engaged envelope separation roller 102, so as to advance the envelope E into the envelope inlet feed path 108, and into engagement with the inlet feed roller pair 104 at the entrance to the envelope flapping path 114. The leading edge of the envelope E is detected as it passes envelope inlet sensor pair 106, which detection may be used to control the drive timing of the motor 300 in the clockwise drive direction. Alternatively, the motor 300 may simply be driven clockwise by a predetermined number of counts, for example.

Figure 11:
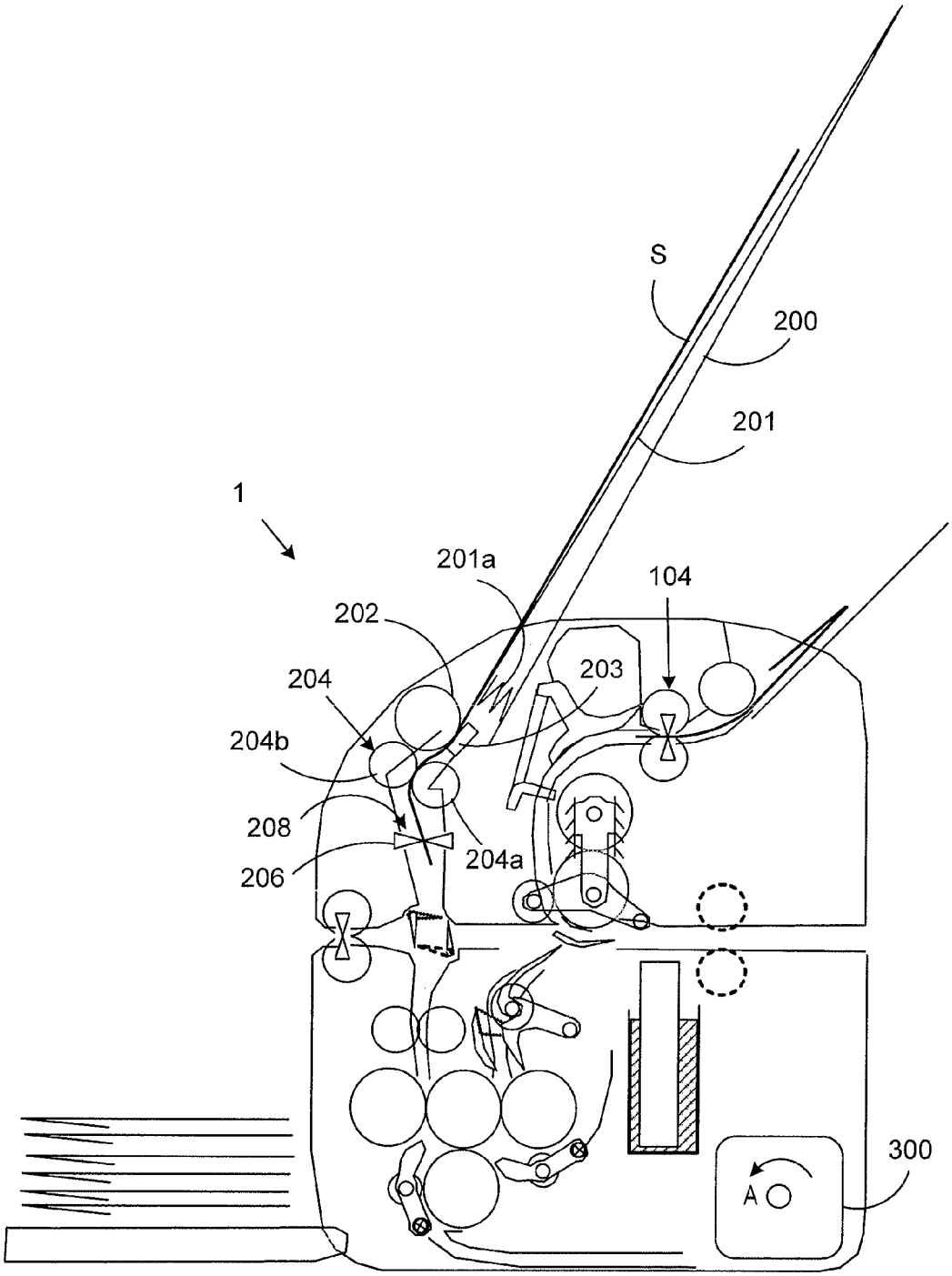
Figure 11A:
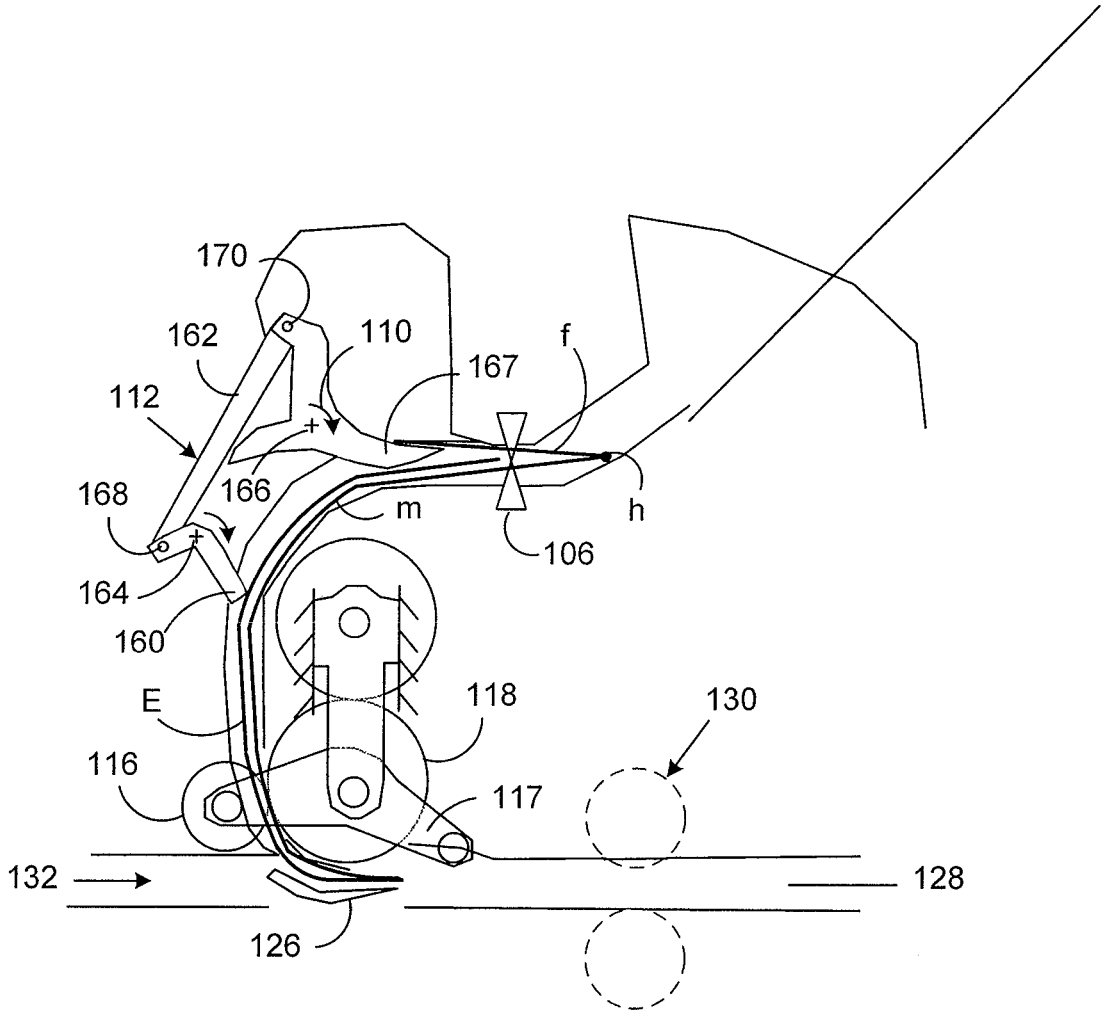
FIG. 11A is an enlarged view showing schematically the detail of operation of the flapping mechanism of the mailpiece creation apparatus of FIGS. 1 and 2.

Referring to FIG. 11, the motor drive direction is then reversed to drive the motor in the anticlockwise direction. This causes the anticlockwise cam 500 of FIG. 4 to rotate, thereby disengaging the selective drive transfer mechanism 510 from engagement with the envelope separation roller 102. At the same time, the anticlockwise driving mechanism of FIG. 3 is driven, thereby driving engaged sheet separation roller 202 to advance a single sheet S into the sheet inlet feed path 208. The separated single sheet S is driven both by the sheet separation roller 202, which cooperates with separation block 203 to separate a single sheet S from the stack of sheets held on the sheet tray 200, and also by the sheet inlet feed roller pair 204, which is also driven by the anticlockwise drive mechanism of FIG. 3. The single sheet S is advanced along sheet inlet feed path 208 until its leading edge is detected at sheet inlet sensor pair 206. The motor 300 driving direction is then switched, to clockwise.

As the motor is then driven clockwise, clockwise cam 600 rotates to actuate the selective drive mechanism elbow link arm 612 to the disengaged position, thereby disengaging drive from the sheet separation roller 202. Simultaneously, the envelope E is advanced by the envelope inlet feed roller pair 104 along envelope flapping path 114. As shown schematically in FIG. 11A, as the leading edge of the envelope E is advanced along the envelope flapping path 114, the leading edge comes into contact with the envelope flapper link mechanism 112. More specifically, the envelope leading edge engages flapper kicker link 160, causing it to rotate around a kicker pivot 164. Flapper kicker link 160 is connected by a rotational joint 168 to a straight link arm 162. Link arm 162 is connected via a rotational joint 170 to envelope flapper mechanism 110, which is itself pivotally mounted to rotate about a pivot 166. When the envelope leading edge engages the flapper kicker link 160 in the envelope flapping path 114 and causes it to rotate about pivot 164, envelope flapper mechanism 110 is caused also to rotate, about pivot 166, by the link arm 162. This brings the flapper mechanism blade edge 167 into contact with the upper surface of the envelope main body m, as the envelope E continues to be advanced around envelope flapping path 114 by the envelope inlet feed roller pair 104. As the envelope flap f passes between envelope inlet feed roller pair 104, the flapper mechanism blade edge 167 is introduced between the envelope main body m and the envelope flap f, causing the flap f to be separated from the main body m and opening the envelope E by rotation of the flap f about hinge h.

Figure 12:
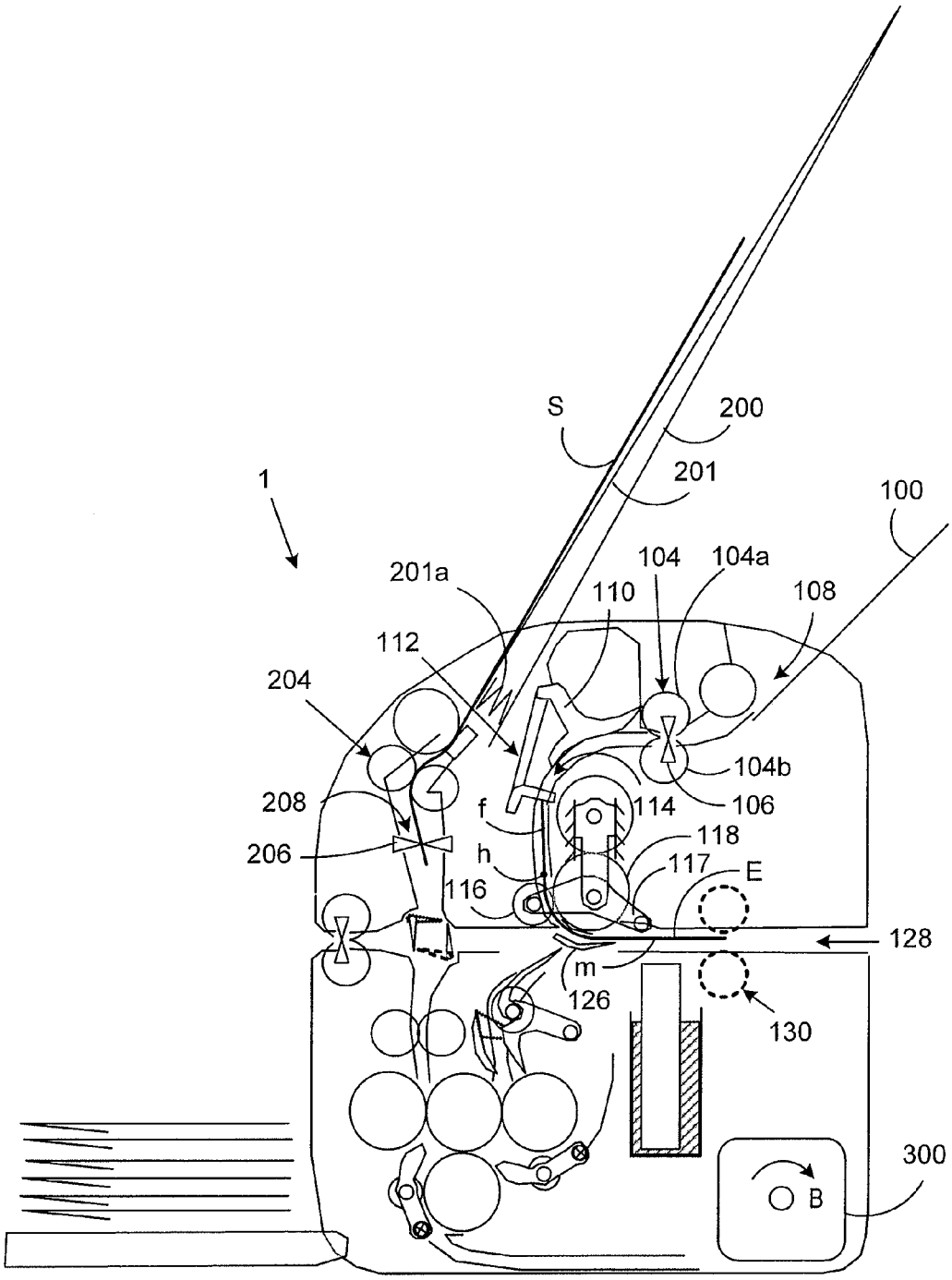

As shown in FIG. 12, as the motor 300 continues to rotate in the clockwise direction, the envelope leading edge is engaged by driven envelope sealing feed roller 118 and envelope flap securing roller 116, which are driven by motor 300 as it drives in the clockwise direction, to advance the envelope E further through the envelope flap securing nip between driven envelope sealing feed roller 118 and envelope flap securing roller 116. This causes the envelope to be advanced towards the trap door 126, which is shaped and positioned to deflect the envelope E leading edge into the envelope insertion path 128. As the envelope E is advanced into the envelope insertion path 128, the hinge h finally passes beyond the range of detection of the envelope inlet sensor pair 106. Once the envelope inlet sensor pair 106 has detected that the envelope is no longer located between the envelope inlet feed roller pair 104, the motor 300 can be driven clockwise by a further predetermined number of counts, or for a predetermined amount of time, until the position of the envelope hinge h has arrived at a predetermined location along the envelope flapping feed path 114. The motor drive direction is then again reversed after the motor 300 has been driven for the predetermined number of counts or predetermined amount of time.

Motor 300 is then driven anticlockwise, which drives the anticlockwise driving mechanism and the anticlockwise cam 500 shown in FIGS. 3 and 4. Typically, when the mailpiece creation cycle is initiated, feed path selector flaps 210*a* and 210*b* would be oriented to provide access from the sheet inlet feed path 208 into the sheet folder inlet feed path 214. If they have not already been configured to such an orientation, the feed path selector flaps 210*a* and 210*b* are controlled to adopt this configuration when drive is transferred to the anticlockwise direction.

Figure 13:
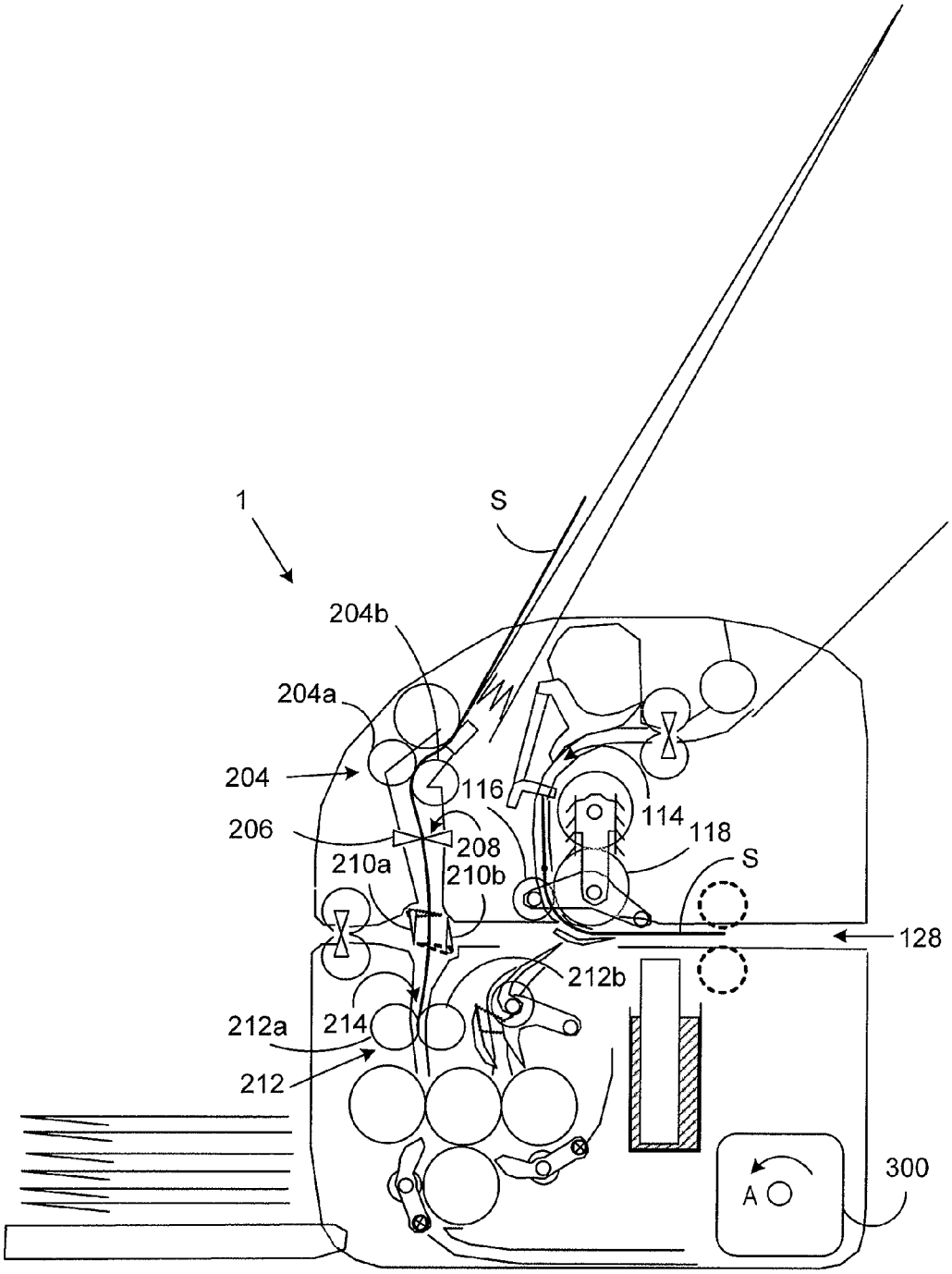

Turning to FIG. 13, it can be seen that as the motor 300 now drives in the anticlockwise direction, the sheet S is fed along sheet inlet feed path 208 and into sheet folder path 214, into engagement at its leading edge with the sheet folder deskew roller pair 212. As the sheet S leading edge is driven into the nip between driven sheet folder deskew roller 212*a* and cooperating sheet folder deskew roller 212*b*, the sheet is caused to buckle, thereby forcing the sheet leading edge to align along the nip between the sheet folder deskew roller pair 212. During this sheet advancement, no further mechanisms are actuated by the anticlockwise cam 500. Since the location of the leading edge of the sheet S was previously known from the sheet inlet sensor pair 206, the sheet S is advanced by sheet inlet roller pair 204 by a predetermined amount so as to bring it into contact with the deskew roller pair 212, and to form a desired buckle in the sheet S, as shown in FIG. 13. Once the sheet S has been advanced by a predetermined amount, the motor drive direction is once more reversed, to the clockwise direction.

Figure 14:
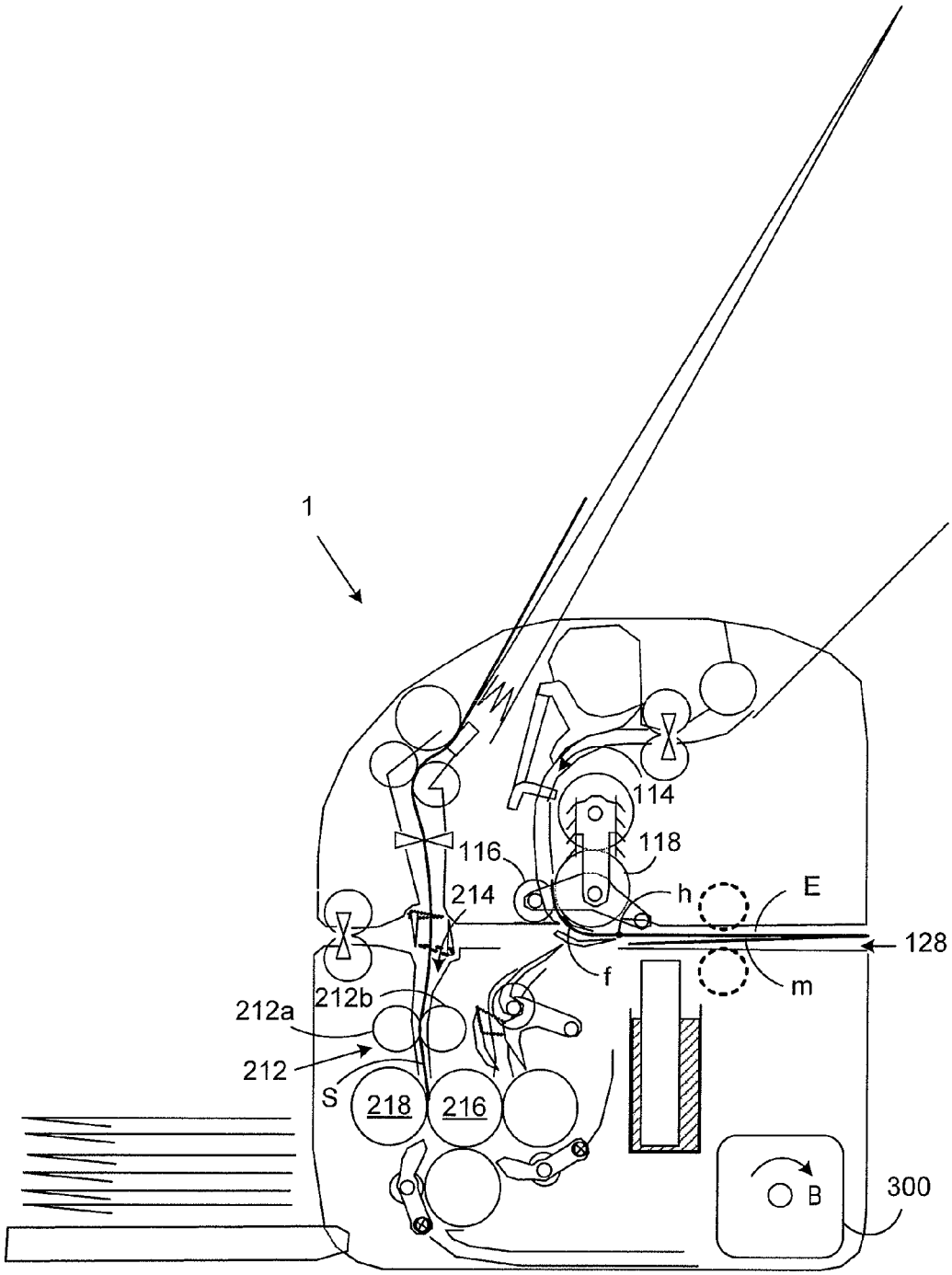

FIG. 14 illustrates that as motor 300 drives in the clockwise direction, the envelope E is further advanced into the envelope insertion path 128 by a further predetermined amount, based upon the previously detected position of the hinge h as it passed through the envelope inlet sensor pair 106. The envelope E is advanced by the predetermined amount by drive transmitted from the motor 300 to the driven envelope sealing feed roller 118, to advance the envelope E through the envelope flap securing nip formed between the driven envelope sealing feed roller 118 and the envelope flap securing roller 116 cooperating therewith.

Figure 18:
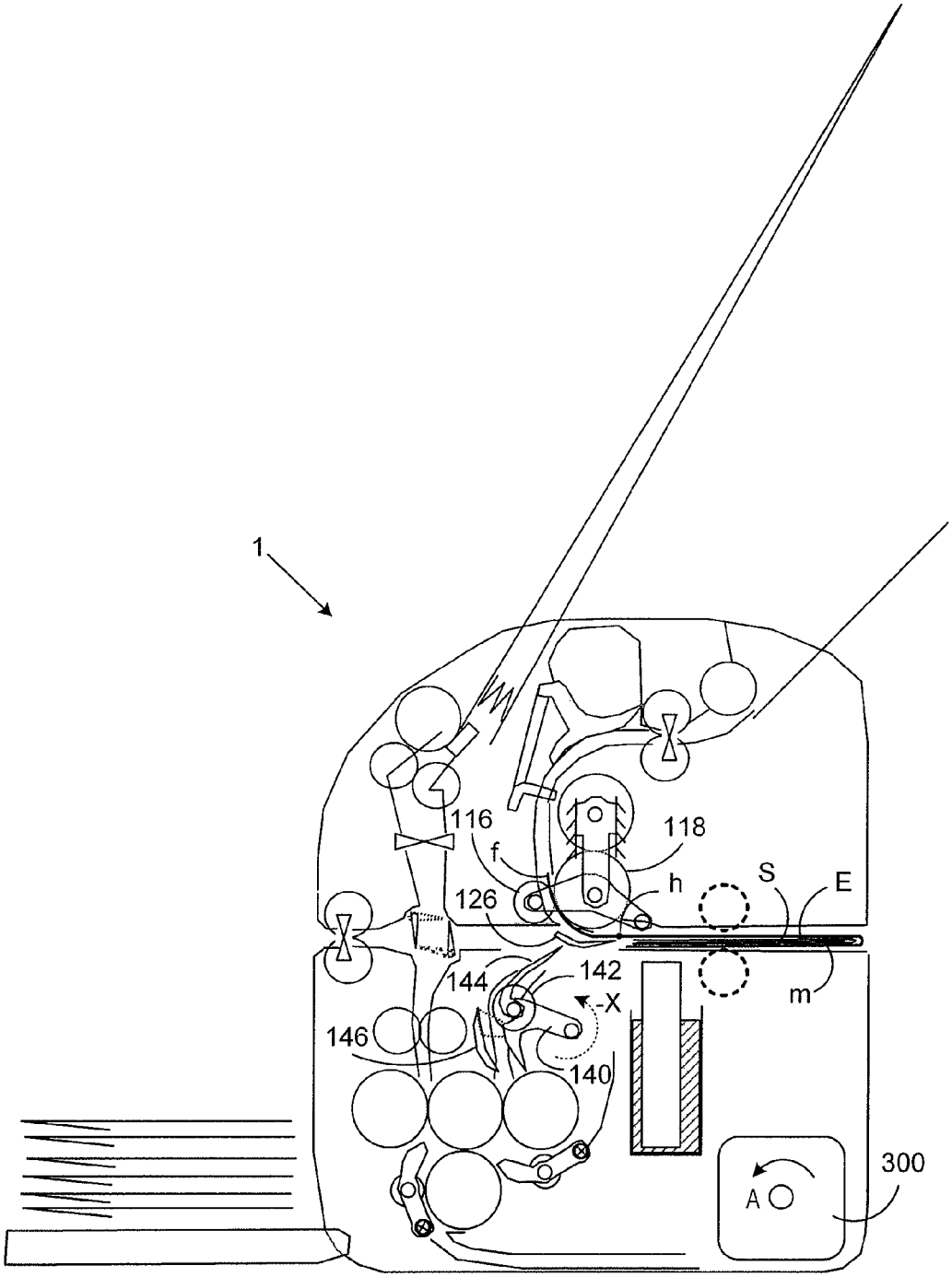
Figure 18A:
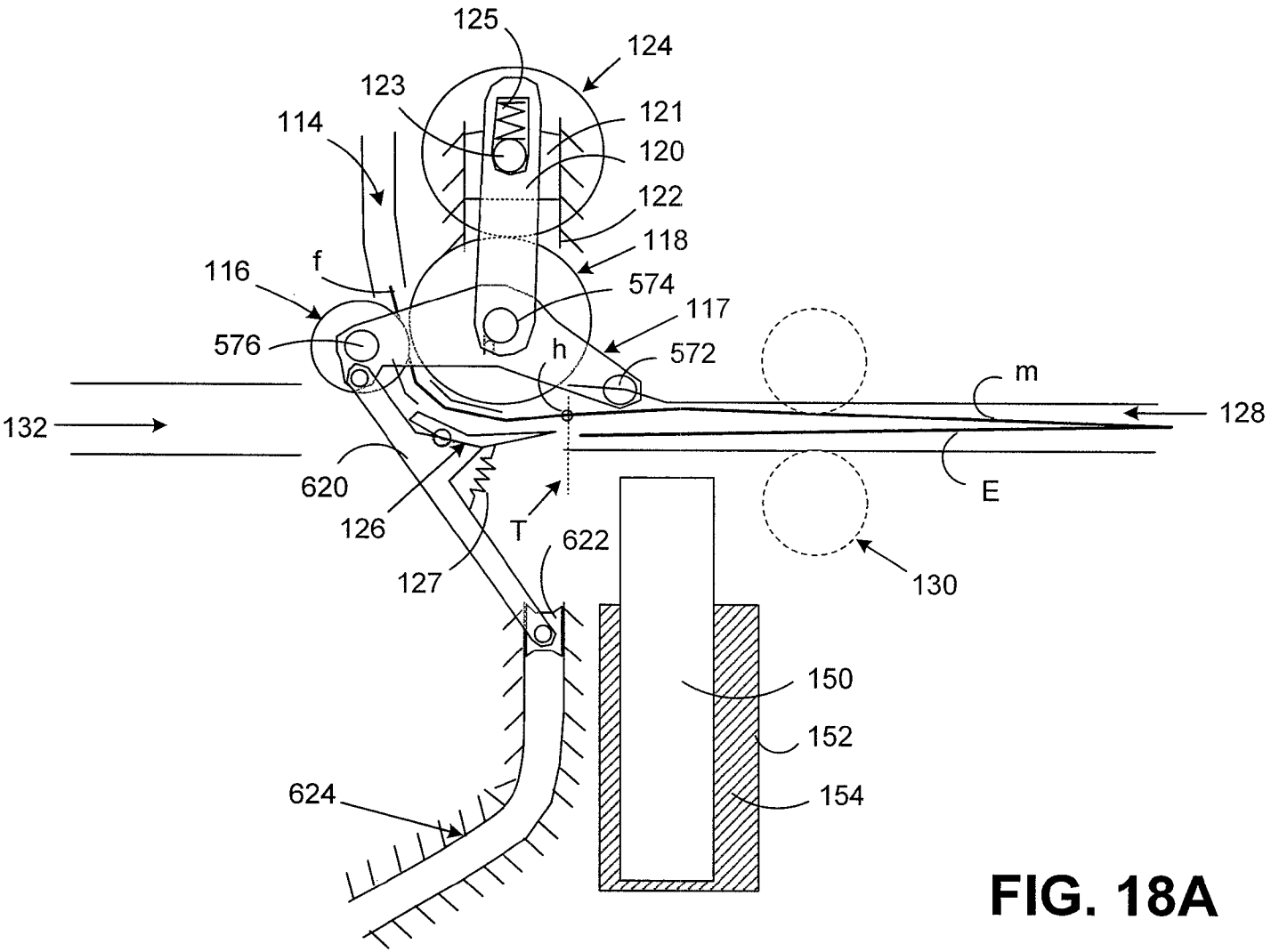
FIG. 18A is an enlarged cross-sectional side view showing schematically the detail of the envelope sealer mechanism in a flap securing location.

With brief reference to FIG. 18A, it will be seen that the envelope E is advanced until the hinge h reaches at least to a hinge threshold T, to or beyond which the hinge h must be advanced. The hinge h must be advanced at least to the threshold T so as to locate the hinge h at a location where, when the envelope sealer frame 120 is later moved from the flap securing position to the envelope sealing position, the envelope hinge h will be appropriately located in the vicinity of the sealing nip between driven envelope sealing feed roller 118 and cooperating envelope sealing roller 124. With the hinge located at the hinge threshold T, as noted above, the trailing edge of the envelope flap f is secured between driven envelope sealing feed roller 118 and the cooperating envelope flap securing roller 116, to maintain the envelope E in the envelope insertion path 128 with the flap f held securely in an open configuration.

Returning to FIG. 14, simultaneously as the envelope E is driven into the envelope insertion path 128, the sheet S is advanced by drive from the sheet folder deskew roller pair 212, since drive is transmitted to the driven sheet folder deskew roller 212*a* from the motor 300 as it rotates in the clockwise direction. This brings the leading edge of the sheet S into engagement with the roller nip between driven sheet folder roller 216 and the first cooperating folder roller 218. After both the sheet S and envelope E have been advanced by the predetermined further amount, the drive direction of motor 300 is changed.

Figure 15:
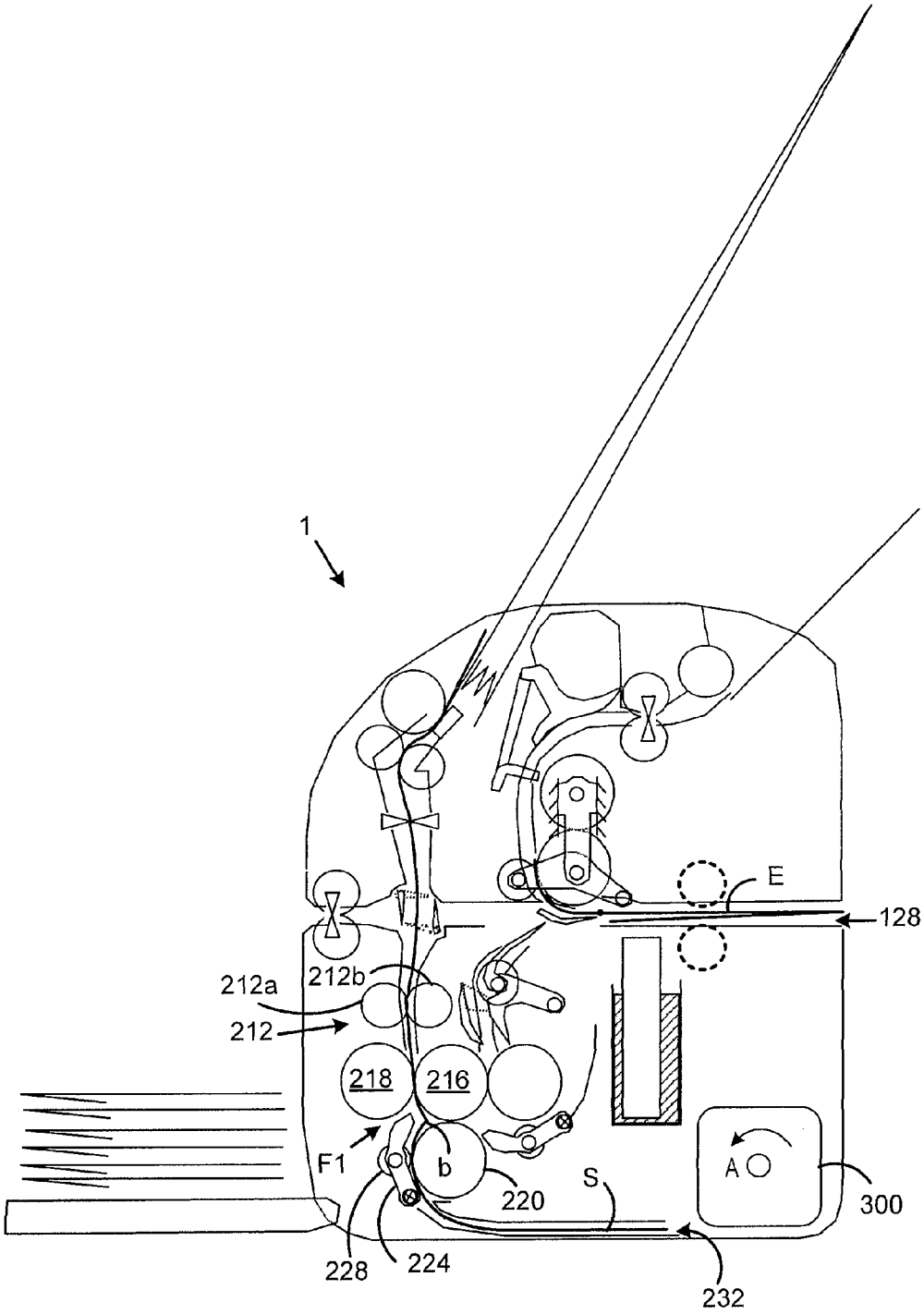
Figure 16:
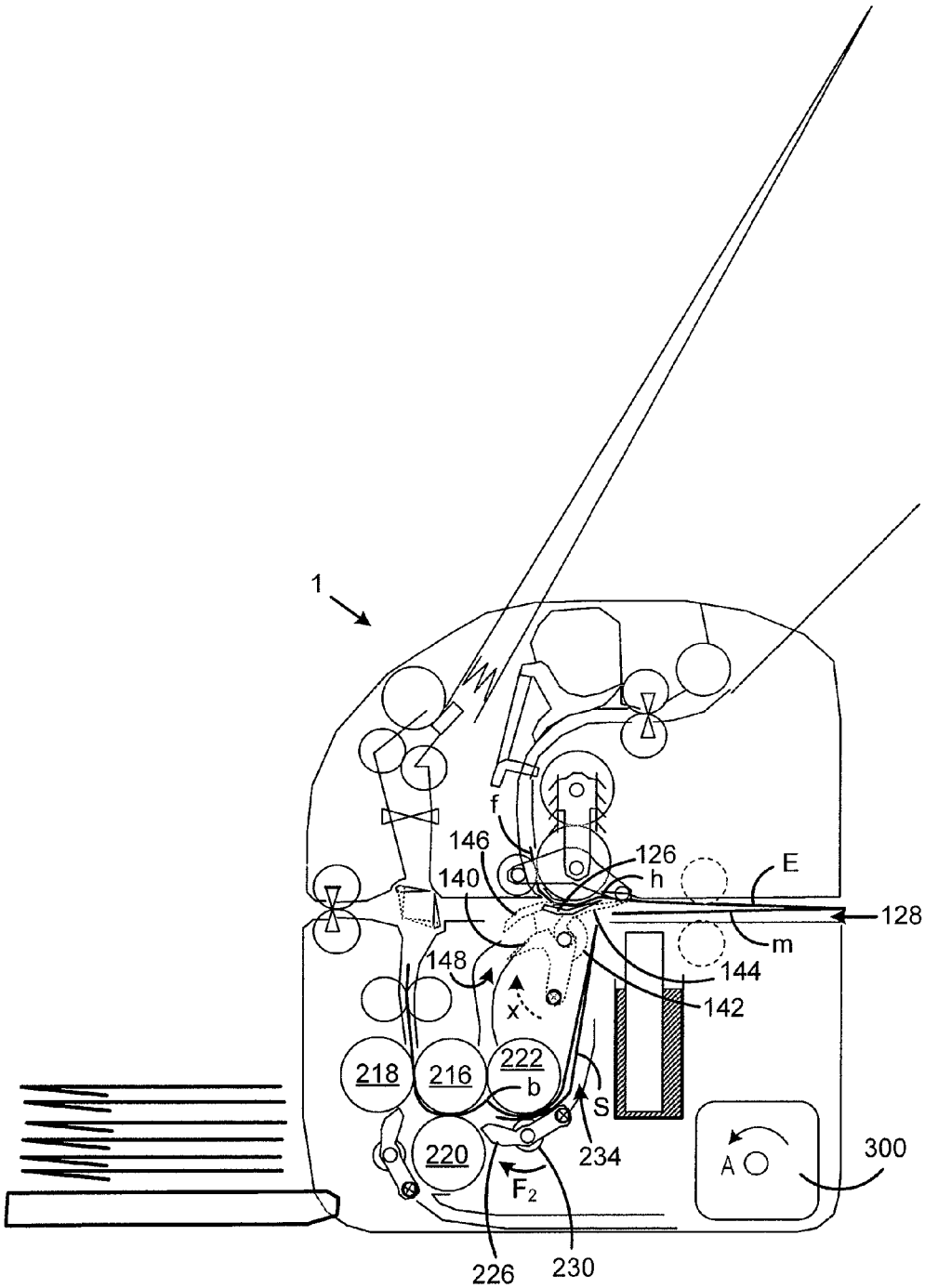
Figure 16A:
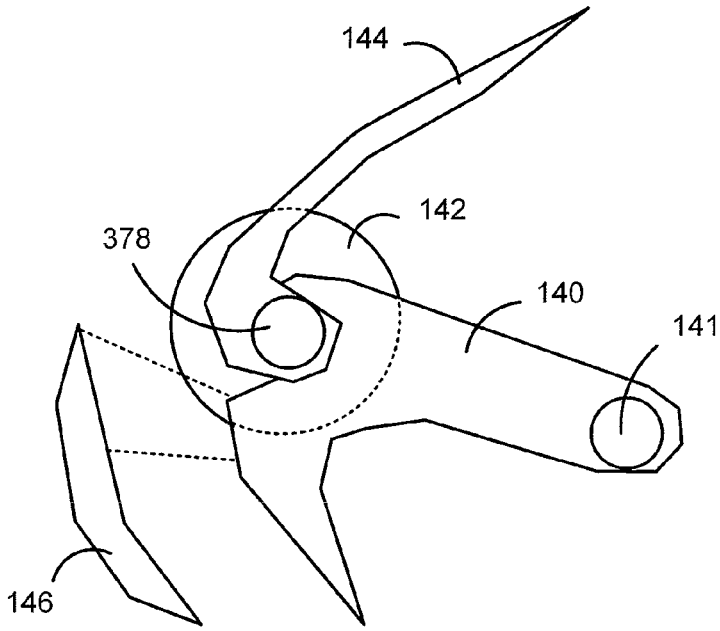
FIG. 16A is an enlarged cross-sectional side view showing schematically the detail of the main components of the insertion frame mechanism.
Figure 17:
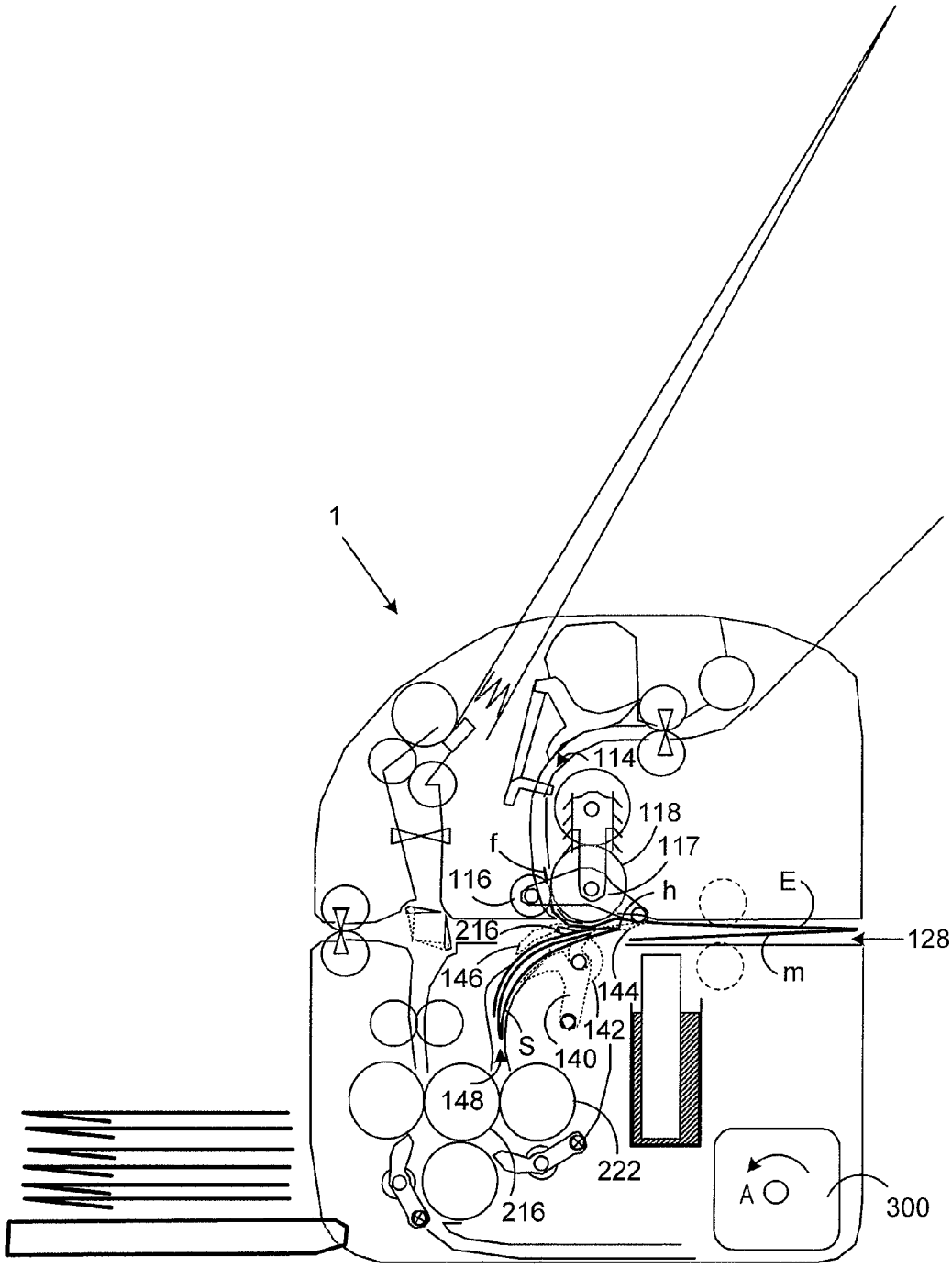

Motor 300 is now driven anticlockwise to perform the sheet folding operation described above with reference to FIG. 1. Referring now to FIGS. 15 to 17, the folding operation is described in more detail.

As motor 300 is driven anticlockwise, the sheet S is advanced by the driven sheet folder roller 216 and first cooperating folder roller 218 into buckle chute 232. When the sheet S has been advanced by a predetermined amount (such as by a predetermined number of pulses delivered to the motor or after being driven for a set period of time) the first buckle roller 228 is clamped against the second cooperating folder roller 220 to halt the sheet S, causing a buckle b to form in the sheet S at a point along the length of the sheet (see FIG. 15). First buckle finger 224 is then rotated in the direction marked by arrow F1 in FIG. 15, to force the formed buckle b into the sheet folder nip between driven sheet folder roller 216 and the second cooperating folder roller 220. Actuation of the buckle fingers 224, 226 and finger rollers 228, 230 is effected in accordance with a predetermined timing sequence, by the anticlockwise mechanical actuation system shown in FIG. 4, which is actuated by rotation of the anticlockwise cam 500. During this operation, the envelope E remains secured in the envelope insertion path 128.

Turning to FIG. 16, as the motor 300 continues to rotate in the anticlockwise direction, the sheet S is fed through the sheet folder nip between driven sheet folder roller 216 and second cooperating sheet folder roller 220, to form a fold at the location of the first buckle b. The folded sheet S is then advanced by the driven sheet folder roller 216 and the first cooperating sheet folder roller 220, between the second finger roller 230 and third cooperating roller 222, and along the second buckle chute 234, until the advancement of the sheet S is halted by clamping of the second finger roller 230, in accordance with the predetermined timing sequence of anticlockwise cam 500 and the associated actuation system of FIG. 4.

At the same time, the anticlockwise cam 500 continues to be rotated by drive transmitted from the motor 300, and thereby actuates rotation of the insertion frame 140 about the insertion frame pivot 141, from the retracted position shown in FIG. 15 to the insertion position shown in FIG. 16 in dashed lines. As indicated, the insertion frame 140 rotates around insertion frame pivot 141 in the direction of arrow X in FIG. 16, which, as shown in FIG. 16, is clockwise. As the insertion frame 140 is pivoted into the insertion position, the trap door 126 is forced upwards into the envelope insertion path 128, while the insertion fingers 144 are advanced into the mouth of the envelope E in the envelope insertion path 128. This brings the insertion roller 142 into proximity with the open mouth of the envelope E held securely with the flap f open in the envelope insertion path 128. As shown in FIG. 16, the insertion frame guide 146 forms a continuation of sheet insertion feed path 148, leading from the sheet folder section into the mouth of the envelope E in the envelope insertion path 128.

Further continued motor drive in the anticlockwise direction forms a second buckle b in the sheet S in proximity to the sheet folder nip formed between the driven sheet folder roller 216 and the third cooperating sheet folder roller 222. Again, in accordance with a predetermined timing routine, the anticlockwise cam 500 then actuates the second buckle finger 226 to rotate in the direction of arrow F2 shown in FIG. 16, thereby urging the buckle b into the nip between driven sheet folder roller 216 and the third cooperating folder roller 222.

The motor 300 continues to drive in the anticlockwise direction, to advance the sheet S through the roller nip between the driven sheet folder roller 216 and the third cooperating sheet folder roller 222, to create a fold at the location of the second buckle b as it is fed through the folder nip, and to advance the twice-folded sheet S along the sheet insertion feed path 148, as shown in FIG. 17. The folded sheet S is advanced along the sheet insertion feed path 148 into engagement with the insertion frame roller 142, in the region of the mouth of the envelope E. Since insertion roller 142 is driven by rotation of the motor 300 in the anticlockwise direction, the insertion roller 142 acts to advance the folded sheet S into the mouth of the envelope E until it is fully inserted into the envelope main body m.

Once the folded sheet S has been fully inserted into the envelope main body m, the anticlockwise cam 500 actuates the insertion frame control mechanism to retract the insertion frame 140 by rotation in the direction of arrow –X in FIG. 18, back to the retracted position. At this point, the envelope sealer mechanism is in the configuration shown in detail in FIG. 18A.

FIG. 18A illustrates how the cooperating envelope sealing roller 124 is held in pressing engagement with the driven envelope sealing feed roller 118 by biasing means 125 that biases the cooperating envelope sealing roller 124 towards the driven envelope sealing feed roller 118. The cooperating sealing feed roller 124 is mounted to an envelope sealer follower 121, which acts as a follower for the envelope sealer frame 120 which maintains the biased cooperating envelope sealing roller 124 and driven envelope sealing feed roller 118 in functional approximation to one another.

As can also be seen in FIG. 18A, the trap door 126 is pivotally mounted to a follower arm 620, which is connected at one end to the envelope securing frame 117. The trapdoor 126 is biased in the clockwise direction, as seen in FIG. 18A, by biasing means 127 mounted to the follower arm 620. The lower end of the follower arm 620 is mounted by a rotational joint to a follower body 622 that is constrained to follow follower track 624 as the sealer link mechanism 550 is actuated.

Figure 19:
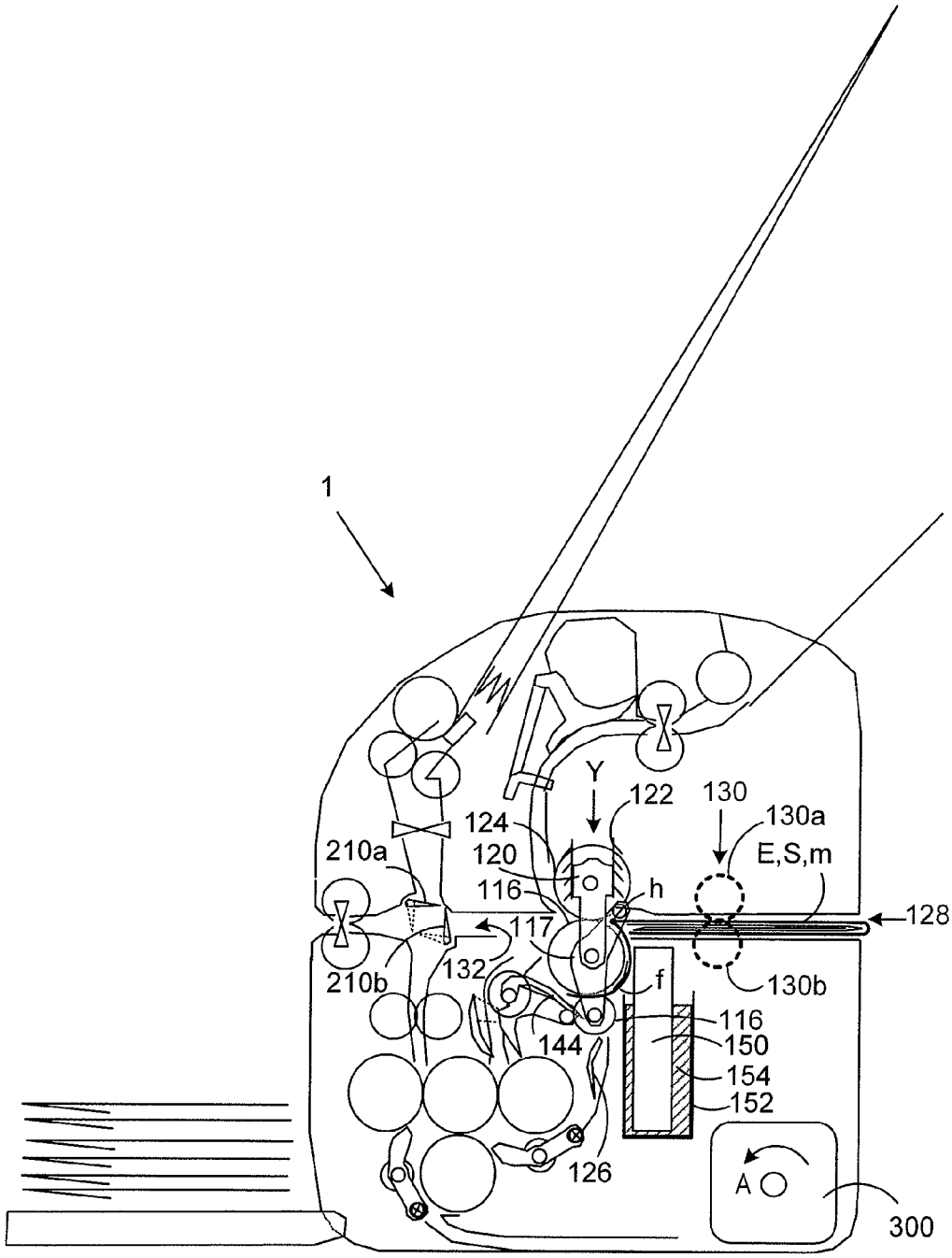
Figure 19A:
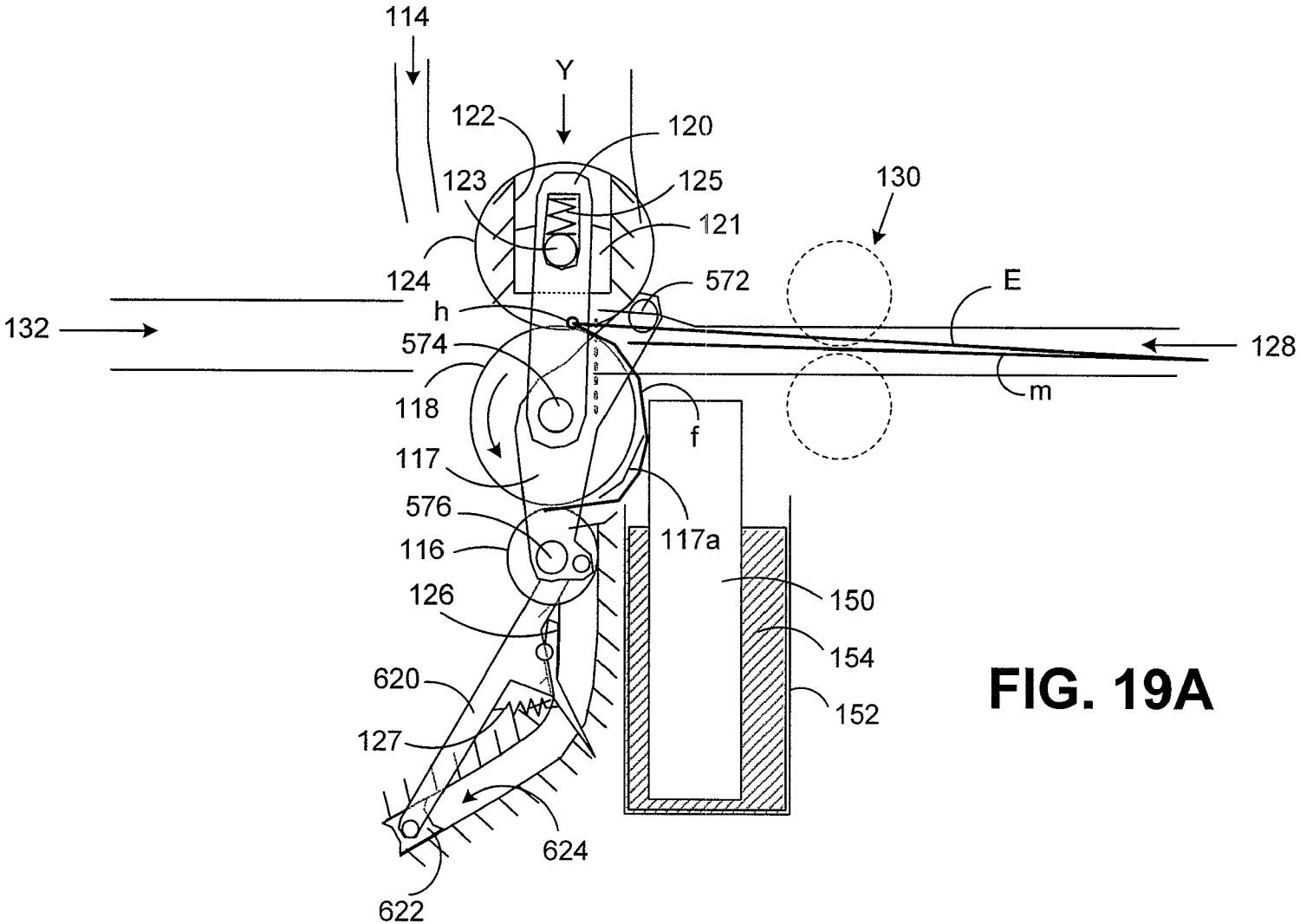
FIG. 19A is an enlarged cross-sectional side view showing schematically the detail of the envelope sealer mechanism in a sealing location.

After the driving operation for folding and inserting the sheet S into the envelope E main body m, and return of the insertion frame 140 to the retracted position, continued anticlockwise drive from motor 300 drives the anticlockwise cam 500 to actuate the sealer link mechanism 550. This causes the envelope sealer frame 120 to transition from the flap securing position in FIG. 18A to the envelope sealing position shown in FIGS. 19 and 19A. The envelope sealer frame 120 is arranged to transition from the flap securing position to the envelope sealing position substantially in the direction of the arrow Y shown in FIG. 19. As shown in FIGS. 19 and 19A, this brings the nip between the driven envelope sealing feed roller 118 and cooperating envelope sealing roller 124 into the region of the hinge h of the envelope E held in the envelope insertion path 128. As the envelope sealer frame 120 transitions in the direction of arrow Y, the envelope securing frame 117 is rotated about pivot 572, causing the envelope flap securing roller 116 to rotate around the outside of the driven envelope sealing feed roller 118 as the envelope sealing frame 120 descends, thereby maintaining the flap f of the envelope e secured in the nip between the envelope flap securing roller 116 and the driven envelope sealing feed roller 118. Because the trap door 126 is mounted on the follower arm 620, which is connected at one end to the envelope securing frame 117, the trap door 126 is simultaneously transitioned out of the path of the descending envelope sealing mechanism as the envelope securing frame rotates and the envelope sealer frame transitions from the flap securing position to the envelope sealing position, with the lower end of the follower arm 620 following the motion of the follower body 622 as it traces along follower track 624. The trapdoor 126 is then displaced to a retracted position, as shown in detail in FIG. 19A.

At the same time as the envelope sealing frame 120 transitions across the envelope insertion path 128, the slider link mechanism shown in FIG. 4 is actuated so as to bring the driven envelope insertion path feed roller 130*a* into cooperative engagement with the filled envelope E and cooperating envelope insertion path feed roller 130*b*.

FIG. 19A further illustrates in detail how the underside of the envelope flap f is brought into proximity or engagement with the moistener wick 150 for applying a moistening fluid 154 held in a moistener fluid container 152 to the sealing gum on the underside of envelope flap f.

Figure 20:
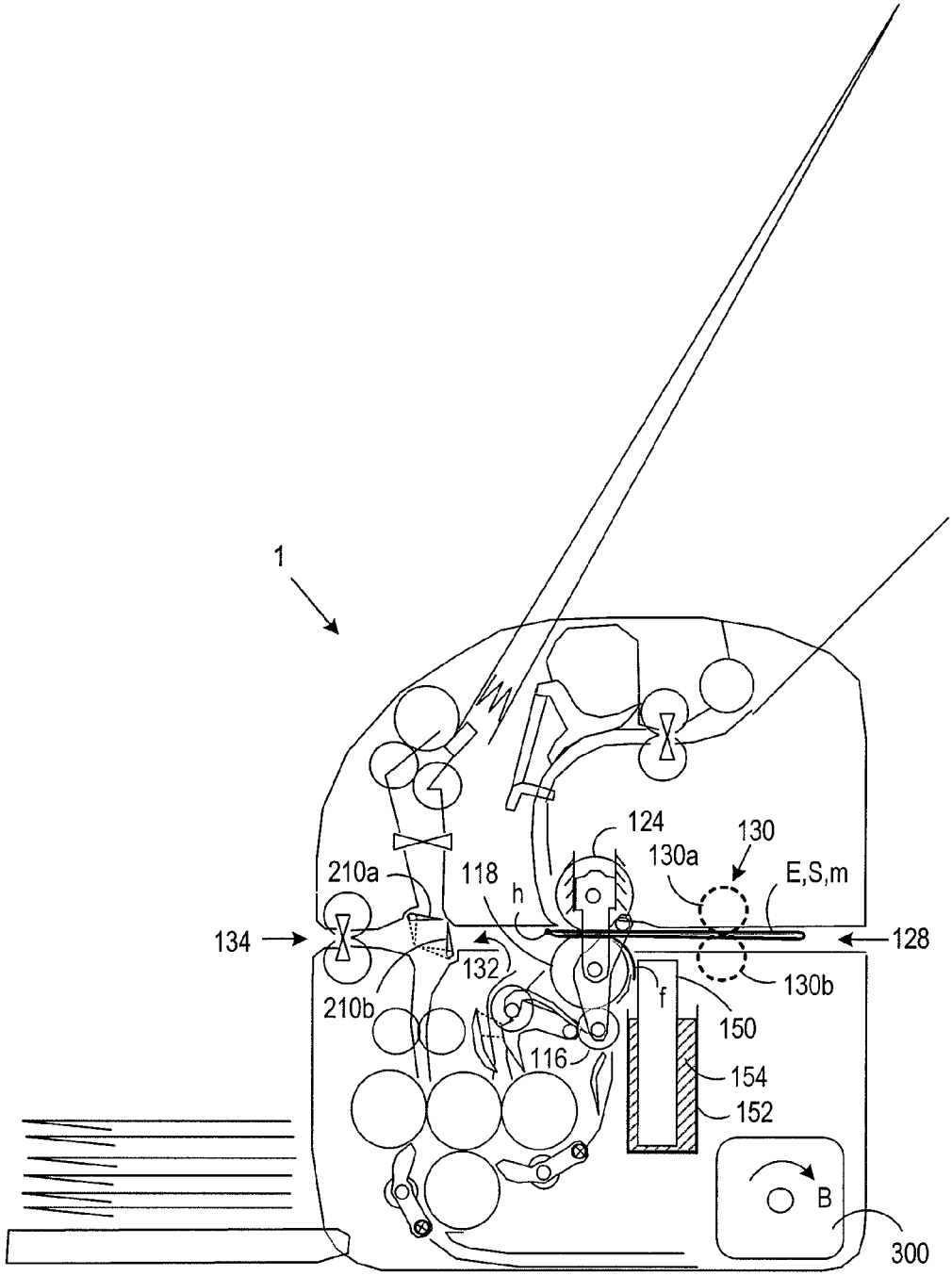

Once the envelope sealing frame has transitioned from the flap securing position to the envelope sealing position, the motor 300 drive direction is again reversed. Motor 300 now drives in the clockwise direction, as shown in FIG. 20. This transmits drive to the driven envelope sealing feed roller 118 and the driven envelope insertion path feed roller 130*a*, causing the envelope E situated in the envelope insertion path 128 to be advanced by the hinge h through the sealing nip between driven envelope sealing feed roller 118 and cooperating envelope sealing roller 124. As the driven envelope sealing feed roller 118 rotates, the envelope flap f is released from secure engagement between the driven envelope sealing feed roller 118 and the envelope flap securing roller 116, allowing the flap f to become closed against the main body m of the envelope E, as it is advanced through the sealing roller nip. This brings the moistened sealing gum on the underside of the envelope flap f into pressing engagement with the main body m of the envelope, to firmly secure the flap f to the envelope main body m, to form a completed mail piece M.

Figure 19B:
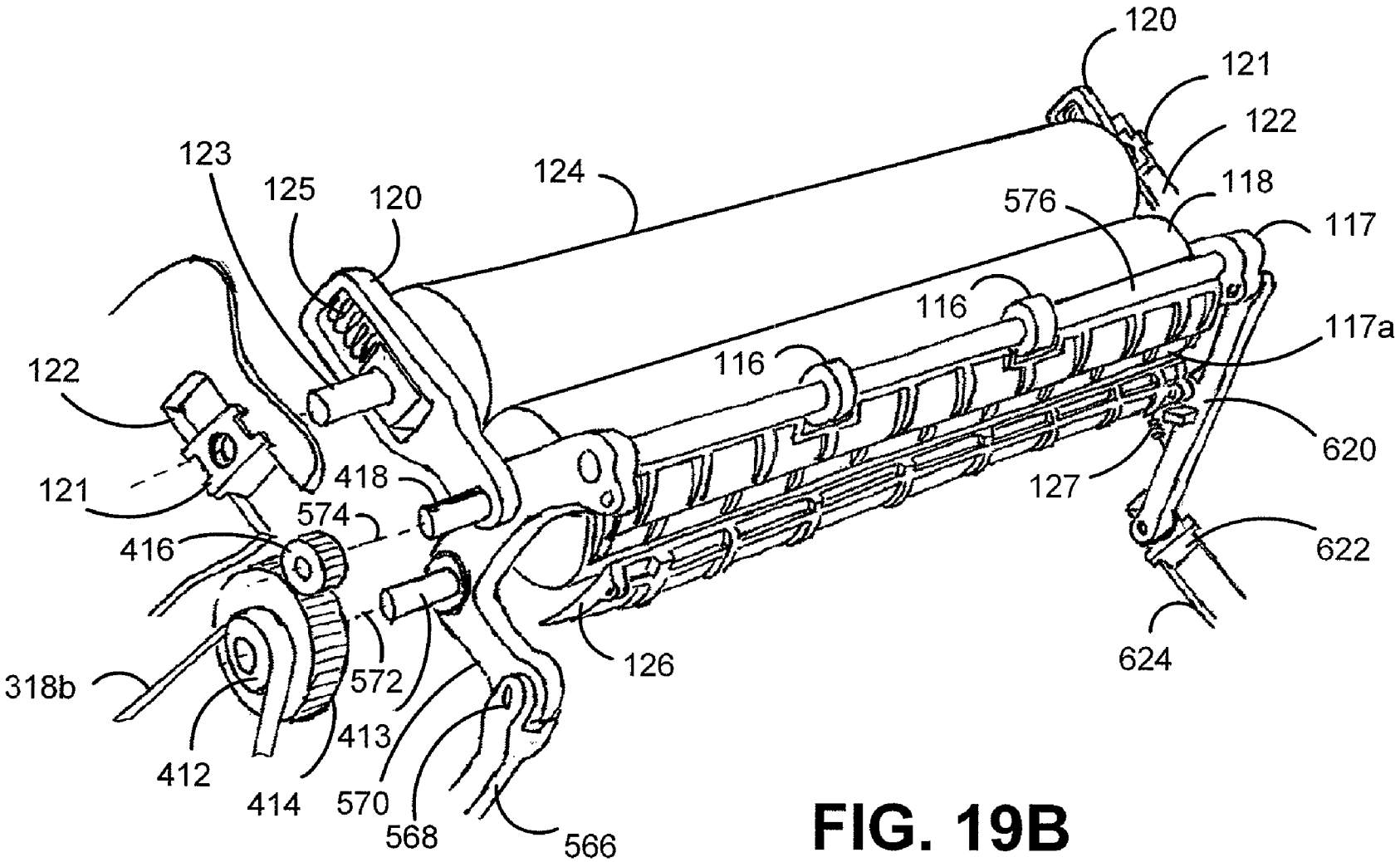
FIG. 19B is a perspective view showing schematically the arrangement of the main components of the sealer mechanism.

Referring now briefly to FIG. 19B, the constructional detail of the sealer mechanism main components is shown in perspective view from the bottom-front-left side of mailpiece creation apparatus 1.

In particular, it can be seen how the driven envelope sealing feed roller 118 and envelope flap securing roller 116 are cooperatively mounted on one side to the envelope securing frame 117 (right hand side in FIG. 19B) and on the other side to the sealer securing and actuating frame 570, with drive provided from second direction B drive belt 318*b* via sealer drive transfer gears 414 and 416. It can also be seen how the envelope sealer frame 120 is configured to maintain cooperating sealer roller 124 in biased engagement with driven envelope sealing feed roller 118 while being constrained to follow follower 121 along follower path 122.

The right hand side of FIG. 19B shows how trapdoor 126 is mounted to follower arm 620, with biasing force provided by trapdoor biasing means 127. Follower arm 620 is rotationally joined to follower body 622 that slides in follower track 624, to allow trapdoor 126 to be moved out of the line of travel of the envelope sealer frame as it moves to the envelope sealing position. It can be seen how follower path 121 and follower track 624 may be formed in side plates defining the left-and-right hand edges of the paper and envelope feed paths, for example.

Similar to FIGS. 7, 8 and 9, FIG. 19B demonstrates how the various drive and actuation mechanisms of FIGS. 4 to 6 can be located on either side of the mailpiece creation apparatus 1.

Returning to the sequence of operation, as the clockwise rotation of the motor 300 is initiated, as shown in FIG. 20, the feed path selector flaps 210*a* and 210*b* are switched from their original positions, in which they allowed passage from the sheet inlet feed path 208 to the sheet folder inlet feed path 214, to their alternative position, allowing transition from the mailpiece feed path 132 to the mailpiece outlet feed path 134. As the motor 300 is driven further in the clockwise driving direction, the completed mail piece M is advanced by the envelope hinge h along the mailpiece feed path 132, and along the mailpiece outlet feed path 134, into engagement with the mailpiece outlet feed roller pair 136.

Figure 21:
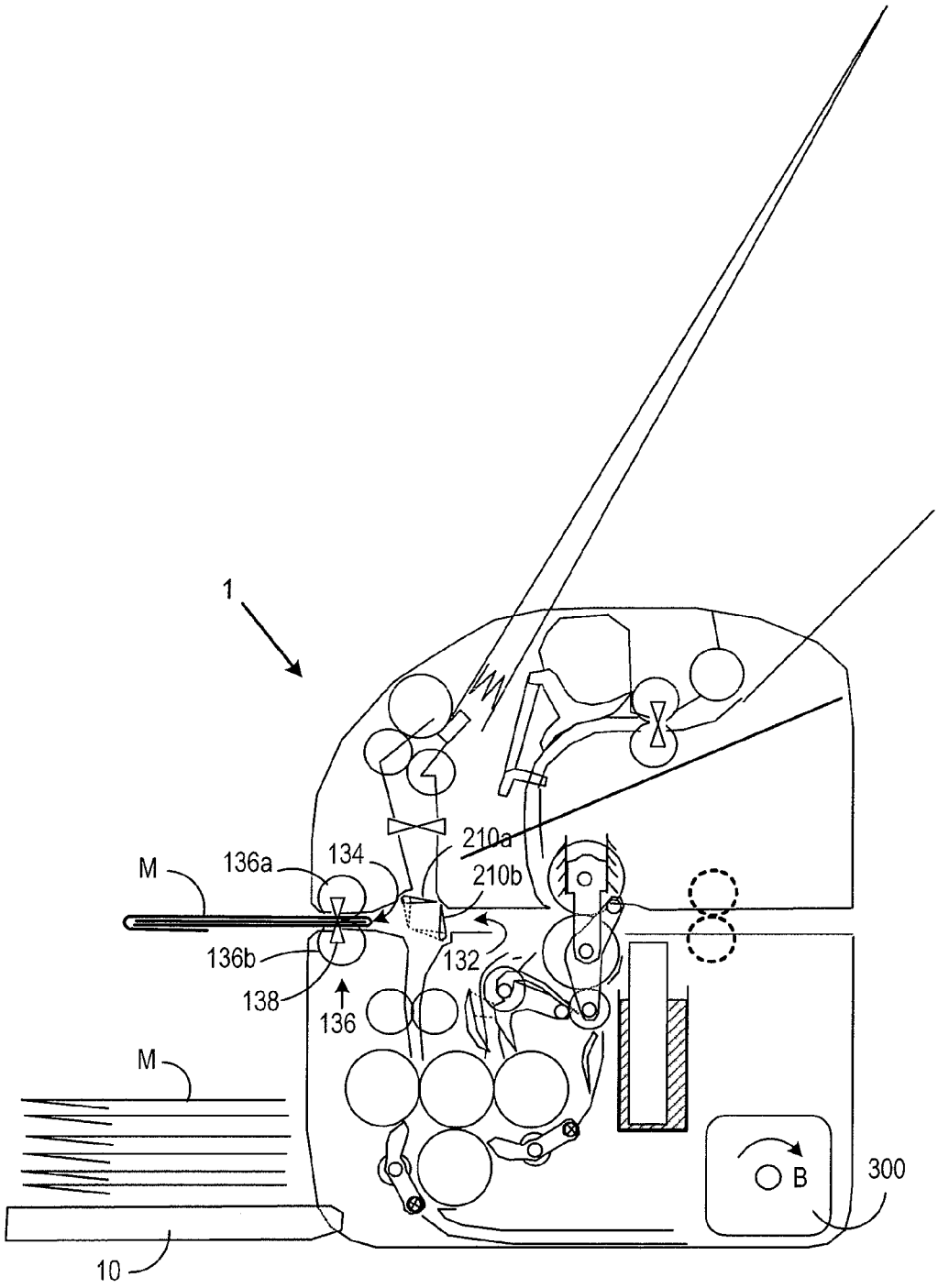
Figure 22:
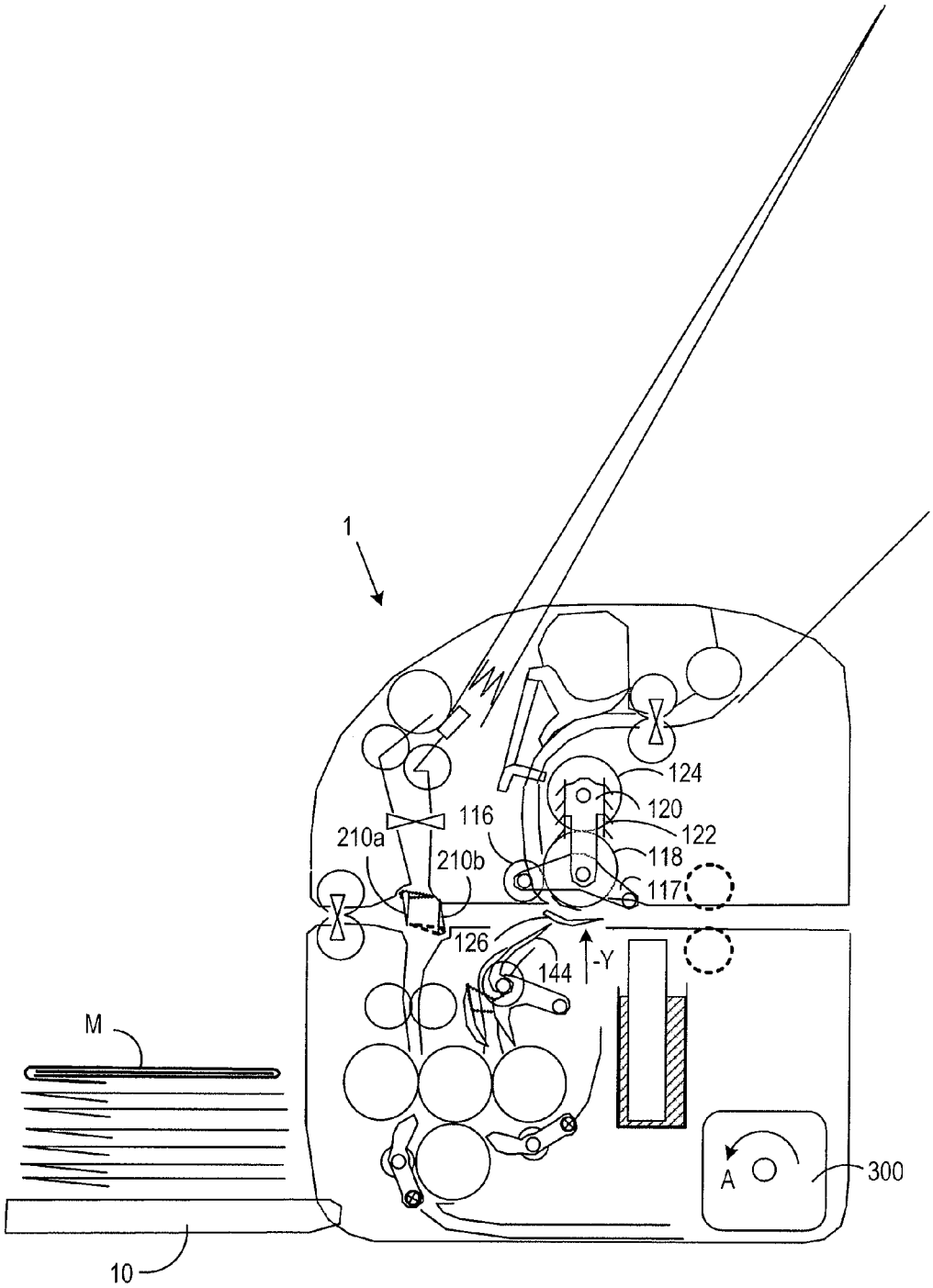

As shown in FIG. 21, the completed mailpiece M is then ejected from the mailpiece outlet feed path 134 as the continued clockwise rotation of motor 300 drives driven mailpiece outlet feed roller 136*a*, ejecting the completed mailpiece M from the mailpiece outlet feedpath 134 to land on the mailpiece collection tray 10. After the completed mailpiece M has been ejected, the motor 300 continues to rotate in the clockwise direction until the clockwise cam 600 has been returned to the home position, ready for the initiation of a new mailpiece creation cycle. Once the clockwise cam 600 has been returned to the home position, the motor 300 changes drive direction.

Motor 300 now drives in the anticlockwise direction to return the anticlockwise cam 500 to its respective home position, ready for re-initiation of a mailpiece creation cycle. As the anticlockwise cam 500 is returned to the home position, it actuates the sealer actuation link mechanism 550 in the reverse direction, shown as arrow Y in FIG. 22, to return the sealer frame 120 to the flap securing position.

Figure 23:
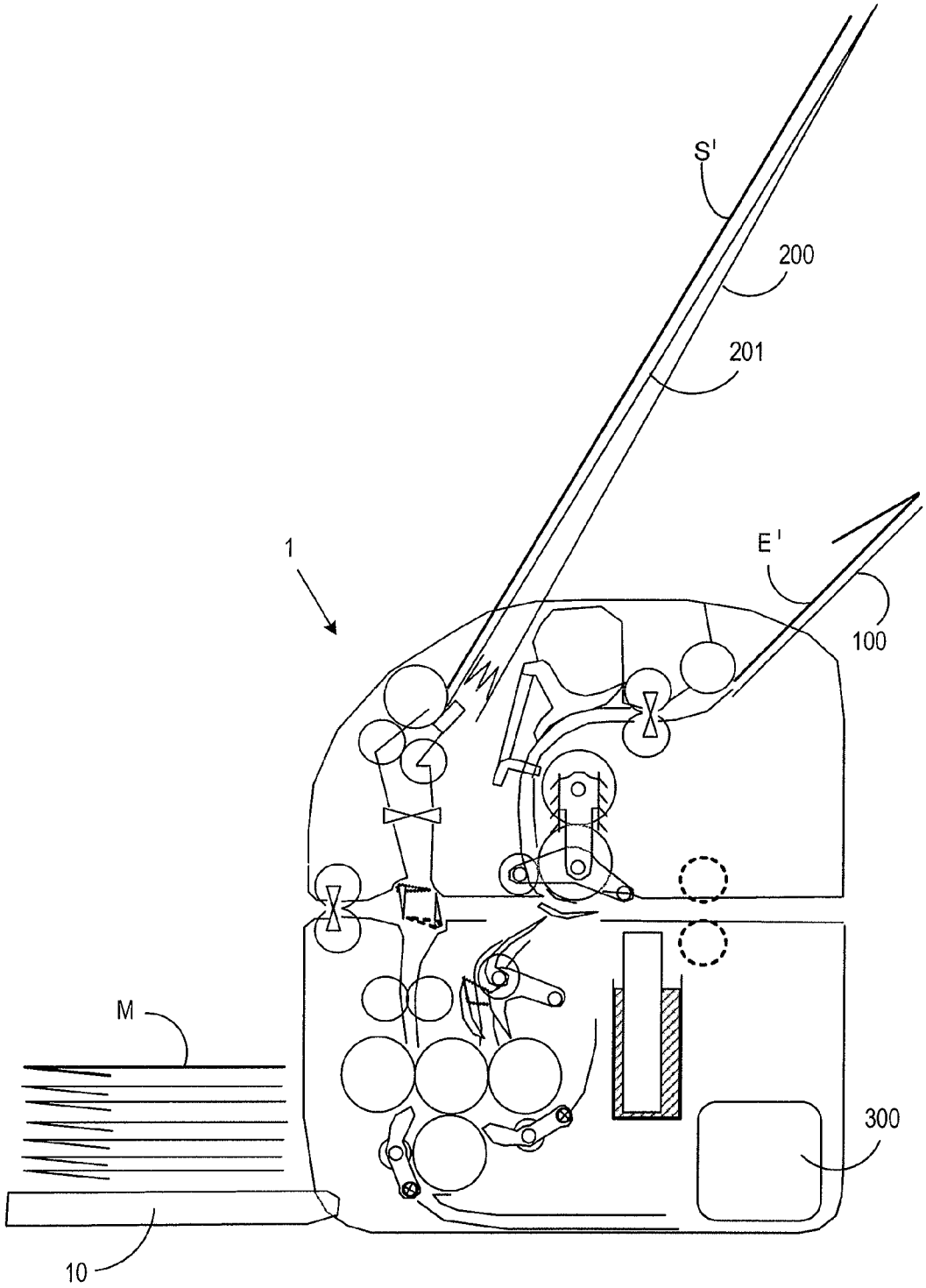

Once the anticlockwise cam 500 has been returned to the home position, the cycle has been completed and the mailpiece creation apparatus 1 is ready for initiation of a new mailpiece creation cycle to be performed on a subsequent sheet S' and a subsequent envelope E', as shown in FIG. 23. Typically the re-initiation process will also return feed path selection flaps 210*a* and 210*b* to their preferred initial position, ready for insertion of sheet S' from the sheet inlet feed path 208 through to the sheet folder inlet path 214.

It will be appreciated that, in a preferred embodiment, the feed path selection flaps 210*a* and 210*b* are not, in fact, actuated, but are arranged with flap 210*a* biased anticlockwise and flap 210*b* biased clockwise, as seen in FIG. 1, so that they act as unidirectional flow gates, allowing the sheets S and mailpieces M to pass through only in the intended feed direction, by the sheets S and mailpieces M being driven against the flaps 210*a* and 210*b* to over come the biasing forces and open them to bridge the gap at the crossing point between the feed paths 208, 214, 132 and 134. This, again, reduces the complexity of the control system needed to control operation of mailpiece creation apparatus 1.

The above described mailpiece creation apparatus 1 produces many advantageous technical effects.

One such advantageous effect derives from the fact that a number of the described systems are complementary with one another to produce a mailpiece creation apparatus that has an overall reduced size, as compared with known such devices, and that is truly suitable for desktop applications. For example, the provision of buckle fingers 224 and 226 for deflecting the buckles b in the sheet S into the folder roller nips allows a compact configuration of the buckle chutes 232 and 234. Similarly, the provision of several different interacting features, such as the insertion frame 140, trap door 126, and the movable envelope sealer frame 120, the provision of a link actuated flapper mechanism 110, and the provision of feed path selector flaps 210*a* and 210*b* that allow different feed paths to cross, all contribute to provide a mailpiece creation apparatus 1 having a compact and reduced-volume series of sheet-, envelope- and mailpiece-feed paths. This enables an uninterrupted flow of the materials through the mail piece creation apparatus 1, and reduces the overall size of the mailpiece creation apparatus 1.

Further advantage is achieved through the use of the continuously engaged drive mechanisms of FIGS. 3 and 5, and the mechanical link actuation mechanisms of FIGS. 4 and 6, which enable the entire mail piece creation process to be carried out utilising a single motor 300. This reduces the cost of the components for the mailpiece creation apparatus 1 by reducing the number of expensive motors typically needed for controlling a mailpiece creation cycle. In an alternative embodiment, however, a second motor may be provided in the upper housing 2, as well as in the lower housing 3, so that the mailpiece creation apparatus can be split between the two housings 2 and 3 along the line of the envelope insertion path 128, mailpiece feed path 132 and mailpiece outlet path 134, to allow access to the internal components of the mailpiece creation apparatus 1 for jam clearance, and other maintenance, without necessitating the provision of drive transfer means for transferring motor drive between the upper and lower halves 2 and 3 of the housing.

More fundamentally, by utilising the mechanical selective drive transfer mechanisms of FIGS. 4 and 6, based on a cam control system, the entire sequence of the mailpiece creation process can be carried out without reliance on complex and expensive components, such as electrically actuated clutches and for engaging drive with the various driven components, and actuators for actuating the various internal mechanisms of the apparatus, at an appropriate timing for carrying out the mailpiece creation process in the correct sequence. As can be seen from the foregoing description of the mailpiece creation cycle, relatively few processor steps are required to control the operation, which can be controlled based only upon the selected detection inputs from the three sensor pairs 106, 206 and 138, located at the two inlets and the outlet from the mailpiece creation apparatus 1. Accordingly an expensive processor with a complex control program is not required, reducing the production and design cost and complexity of the mailpiece creation apparatus 1, as compared with typical mailpiece creation device construction.

A further feature reducing the complexity of the described mailpiece creation apparatus 1 is the provision of the mechanically actuated flapper mechanism 110, which operates without any control input required, instead being actuated simply by the passage of the envelope E along the envelope flapping path 114. This reduces the requirement for any associated sensor and microprocessor control system for actuating the flapper mechanism according to the detected position of the envelope E.

Further, by providing a small, compact mailpiece creation device, the needs of individual users, who require a less complex piece of mailpiece creation equipment, can be met, without the device occupying a large portion of available office space or requiring special operator training.

Additional flexibility to accommodate variations in the contents of the mailpiece to be created is also provided by the use of a transitioning envelope sealer frame 120, which transitions across the mail piece feed path 132, without requiring the completed mail piece M to be transported around a curved feed path. This enables rigid, non-flexible mail items to be inserted into the envelope E as it is held securely in the envelope insertion path 128, prior to sealing the envelope flap f against the envelope main body m. In this manner, non-flexible items, such as card items, CDs, pens, and the like, can be inserted into the envelope E as it is held securely in the envelope insertion path 128, prior to sealing the envelope and ejecting it from the mailpiece creation apparatus 1 along the mailpiece feed path 132 and mailpiece outlet feed path 134. This ability is furthered, as noted above, by the provision of pivotally-mounted driven envelope insertion path feed roller 130*a* that is able to accommodate different thicknesses of filled envelope E, while still being able to provide drive through the sealing nip.

While the above illustrated example of a mailpiece creation apparatus 1 has been described in terms of the complete arrangement for carrying out a particular mailpiece creation process, it will be appreciated that the individual components of the mail piece creation apparatus can be utilised in similar types of sheet handling machines, having similar and related functions for mechanically handling sheets of paper and envelopes. In particular, it will be appreciated that the cam-actuated selective drive transmission mechanism, by which the envelope separator roller 102 and sheet separator roller 202 are selectively engaged for feeding an envelope E or sheet S, respectively, can be adapted to provide selective drive to any sheet or envelope feed roller in the various sections of a paper handling device, as required for any particular sheet handling task, not restricted to the inlet separator feed rollers.

The invention claimed is:

1. A sheet handling machine comprising:

A. a drive source;

B. a first driven shaft arranged to receive drive from said drive source at least when said drive source drives in a first direction of rotation;

C. a feed roller shaft;

D. a feed roller mounted on said feed roller shaft for feeding sheets when said feed roller shaft is driven;

E. rotatably supported drive transmission means for selectively engaging drive transmission from said first driven shaft to said feed roller shaft in dependence upon the rotational position of said drive transmission means:

wherein said drive transmission means is:

a support arm rotatably supported at a pivot so as to be selectively pivotable between a first angular position in which the transmission means is disengaged from transmitting drive from said first driven shaft to said feed roller shaft and a second angular position in which the transmission means is engaged to transmit drive from said first driven shaft to said feed roller shaft;

a drive receiving member mounted on said feed roller shaft for receiving drive so as to drive said feed roller shaft, wherein:

said drive receiving member is a friction roller;

said drive transferring member is a friction roller rotationally mounted on said support arm;

when the support arm is in the first position, said drive transferring member is frictionally decoupled from said drive receiving member;

when the support arm is in the second position, said drive transferring member is frictionally coupled to said drive receiving member, so that rotation of the drive transferring member causes rotation of said drive receiving member, thereby to transfer drive from said drive transferring member to said feed roller shaft; and wherein said drive transmission means further comprises:

a drive transferring member mounted on said support arm spaced apart from the pivot of said support arm, the drive transferring member being disengaged from said drive receiving member when the support arm is in the first position, and being configured to engage said drive receiving member when the support arm is in the second angular position, thereby to transfer drive from said drive transferring member to said drive receiving member so as to drive said feed roller shaft.

2. The sheet handling machine of claim 1, wherein:

the support arm pivot is arranged coaxially with the rotational axis of said first driven shaft; and the drive transmission means further comprises:

a first drive transmission member mounted on said first driven shaft; and a second drive transmission member mounted on said support arm at a location spaced apart from said first drive transmission member and arranged so as to be rotationally coupled to said drive transferring member, the first and second drive transmission members being coupled to one another for transmitting drive from said first drive transmission member to said second drive transmission member, thereby to transmit drive from said first driven shaft to said drive transferring member.

3. The sheet handling machine of claim 2, wherein:

the first drive transmission member is a pulley;

the second drive transmission member is a pulley mounted on a common shaft with the drive transferring member; and the drive transmission means further comprises a drive belt that couples said first and second drive transmission members.

4. The sheet handling machine of claim 3, wherein the first driven shaft is arranged to receive drive from said drive source only when the drive source drives in the first direction of rotation.

5. The sheet handling machine of claim 1, further comprising:

a second driven shaft arranged to receive drive from said drive source only when said drive source drives in a second direction of rotation opposite to the first direction of rotation;

at least one further feed roller shaft having a feed roller mounted thereon for feeding sheets when said at least one further feed roller shaft is driven; and a second rotatably supported drive transmission means for selectively engaging drive transmission from said second driven shaft to said at least one further feed roller shaft in dependence upon the rotational position of said second drive transmission means.

6. The sheet handling machine of claim 1, wherein said drive transmission means comprises:

a cam shaft arranged to receive drive from said drive source at least when said drive source drives in a second direction of rotation which is opposite to said first direction of rotation;

a cam rotatably supported to rotate with the cam shaft, the cam defining a cam surface;

a drive engaging support means, including a cam follower constrained to maintain contact with the cam surface, wherein the cam surface is shaped to vary the position of the cam follower as the rotational position of the cam is varied with rotation of the cam shaft, thereby to actuate the drive engaging support means in order to selectively engage drive transmission from said first driven shaft to said feed roller shaft in dependence upon the rotational position of said cam.

* * * * *